US006702501B2

(12) United States Patent
Chizmar

(10) Patent No.: US 6,702,501 B2
(45) Date of Patent: Mar. 9, 2004

(54) LOOSE-LEAF BINDER

(75) Inventor: James S. Chizmar, 137 Sullivan St., Apt #12, New York, NY (US) 10012

(73) Assignee: James S. Chizmar, New York, NY (US)

( * ) Notice: Subject to any disclaimer, the term of this patent is extended or adjusted under 35 U.S.C. 154(b) by 127 days.

(21) Appl. No.: 10/123,000

(22) Filed: Apr. 15, 2002

(65) Prior Publication Data

US 2002/0159822 A1 Oct. 31, 2002

Related U.S. Application Data

(63) Continuation-in-part of application No. 09/698,838, filed on Oct. 27, 2000, now Pat. No. 6,371,678, which is a continuation of application No. 09/296,377, filed on Apr. 22, 1999, now Pat. No. 6,196,749.

(51) Int. Cl.[7] ..... B42F 13/20

(52) U.S. Cl. ..... 402/42; 402/31; 402/43; 402/73; D19/27

(58) Field of Search ..... 402/26, 31, 32, 402/33, 42, 43, 73, 500, 502; D19/26, 27

(56) References Cited

U.S. PATENT DOCUMENTS

| | | | | |
|---|---|---|---|---|
| 659,860 | A | 10/1900 | Schild | |
| 842,851 | A | 2/1907 | Boden | |
| 854,074 | A | 5/1907 | Bryant | |
| 857,377 | A | 6/1907 | Baker | |
| 901,549 | A | 10/1908 | Nelson | |
| 924,647 | A | 6/1909 | Eddy | |
| 974,831 | A | 11/1910 | Scherzinger | |
| 1,228,866 | A | 6/1917 | Amoroso | |
| 1,398,388 | A | 11/1921 | Murphy | |
| 1,710,493 | A | 4/1929 | Valkenburgh | |
| 1,827,592 | A | 10/1931 | Lewis | |
| 2,051,738 | A | 8/1936 | Ottinger | 129/1 |
| 2,185,004 | A | 12/1939 | Trussell | 281/25 |
| 2,206,317 | A | 7/1940 | Behn | 129/24 |
| 2,268,431 | A | 12/1941 | Slonneger | 129/24 |
| 2,331,461 | A | 10/1943 | Dawson et al. | 129/1 |
| 2,715,906 | A | 8/1955 | Lucchesi | 129/24 |
| 2,764,162 | A | 9/1956 | Valla | 129/1 |
| 2,924,221 | A | 2/1960 | Dudley-Smith | 129/10 |
| 3,190,293 | A | 6/1965 | Schneider et al. | 129/24 |
| 4,130,368 | A | 12/1978 | Jacoby et al. | 402/41 |
| 4,798,491 | A | 1/1989 | Lässle | 402/39 |
| 4,815,882 | A | 3/1989 | Ohminato | 402/34 |
| 4,848,948 | A | 7/1989 | Pitts | 402/29 |
| 4,904,103 | A | 2/1990 | Im | 402/35 |
| 4,919,557 | A | 4/1990 | Podosek | 402/41 |
| 4,930,925 | A | 6/1990 | Baldwin et al. | 402/30 |
| 5,015,114 | A | 5/1991 | Miller | 402/4 |
| 5,553,959 | A | 9/1996 | Feldman et al. | 402/79 |
| 5,975,784 | A | 11/1999 | Whaley | 402/34 |
| 6,196,749 | B1 | 3/2001 | Chizmar | 402/42 |
| 6,371,678 | B1 | 4/2002 | Chizmar | 402/42 |

FOREIGN PATENT DOCUMENTS

GB 2190331 * 11/1987

OTHER PUBLICATIONS http://www.usringbinder.com/plastix.htm Aug. 26, 2003.
http://www.rickieworld.com.hk/products/D–3.htm Aug. 27, 2003 (entitled "Memo Mechanism Trigger Type–6–Ring (Plastic)").

* cited by examiner

*Primary Examiner*—Monica S. Carter
(74) *Attorney, Agent, or Firm*—Morgan & Finnegan, LLP; Mark J. Abate

(57) ABSTRACT

A binder for releasably retaining loose-leaves. The binder has a front cover that lies flatly beneath its back cover when the binder is open 360 degrees. The rings of the binder can rotate around an edge of the flatly-folded cover to enable loose-leaves to lie flat above and below the cover. The binder also has a skeleton with a minimal cross-section spine which may be partially or completely embedded in a cover and rotates in relation to parallel front and back covers when the binder is open 360 degrees. The front cover, middle cover and back cover are connected in a way so that they do not interfere with the rotation of the rings. Mechanisms to open and close the rings of the skeleton to allow addition or removal of loose-leafs, and ring shapes to optimize or stabilize the capacity of the binder during operation are also disclosed.

28 Claims, 40 Drawing Sheets

1
61A
60D
72
60C
58C
60B
58B
46B
46
56
44
40A
50
46A
100
60A
58A
54
40
42
40B
61B
66

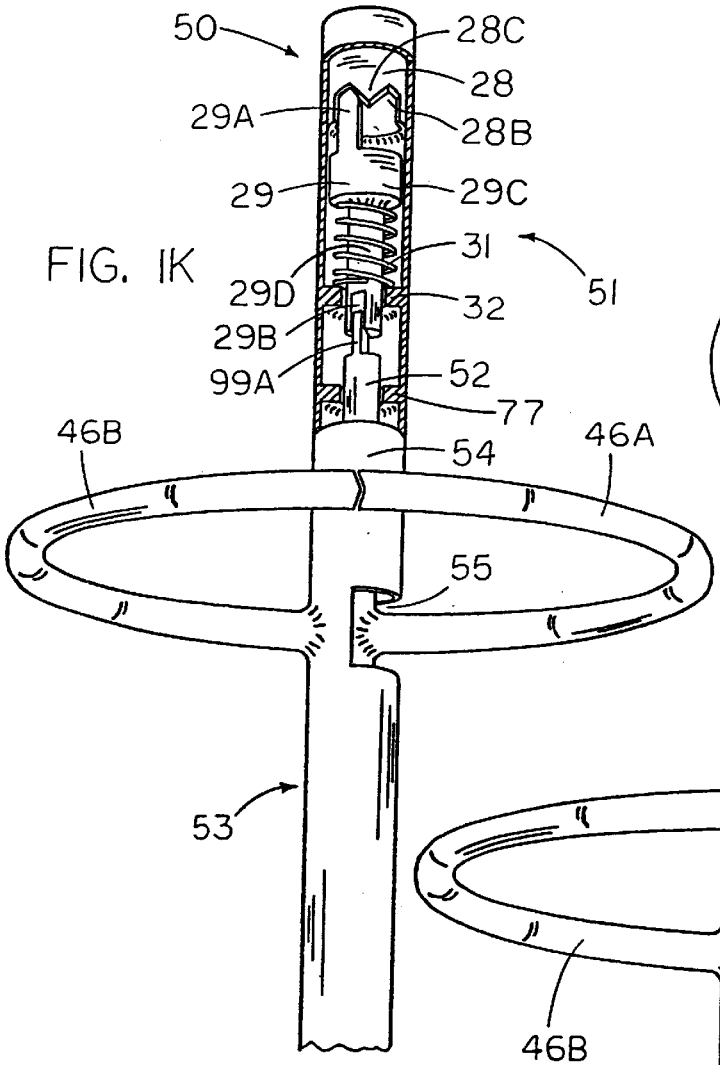
FIG. IK
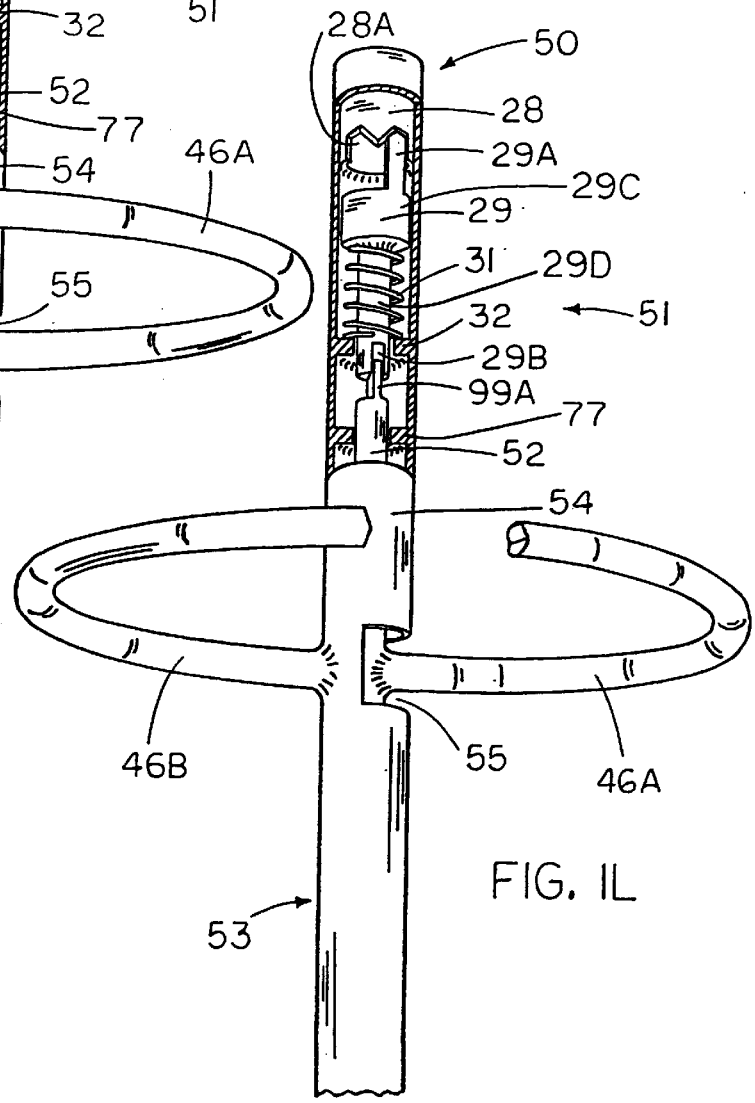
FIG. IL 34B
154
150
34A
34
146B
146A
34B
33
38
151
36
37
38A 150
146C
146B
146A
154
146
146C
146B
146A
30
35
131
151
33
132
154
36
34
38A
37

34

48
47
246A
246B
49A
49B
450
452

246A
246
246B
57

452
57
246
48
29C
47
49A
29C
346
346S
346Q
346B
346A
PI
QI
EI
53
346R
346P 446
446U
446R
446B
446A
53
446T
446Q
446S
446P 546
546U
546R
546T
546Q
546B
546A
53
XI
YI
546S
546P 646
646S
646Q
646B
646A
53
Y2
X2
646P
646R 746
746B
746A
553

846
846B
846A
553

46B
59
85
46A
232
650
451
83
45A
45B
653
652B
41
652A 112
652B
41
652A
45B
45A
46B
59
85
46A
63B
63A 41
112
155B
155A 46B
46A
652B
652A
45B 45B
59
85
45A
41
45A
46B
46A
46

650
63B
653
63A

FIG. 37A
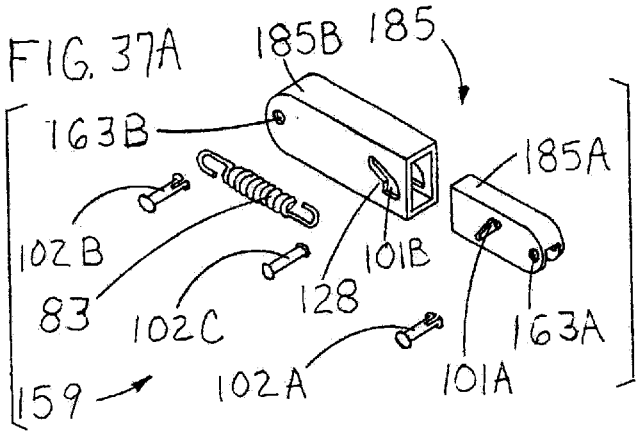
FIG. 37C
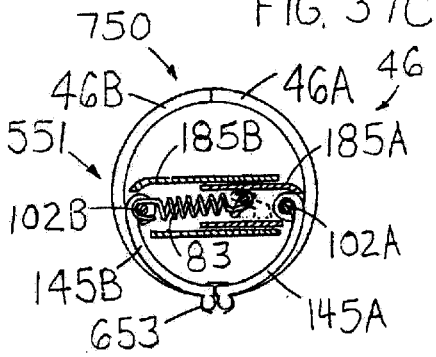
FIG. 37B
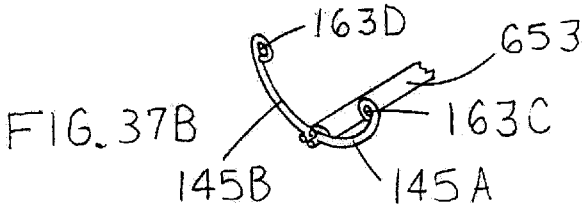
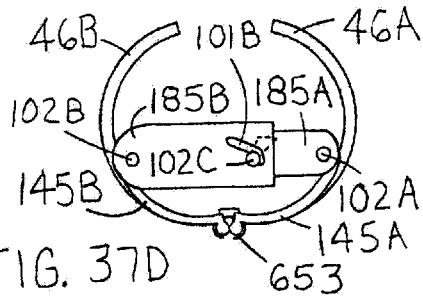
FIG. 37D
FIG. 38A
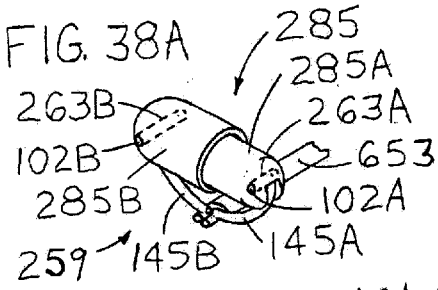
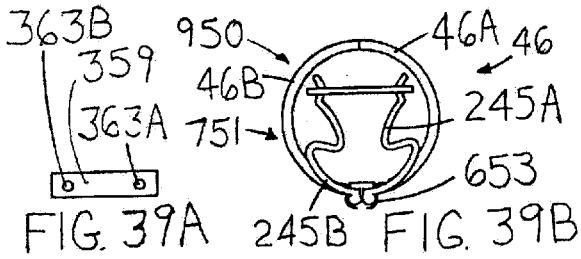
FIG. 39A FIG. 39B
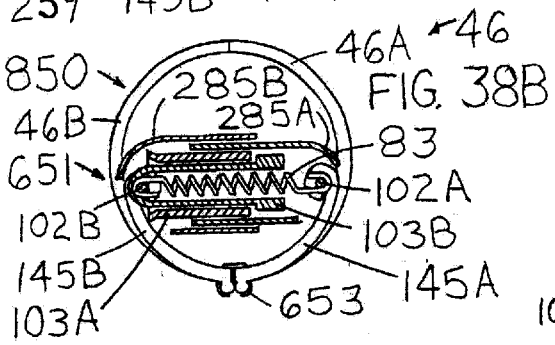
FIG. 38B
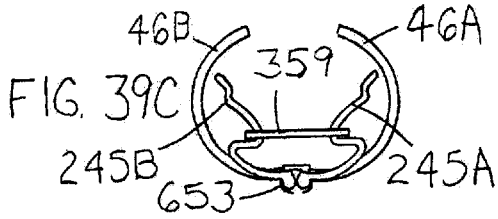
FIG. 39C
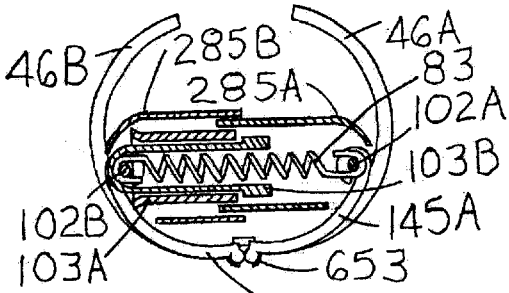
FIG. 38C
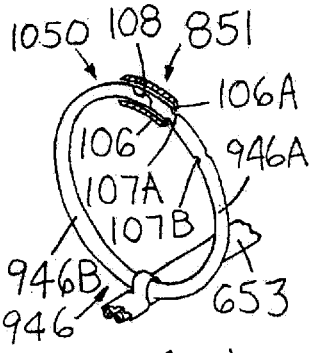
FIG. 40A
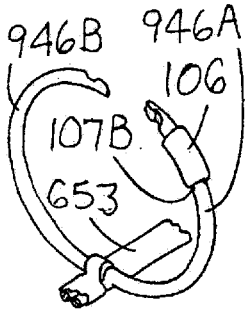
FIG. 40B 105
459
46B
46A
87B
87A
851
385
83
345C
345D
345A
345B
752A
752B
141

385A
141
345A
105
87A
87B
752D
752B
345B
109B 105
87B
87A
46A
46B
345C
345D
345A
345B
83
753
752C
345D
385B
851
752A
87B 46B
109A
345A
345B
87B
46A
385
87A
46
46B
87A
345A
345C
105
752B
46A
1150

141

105
87A
752A
1250
345B
753
87B
46B
953
952A
952B 46A
110B
110A
109B
109A
43
951
1046
1046B
1046A
853
46A
46B
104
852B
852A 952D
952C
46A
46B
952B
43
952A
53
111

LOOSE-LEAF BINDER

This continuation-in-part of application Ser. No. 09/698,838, filed Oct. 27, 2000, now U.S. Pat. No. 6,371,678 which is a continuation of application Ser. No. 09/296,377, filed Apr. 22, 1999, now U.S. Pat. No. 6,196,749.

FIELD OF INVENTION

This invention relates to loose-leaf binders and analogous products such as loose-leaf personal organizers, loose-leaf flip charts, loose-leaf writing pads and loose-leaf photo albums.

BACKGROUND

Binders generally are comprised of two high-level assemblies, a "skeleton" and cover. The skeleton, as used herein, refers to the chassis of the binder, including the rings, spine and possible actuators, but excluding the cover. The spine, as used herein, refers to the elongated portion of the skeleton on which the rings are mounted; the spine excludes the rings, any transversely protruding elements disposed at the longitudinal ends of the skeleton such as actuation levers or proximate to the attachment points of rings such as springs wrapped around ring bases, and transversely protruding elements which are not fixed to rotate with the elongated portion such as a cover-attachment fastener wrapped about and rotatable about the elongated portion.

One object of loose-leaf binders, which is related to both the skeleton and the cover, is minimization of the "footprint" of the binder. The footprint of a binder is the area that is covered by any part of the binder when the binder is placed upon a generally flat surface. Minimizing a binder's footprint during use efficiently utilizes desk, table, or lap space.

A substitute product, the spiral notebook, specifically addresses this object by letting users flip the front cover and forward pages perfectly flat beneath the back cover and latter pages. However, spiral notebooks do not permit the easy addition or removal of pages.

Conventional loose-leaf binders have a very large footprint because, during use, the front cover is open 180 degrees relative to the back cover. This large footprint causes these binders to be cumbersome during use. Furthermore, if the front cover and forward loose-leaves are flipped behind the back cover and latter loose-leaves of a conventional binder, the forward and latter loose-leaves do not lie flat against the front and back covers, respectively. Large stress is exerted on some loose-leaves causing them to tear out of the binder and the airfoil shape of the stack of forward loose-leaves, front cover, back cover, and latter loose-leaves does not provide a flat writing surface. Furthermore in this case, writing on the topmost loose-leaf is difficult as the stack of loose-leaves bends and springs back under the shifting weight of a writing hand and wrist.

In the prior art, there have been attempts to minimize the footprints of loose-leaf binders during use while eliminating the problems mentioned above for conventional binders. However, each of these attempts has had some failing including: (1) sacrifice of a desired feature, (2) only partial achievement of this functionality, and (3) addition of undesirable characteristics.

The failings of known loose-leaf binders to minimize binder footprints are principally the result of (1) the large transverse cross-section dimensions of spines of known skeletons, (2) the methods employed to attach covers to skeletons, and (3) the design of the covers.

The first main cause of these failings, the large transverse cross-section dimensions of loose-leaf binder skeleton spines, has generally resulted from a common objective of skeletons, the ability to simultaneously open and close all rings of a skeleton via a simple actuation mechanism. SOCRA, which is used herein to describe these skeletons, is an acronym for Simultaneously Openable/Closeable Rings Actuation.

Conventional loose-leaf binders have SOCRA skeletons with spines having transverse cross-sections with major and minor dimensions wherein the large major dimension is built into the perimeter of the rings whereas the minor dimension is substantially radial to the center of the rings. Binder skeleton spines have traditionally had a transverse cross-section with a ratio of major to minor dimensions greater than two.

Conventional loose-leaf binders have a front cover attached to a middle cover which in turn is attached to a back cover. The SOCRA skeleton is rigidly fixed to the middle cover or back cover via rivets.

Exemplary dimensions of conventional loose-leaf binder covers in the market are as follows:

| Front and Back Cover Thickness | Middle cover Thickness |
|---|---|
| 2 mm | 2 mm |
| 3 mm | 4.5 mm |
| 4 mm | 5 mm |

Typical dimensions of conventional loose-leaf binder skeletons in the market are as follows:

| Ring Outer Diameter | Ring Prong Thickness | Skeleton Spine Width |
|---|---|---|
| 13.5 mm | 1 mm | 10 mm |
| 21 mm | 2 mm | 16 mm |
| 32 mm | 2.8 mm | 25 mm |
| 75 mm | 3.5 mm | 50 mm |

A ring outer diameter differs from its corresponding ring inner diameter by two ring prong thicknesses. Skeleton spine width is the major transverse cross-section dimension of a binder skeleton spine. The widths of skeleton spines are affected and constrained by the SOCRA mechanism employed and ring prong thickness. Note that as ring size increases, prong thickness increases to handle the stronger forces acting on the rings. Because ring prongs are commonly riveted into plates in conventional skeletons, as ring prongs increase in thickness, the skeleton spine width also must increase to secure the thicker prongs. The smallest conventional binders in the market which are small pocket binders have skeleton spine widths that are still 10 mm thick. Because of the thinness of cover segments and thickness of SOCRA skeleton spines in the prior art, the prior art generally teaches away from embedding of a SOCRA skeleton spine in a binder cover.

The large transverse cross-section of known SOCRA skeleton designs has led to the orientation of the transverse cross-section such that the major dimension is substantially radial to the center of the rings in an attempt to minimize the binder footprint. However, this orientation has made attachment to the cover more difficult which in turn has led to the use of loose-leaf front and back covers with no middle cover disposed therebetween. Such configuration exposes the rings and the ends of the loose-leaves leaving both less protected and makes the binder cumbersome to handle and less attractive. In such a known binder, the skeleton creates an awkward lump, thwarting the object of a flat writing surface, when positioned within a stack of loose-leaves or when positioned between the front cover and back cover after the front cover is flipped around against the back cover. U.S. Pat. No. 3,190,293 to Schneider, U.S. Pat. No. 4,904,103 to Im and U.S. Pat. No. 2,331,461 to Dawson are examples of such known binders.

Alternatively, to minimize binder footprints, some loose-leaf binders have independently-openable rings. In some of these loose-leaf binders, the back cover pivots about the thin skeleton spine and the front cover hangs loose-leaf on the rings, but there is no middle cover joining the front cover to the back cover. These designs make insertion and removal of loose-leaves tedious. Also, the exposed rings are unattractive and the loose-leaves are less protected. U.S. Pat. No. 659, 860 to Schild and U.S. Pat. No. 2,268,431 to Slonneger are examples of such binders.

Yet another problem with known attempts to build a minimal-footprint binder are inadequate ring shapes having varying loose-leaf capacity when these binders are open 360 degrees versus when they are closed. This variation in capacity results from inclusion of the skeleton among the loose-leaves in one position but not in the other. U.S. Pat. No. 4,904,103 to Im is an example of such a binder.

SUMMARY OF INVENTION

Accordingly, this invention provides an improved binder that satisfies the object of providing a binder with a minimal footprint during operation while obviating the disadvantages of the prior art. The invention includes improvements to the binder skeleton, cover and attachment of the skeleton to the cover.

To minimize the binder footprint, the various embodiments of the invention described below contain at least one of the following elements as features:

(1) Skeleton with a minimal LSCPL (defined below).
(2) SOCRA skeleton.
(3) Cover designs that allow the front cover and back cover to fold in flat formations when open 360 degrees while simultaneously allowing the rings to rotate around an edge of the flatly-folded cover.
(4) Spine of skeleton axially disposed relative to rotation of rings and oppositely rotating back cover when the binder is open 360 degrees.
(5) Spine of skeleton embedded or partially embedded in cover in design and/or during operation of binder.
(6) Middle cover joining front cover to back cover.
(7) Attachment of the middle cover to back cover so that the covers do not interfere with rotation of the rings when the binder is opened 360 degrees.
(8) Slots or holes to eliminate interference of cover with skeleton rings as skeleton rings rotate through plane of back cover.
(9) Longest ring dimension is much larger than the LSCPL (defined below).
(10) Attachment of skeleton to cover in a way that allows the front cover to lie flat on the back cover while the binder is open 360 degrees.
(11) Rings hidden (not exposed) when binder is closed.
(12) Writing-support pads (described below).
(13) Stable, incremental rotation of rings about an edge of the flatly-folded cover without a strong bias to particular positions.
(14) Ring shapes with particular orientations to skeleton and cover to optimize or stabilize binder capacity.

The preferred embodiments have a spine. LSCPL is an acronym for the Longest Spine Cross-section Perimeter Line segment and refers to the longest line segment connecting two points on the perimeter of the transverse cross-section of the skeleton spine. For example, for a skeleton spine having a circular cross-section, the LSCPL is the circle's diameter; for an ellipse, the LSCPL is the major axis; for a square or rectangle, the LSCPL is a diagonal; for a triangle, the LSCPL is the longest side of the triangle.

The LSCPL dimension is important. When the binder cover is open 360 degrees, the binder cover is turned inside out such that at least a portion of the interior surfaces of the front and back covers face in opposite directions and the skeleton spine as well as a portion of the cover may be sandwiched between forward and latter loose-leaves. Preferably, the cover folds flat when open 360 degrees. The rings must be able to rotate while the cover is open 360 degrees. In the preferred embodiments, rotation of the rings necessitates that the spine rotate. If the LSCPL dimension is less than or equal to the thickness of the front and back covers, the spine can lie completely between the interior surface planes of the front and back cover throughout the complete range of the spine's rotation; in this case, the spine can remain flush with the front and back cover so that any potential lump caused by the spine while it is sandwiched between forward and latter loose-leaves is minimized or prevented so as to present a flatter top loose-leaf surface. Furthermore, the LSCPL dimension influences the desired thickness of a cover segment having a conduit in which the spine is rotatably disposed as a pivot of cover rotation; as the cover segment rotates about the spine, the conduit containing the spine must accommodate the LSCPL dimension.

Various features of each preferred embodiment cooperate to enable its loose-leaves above and below the back cover to lie flat and parallel when the cover is open 360 degrees whether none, one, many, or all of the loose-leaves are flipped below the back cover.

In the preferred embodiments, a SOCRA skeleton is rotatably disposed in a cover such that (1) the spine is a pivot about which the cover can rotate and (2) the spine is axially disposed relative to opposite rotations of the cover and rings.

Several embodiments of skeletons for use with the binder are disclosed for minimizing the LSCPL. For example, in one embodiment of a skeleton, the rings are attached via a space-saving weld or braze versus the space-demanding riveting of conventional binders.

Embedment of a skeleton in a cover segment without the segment becoming awkwardly thick and unattractive becomes feasible beginning with skeletons having LSCPL values of about 7–9 mm. Most preferably, the LSCPL of the skeleton is less than or equal 5 mm.

Preferably, the binder has a SOCRA skeleton with a synchronized switching element to open or close its rings simultaneously. The preferred synchronized switching element has a first connective element which connects to one set of ring segments and a second connective element which connects to a corresponding and opposing second set of ring segments. The synchronized switching element has a mechanism to enable the first connective element to move in relation to the second connective element so as to open or close the first ring segments relative to the second ring segments.

Means for attaching the front, middle and back cover segments are also disclosed.

OBJECTS AND ADVANTAGES

Accordingly, several objects or advantages of my invention contained in various embodiments described below are:

(a) to provide a binder which can minimize its footprint during use by flipping the front cover and any number of forward loose-leaves flatly beneath the back cover and latter loose-leaves and which lacks the limitations and failings of past attempts cited;

(b) to provide a binder which is reversible, so that either side may be used with equal advantages, the reversal being accomplished by opening the binder 360 degrees and then positioning it to access either the back of the exposed forward loose-leaf page or front of the exposed latter page, whereby either or both sides of a page may be written upon;

(c) to provide a binder which always presents a flat writing surface including when the front cover is opened 180 or 360 degrees relative to the back cover, and the whole surface of the current loose-leaf page is flat and can be used from edge to edge and top to bottom;

(d) to provide a binder whose front and back covers and optional writing-support pads may take the place of a desk, offering good support to write upon if the pad is rested in a lap or held in the hand;

(e) to provide an attractive binder with rings hidden when closed;

(f) to provide a binder affording superior protection to loose-leaves via a surrounding cover;

(g) to provide a binder that is easy to handle, conveniently packs in brief cases and book bags and stacks or stands well on a bookshelf;

(h) to provide a binder which reduces tearing stress on its loose-leaf pages when they are flipped beneath the back cover and latter pages;

(i) to provide a thin binder when closed by embedding the skeleton spine in the cover;

(j) To provide a binder with releasably retaining rings to bind loose-leaf pages permitting easy addition or removal of loose-leaf pages as desired;

(k) to provide a binder with the ability to simultaneously open or close all of the binder's rings by a skeleton mechanism to reduce the effort of adding or removing loose-leaf pages;

(l) to provide a binder with the smallest possible LSCPL skeleton value to eliminate or minimize any lump cause by the skeleton when the binder is open 360 degrees but where the skeleton fulfills its requirement to enable simultaneous opening and closing of all rings;

(m) to provide a binder with a skeleton which can accommodate various numbers and spacings of rings;

(n) to provide a binder with a skeleton that is spring urged to or can be locked in either of two stable states, an open position or closed position so its rings do not inadvertently open or close;

(o) to provide a skeleton with a ring shape that provides substantially constant capacity during operation when the skeleton may be rotated from its upright position; and (p) to provide a binder that can be manufactured cheaply.

Further objects and advantages of my invention will become apparent from consideration of the drawings and ensuing description.

BRIEF DESCRIPTION OF THE DRAWINGS

FIG. 1I is a perspective view of a component of the skeleton of the binder of FIG. 1A.

FIG. 1K is a perspective view of the skeleton of the binder of FIG. 1A, when the rings are in the closed position, with a sectional portion displaying the construction of the synchronized switching element that is disposed within the spine and that simultaneously opens or closes the rings of the binder.

FIG. 1L is a perspective view of the skeleton of the binder of FIG. 1A, when the rings are in the open position, with a sectional portion displaying the construction of the synchronized switching element that is disposed within the spine and that simultaneously opens or closes the rings.

FIGS. 30B–30F depict skeleton rotation and related cover positions as the front cover, writing-support pad, and varying numbers of forward loose-leaves are flipped beneath the back cover and varying numbers of latter loose-leaves.

FIGS. 31B–31F depict skeleton rotation and related cover positions as the front cover, writing-support pad, and varying numbers of forward loose-leaves are flipped beneath the back cover and varying number of latter loose-leaves.

32B–32F depict skeleton rotation and related cover positions as the front cover, writing-support pad, and varying numbers of forward loose-leaves are flipped beneath the back cover and varying number of latter loose-leaves.

Figures 29A, 29B, 29C, 30A, 31A, 32A, 33A, 34, 35:
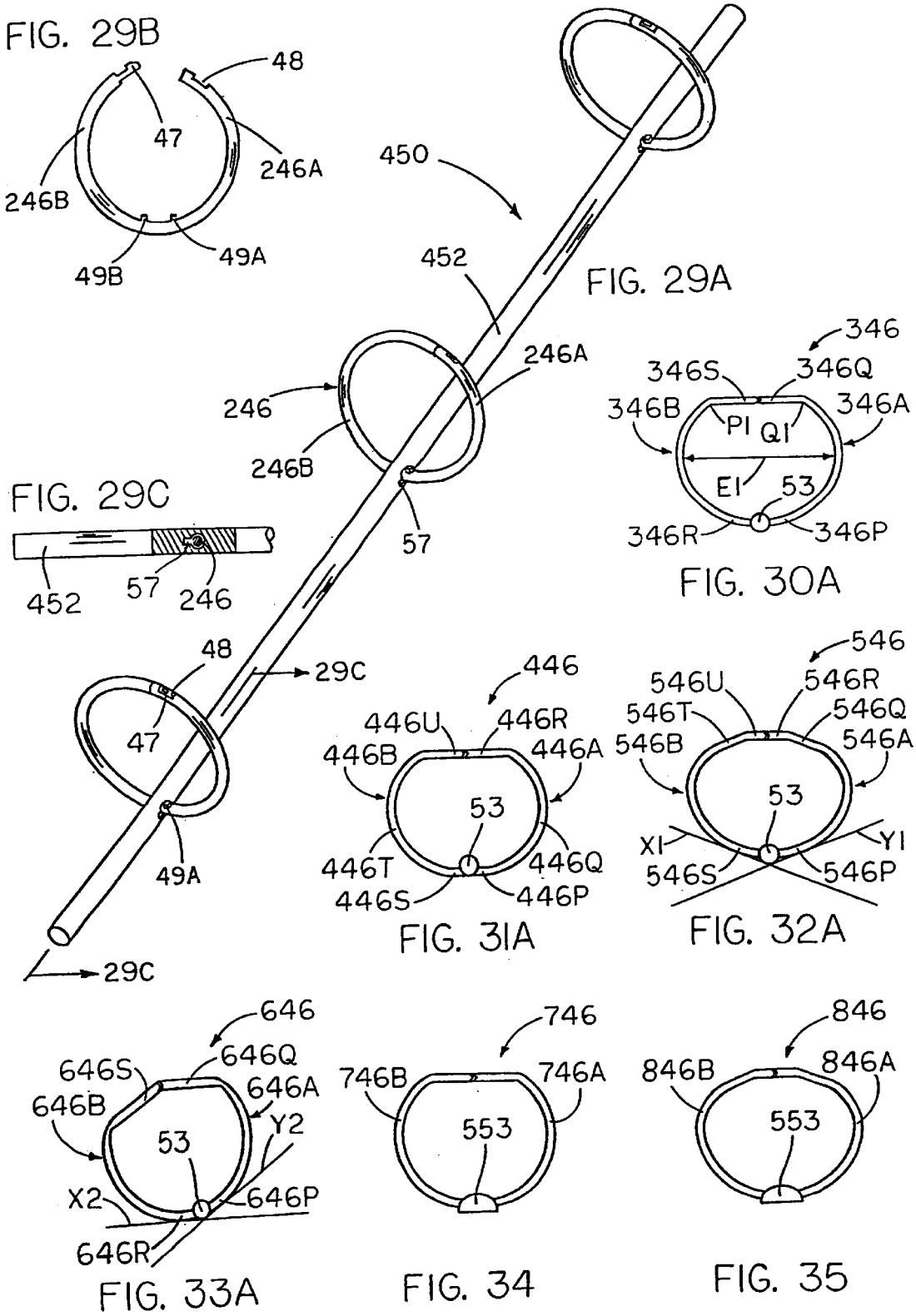
FIG. 29A is a perspective view of a fifth embodiment of a skeleton for use with the binder that has its rings closed.
FIG. 29B is a bottom view of a ring component of the skeleton of 29A.
FIG. 29C is a partial, cross-sectional view of FIG. 29A indicated by the section lines 29C—29C in FIG. 29A.
FIG. 30A is a bottom view of a first embodiment of a ring for use with the binder that has a partially elliptical shape with a linear top segment.
FIG. 31A is a bottom view of a second embodiment of a ring for use with the binder that has a partially elliptical shape with linear top and bottom segments.
FIG. 32A is a bottom view of a third embodiment of a ring for use with the binder that has a partially elliptical shape with three linear top segments.

FIG. 33A is a bottom view of a fourth embodiment of a ring for use with the binder that has a partially elliptical shape with two linear top segments.

FIGS. 33B–33F are bottom views of the binder of FIG. 1 with its rings replaced with rings of FIG. 33A; FIGS. 33B–33F depict skeleton rotation and related cover positions as the front cover, writing-support pad, and varying numbers of forward loose-leaves are flipped beneath the back cover and varying number of latter loose-leaves.

FIG. 34 is the bottom view of another preferred embodiment of a ring component.

FIG. 35 is the bottom view of another preferred embodiment of a ring component.

Figures 36A, 36B, 36C, 36D, 36E, 36F:
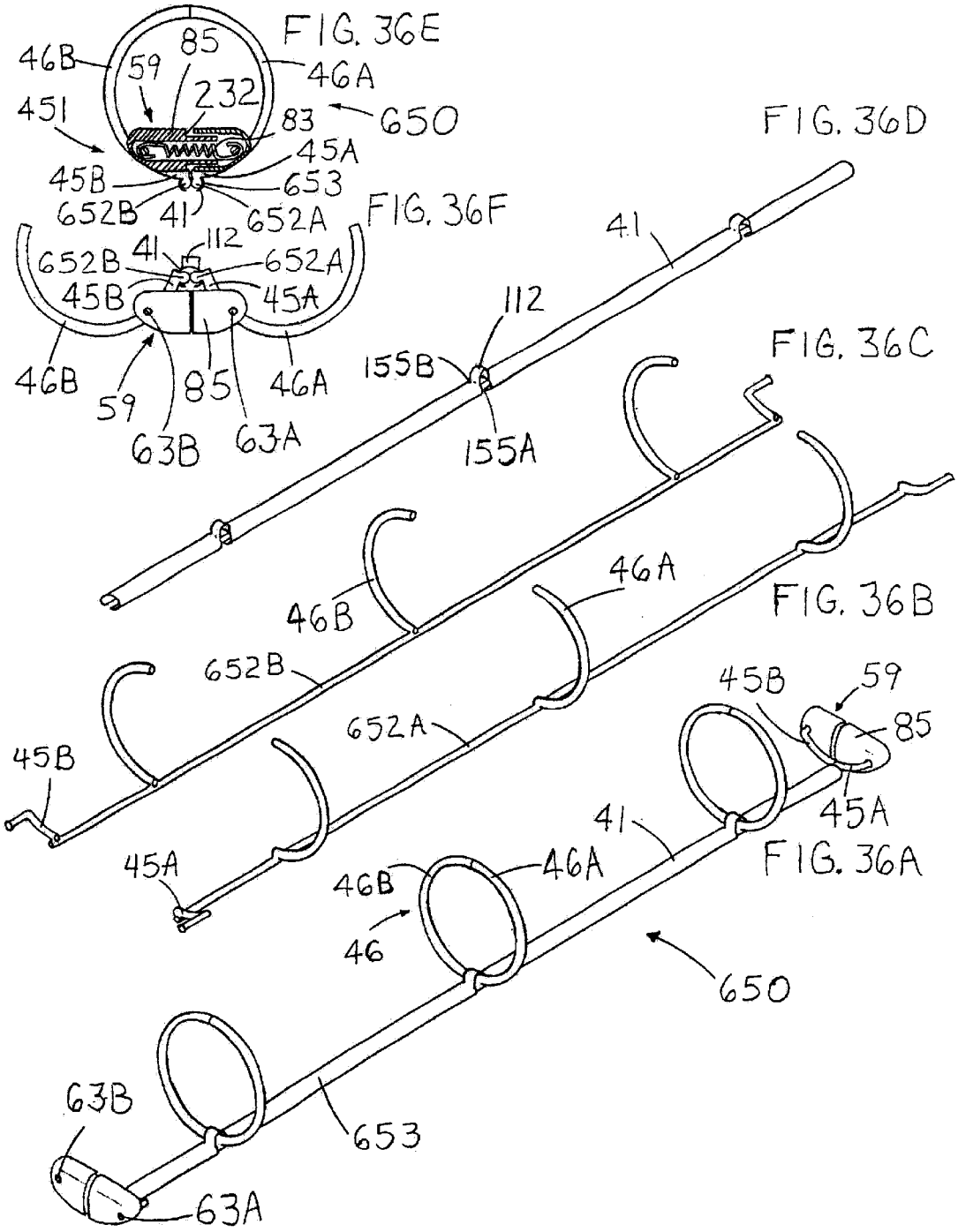

FIG. 36A is a perspective view of a sixth preferred embodiment of a skeleton for use with the binder.

FIG. 36B is a perspective view of components of the skeleton of FIG. 36A.

FIG. 36C is a perspective view of additional components of the skeleton of FIG. 36A.

FIG. 36D is a perspective view of a wrap housing component of the skeleton of FIG. 36A.

FIG. 36E is a bottom view of the skeleton of FIG. 36A with a sectional portion displaying the construction of the spreader component of the actuator (also known as the synchronized switching element) when the rings are in the closed position.

FIG. 36F is a bottom view of the skeleton of FIG. 36A when the rings are in the open position.

FIG. 37A is a perspective exploded view of a spreader component of the skeleton of FIG. 37C.

FIG. 37B is a perspective view of torque lever components attached to the spine of the skeleton of FIG. 37C.

FIG. 37C is a bottom view of another preferred embodiment of a skeleton for use with the binder with a sectional portion displaying the construction of the spreader component of the actuator when the rings are in the closed position.

FIG. 37D is a bottom view of the skeleton of FIG. 37C when the rings are in the open position.

FIG. 38A is a perspective view of a spreader component attached to torque levers, which are attached to the spine of the skeleton of FIG. 38B.

FIG. 38B is a bottom view of another preferred embodiment of a skeleton for use with the binder with a sectional portion displaying the construction of the spreader component of the actuator when the rings are in the closed position.

FIG. 38C is a bottom view of the skeleton of FIG. 38B with a sectional portion displaying the construction of the spreader component of the actuator when the rings are in the open position.

FIG. 39A is a front view of a spreader component of the skeleton of FIG. 39B.

FIG. 39B is a bottom view of another preferred embodiment of a skeleton for use with the binder when the rings are closed.

FIG. 39C is a bottom view of the skeleton of FIG. 39B when the rings are open.

FIG. 40A is a perspective view of another preferred embodiment of a skeleton for use with the binder with a sectional portion displaying part of the construction of the actuator when the rings are in the closed position.

FIG. 40B is a perspective view of the skeleton of FIG. 40A when the rings are open.

Figures 41A, 41B, 41C, 41D, 41E, 41F, 42, 43A, 43B, 44:
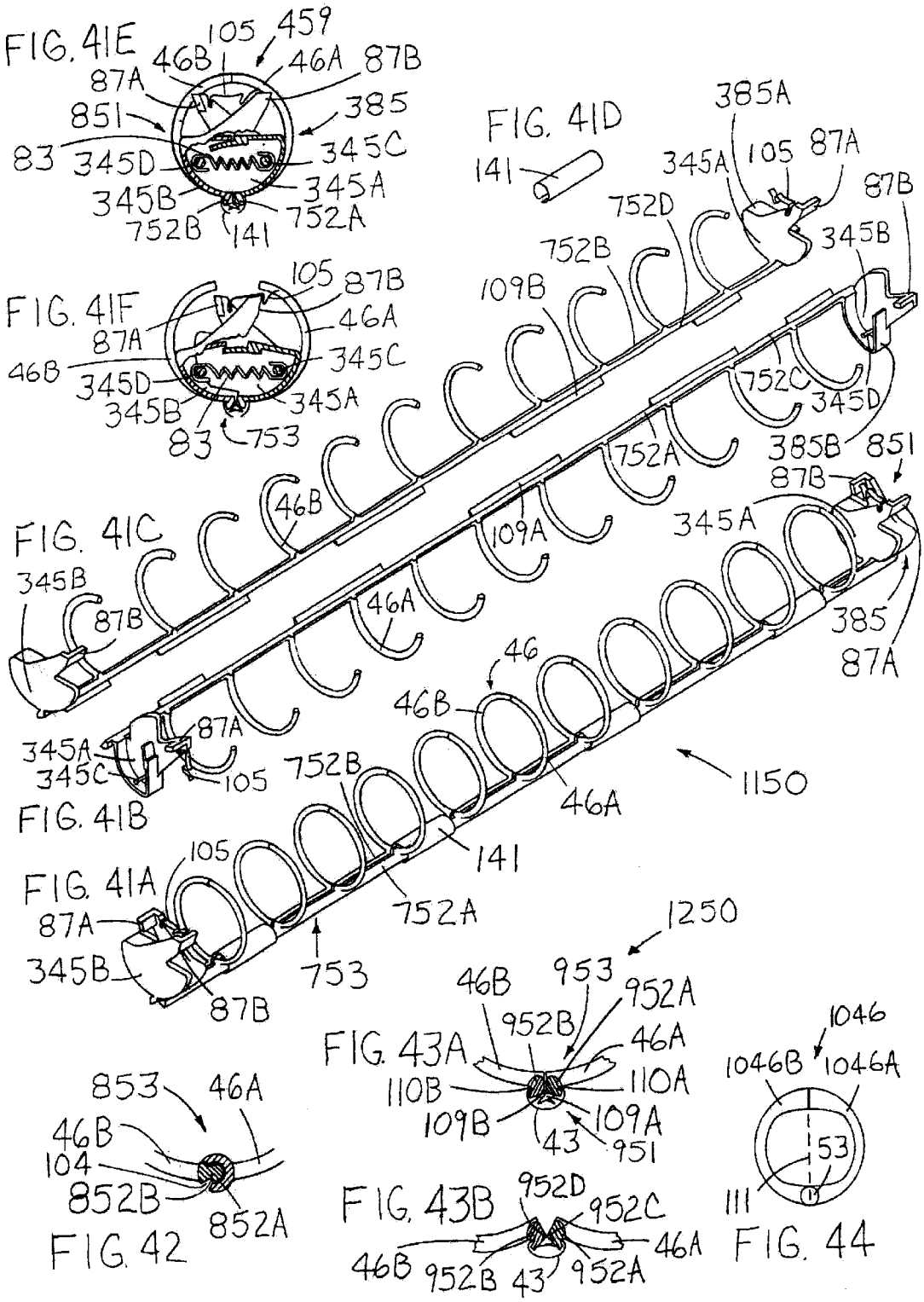

FIG. 41A is a perspective view of another preferred embodiment of a skeleton for use with the binder.

FIG. 41B is a perspective view of components of the skeleton of FIG. 41A.

FIG. 41C is a perspective view of additional components of the skeleton of FIG. 41A.

FIG. 41D is a perspective view of a wrap band component of the skeleton of FIG. 41A.

FIG. 41E is a bottom view of the skeleton of FIG. 41A with a sectional portion displaying the construction of the spreader component of the actuator when the rings are in the closed position.

FIG. 41F is a bottom view of the skeleton of FIG. 41A with a sectional portion displaying the construction of the spreader component of the actuator when the rings are in the open position.

FIG. 42 is a bottom sectional view of another preferred embodiment of a spine for use with the binder with ring segments attached.

FIG. 43A is a bottom view of another preferred embodiment of a skeleton for use with the binder with a sectional portion displaying the construction of the actuator when the rings are in the closed position.

FIG. 43B is a bottom view of the skeleton of FIG. 43A with a sectional portion displaying the construction of the actuator when the rings are in the open position.

FIG. 44 is a bottom view of another preferred embodiment of a ring for use with the binder.

Figure 45A:
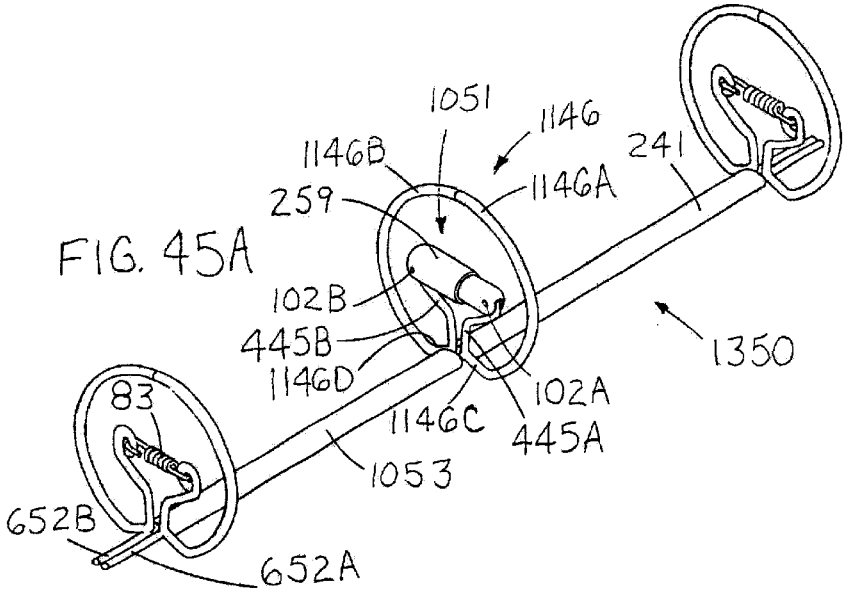

FIG. 45A is a perspective view of another preferred embodiment of a skeleton for use with the binder.

Figure 45B:
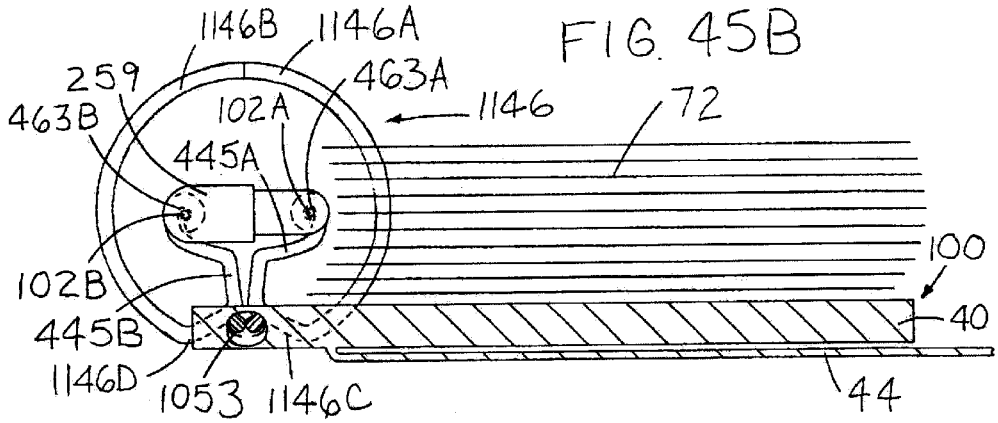

FIG. 45B is a bottom view of the binder of FIG. 1 with its skeleton replaced by the skeleton of FIG. 45A and with its rings in the upright position.

Figure 45C:
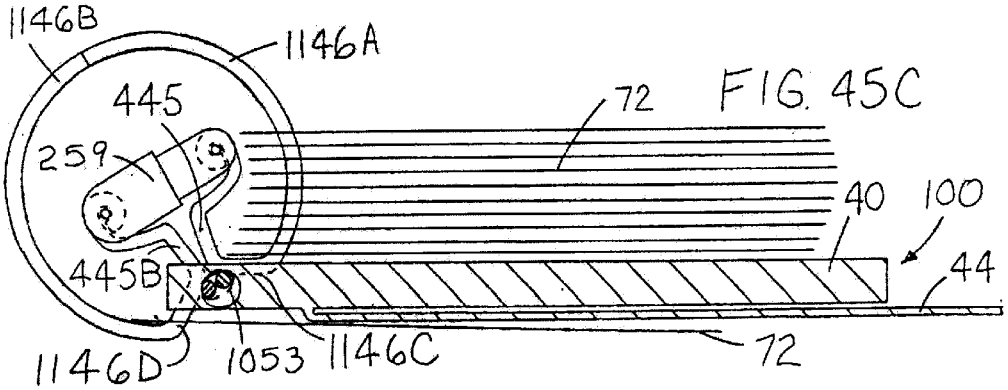

FIG. 45C is a bottom view of the binder of FIG. 1 with its skeleton replaced by the skeleton of FIG. 45A and with its rings rotated counterclockwise from the upright position.

DETAILED DESCRIPTION OF THE PREFERRED EMBODIMENTS

FIGS. 1A–1L

Figure 1A:
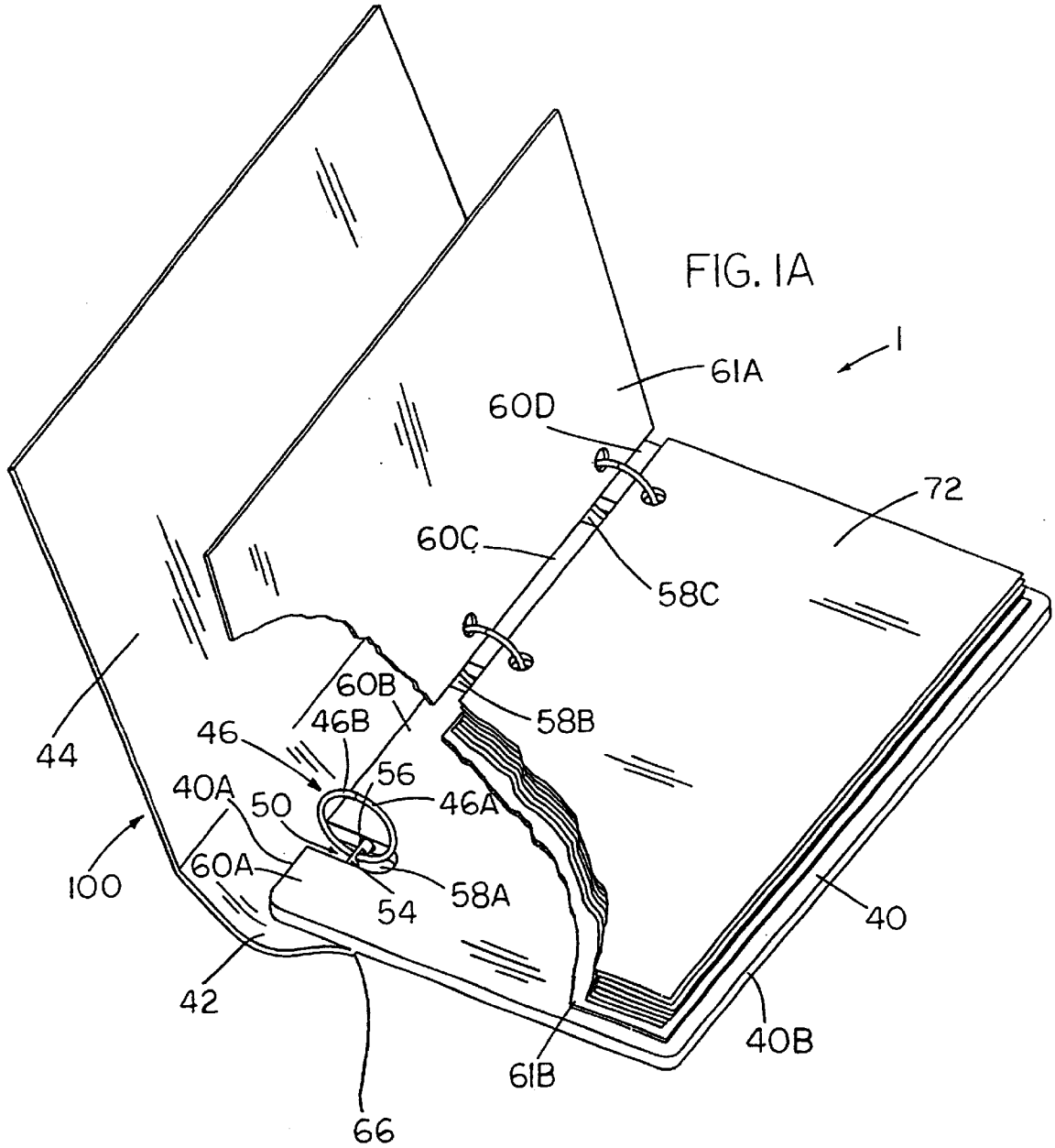
FIG. 1A is a perspective view of an embodiment of the binder of the present invention with its front cover open approximately 120 degrees relative to the back cover in which the spine of the binder skeleton is rotatably disposed.
Figure 1B:
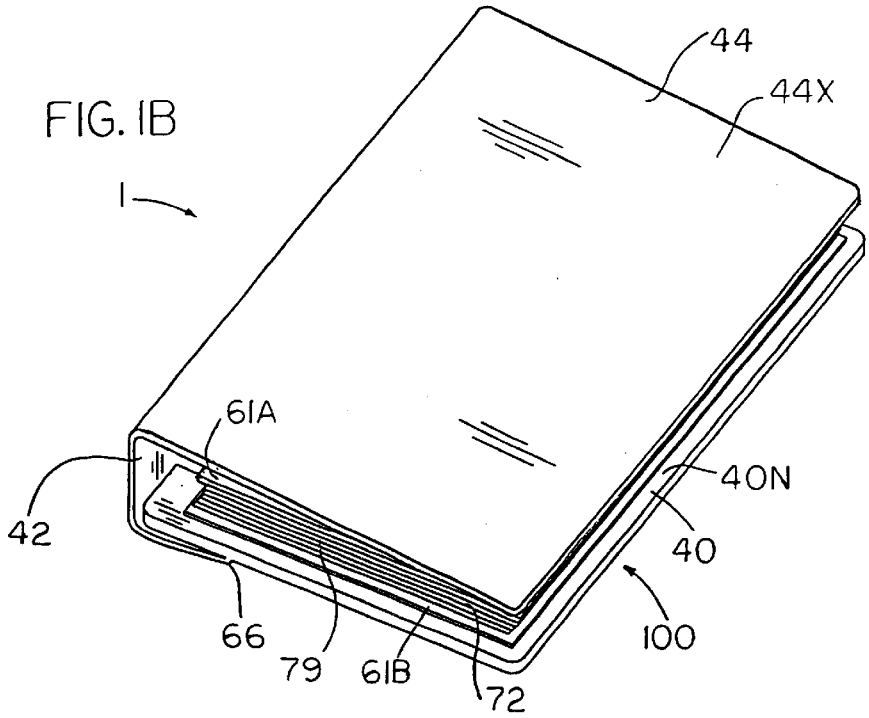
FIG. 1B is a perspective view of the binder of FIG. 1A in its closed position.
Figure 1C:
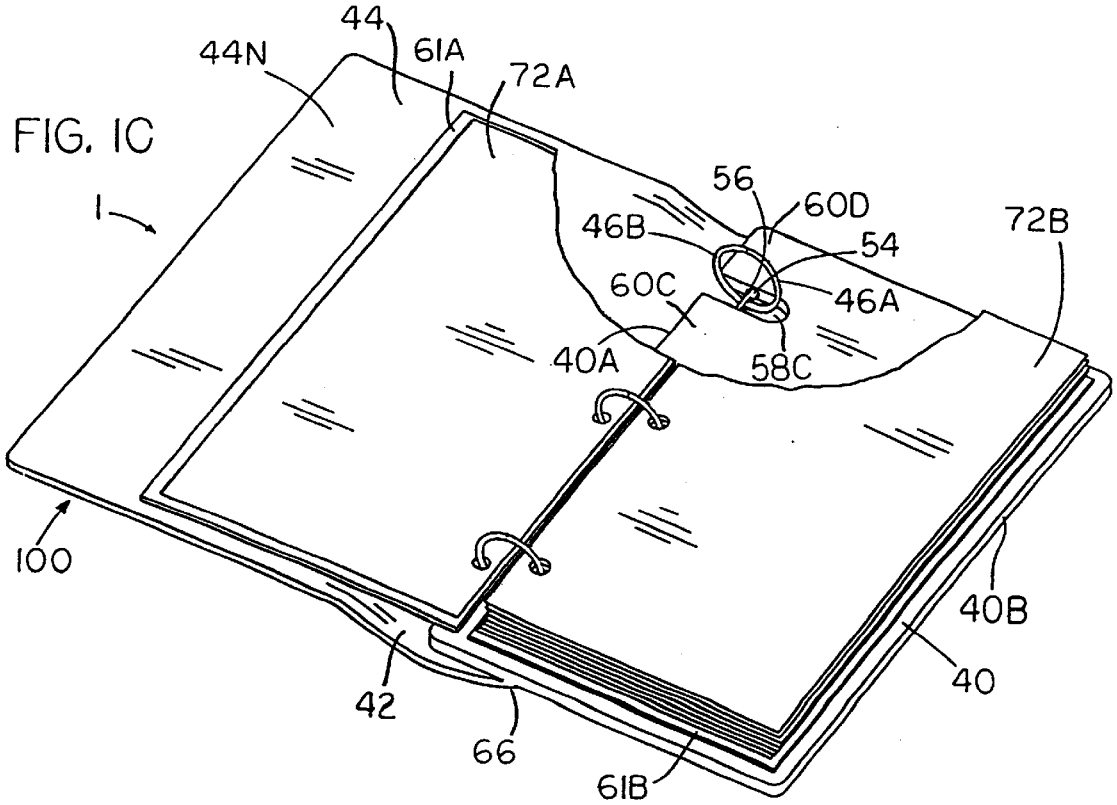
FIG. 1C is a perspective view of the binder of FIG. 1A with the front cover and forward loose-leaf pages flipped 180 degrees open relative to the back cover.
Figure 1D:
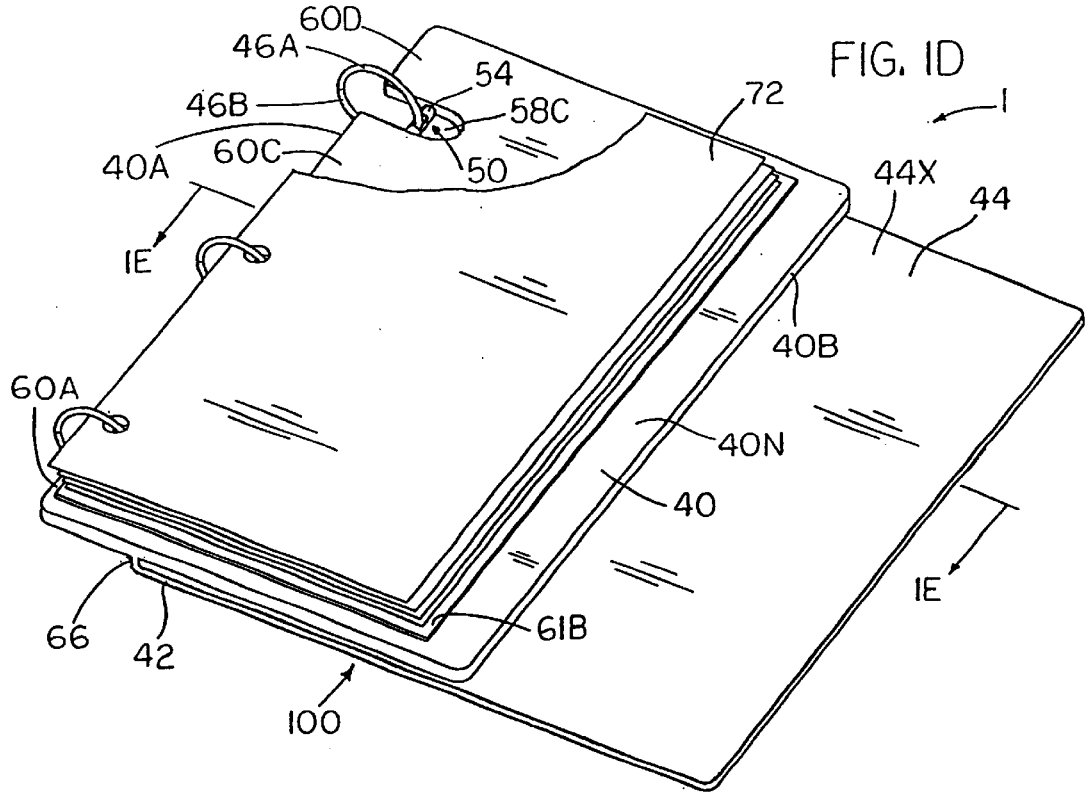
FIG. 1D is a perspective view of the binder of FIG. 1A with the front cover and forward loose-leaf pages flipped approximately 360 degrees to a fully open position flatly beneath the back cover and latter loose-leaf pages.
Figure 1E:
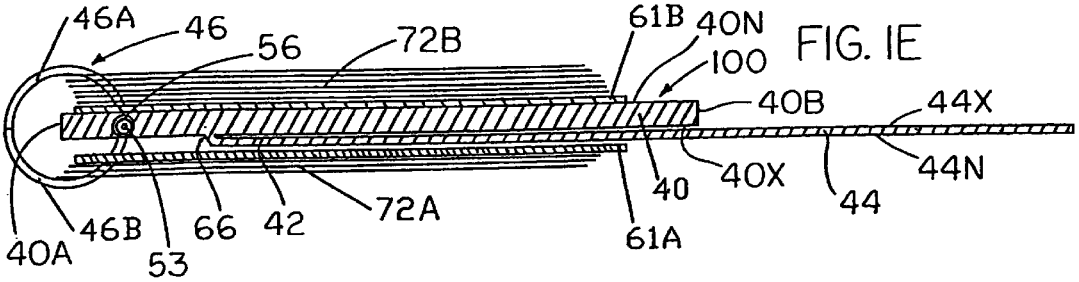
FIG. 1E is a cross-sectional view of the binder of FIG. 1D along line 1E—1E in FIG. 1D.
Figure 1F:
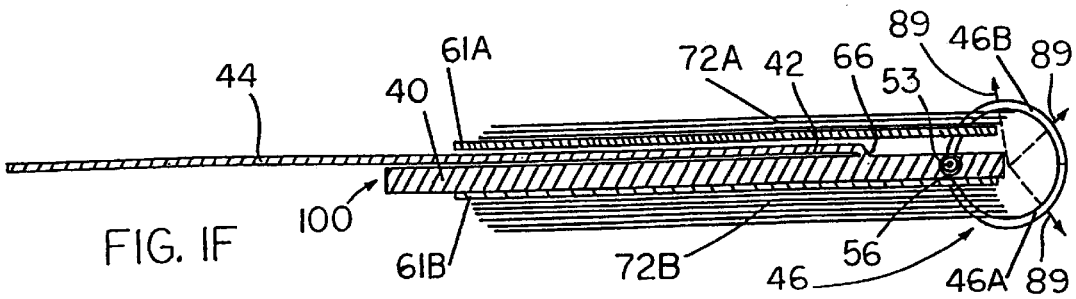
FIG. 1F is a sectional view of the binder of FIG. 1E after it has been flipped over 180 degrees to enable writing on the back side of a forward loose-leaf page.

A first preferred embodiment of the binder 1 of the present invention is illustrated in FIGS. 1A–1D (perspective views of the binder 1 open 120 degrees, 0 degrees, 180 degrees, and 360 degrees, respectively), FIGS. 1E–1F (bottom views of the binder 1 open 360 degrees), and FIGS. 1G–1L (perspective views of the skeleton 50 of the binder 1). The binder 1 comprises cover 100 and skeleton 50 with optional loose-leaf writing-support pads 61A and 61B.

Cover 100 includes back cover 40, middle cover 42, and front cover 44. Back cover 40 has interior surface 40N and exterior surface 40X and front cover 44 has interior surface 44N and exterior surface 44X. Back cover 40, middle cover 42 and front cover 44 are typically made of cardboard, plastic, or other semi-rigid material that is optionally covered by a more flexible material such as vinyl or leather, but may be composed of any materials used to manufacture binder covers, loose-leaf flip-chart covers, loose-leaf personal organizer covers, or loose-leaf writing-pad covers.

Skeleton 50 comprises the spine 53 and a plurality of rings 46. Rings 46 have ring segments 46A and 46B. Spine 53 includes tube 54 and inner rod 52. Ring segments 46B are disposed on tube 54 and ring segments 46A, complementary with ring segments 46B, are disposed on inner rod 52. Spine 53 has a synchronized switching element 51 that simultaneously opens or simultaneously closes ring segments 46A relative to ring segments 46B. Ring segments 46A and ring segments 46B are disposed perpendicular to spine 53.

Conduit 56 is defined by the back cover 40 and is proximate to and runs substantially parallel with the edge 40A of back cover 40. The spine 53 of the skeleton 50 is rotatably disposed within conduit 56. Spine 53 is a pivot about which back cover 40 can rotate. Rings 46 are constrained to rotate with spine 53. Because spine 53 is a pivot of back cover 40 and rings 46 rotate with spine 53, spine 53 is axially disposed relative to opposite rotations of back cover 40 and rings 46. Slots 58A–58C are cut perpendicularly into the edge 40A of back cover 40. Back cover 40 defines paper margin supports 60A–60D. The purpose of slots 58A–58C which intersect conduit 56 and that of margin supports 60A–60D will become apparent in the explanation of the operation of the binder 1.

The rings 46 are aligned with their respective slots 58A–58C so that at least a portion of each of the rings 46 is both received in and protrudes from one of the slots 58A–58C and thereby allowing spine 53 to be rotatably disposed within the back cover 40. Preferably, the tube 54 of spine 53 is constructed to have a relatively small cross-sectional dimension so that back cover 40 need not be unduly thick to define a conduit 56 large enough to receive the tube 54. Preferably, the cross-sectional dimension of tube 54 ranges from about 4 mm to about 9 mm and more preferably from about 4 mm to 7 mm.

One edge of middle cover 42 merges into the plane of back cover 40 along seam 66 which is parallel to conduit 56. Seam 66 can be located between conduit 56 and the far parallel edge 40B of back cover 40 but is preferably located near conduit 56 without intersecting slots 58A–58C. The other edge of middle cover 42 interfaces to an edge of front cover 44. There need not be a distinct boundary distinguishing middle cover 42 and front cover 44, but often there is one in the form of a seam, crease, or hinge. Optional pads 61A and 61B can be placed loose-leaf on rings 46 between which loose-leaves 72 may be added. The binder 1 has a loose-leaf stack space 79 which is the space available for occupation by loose-leaves 72 concurrently bound on rings 46 when the cover 100 is closed.

Figures 1G, 1H:
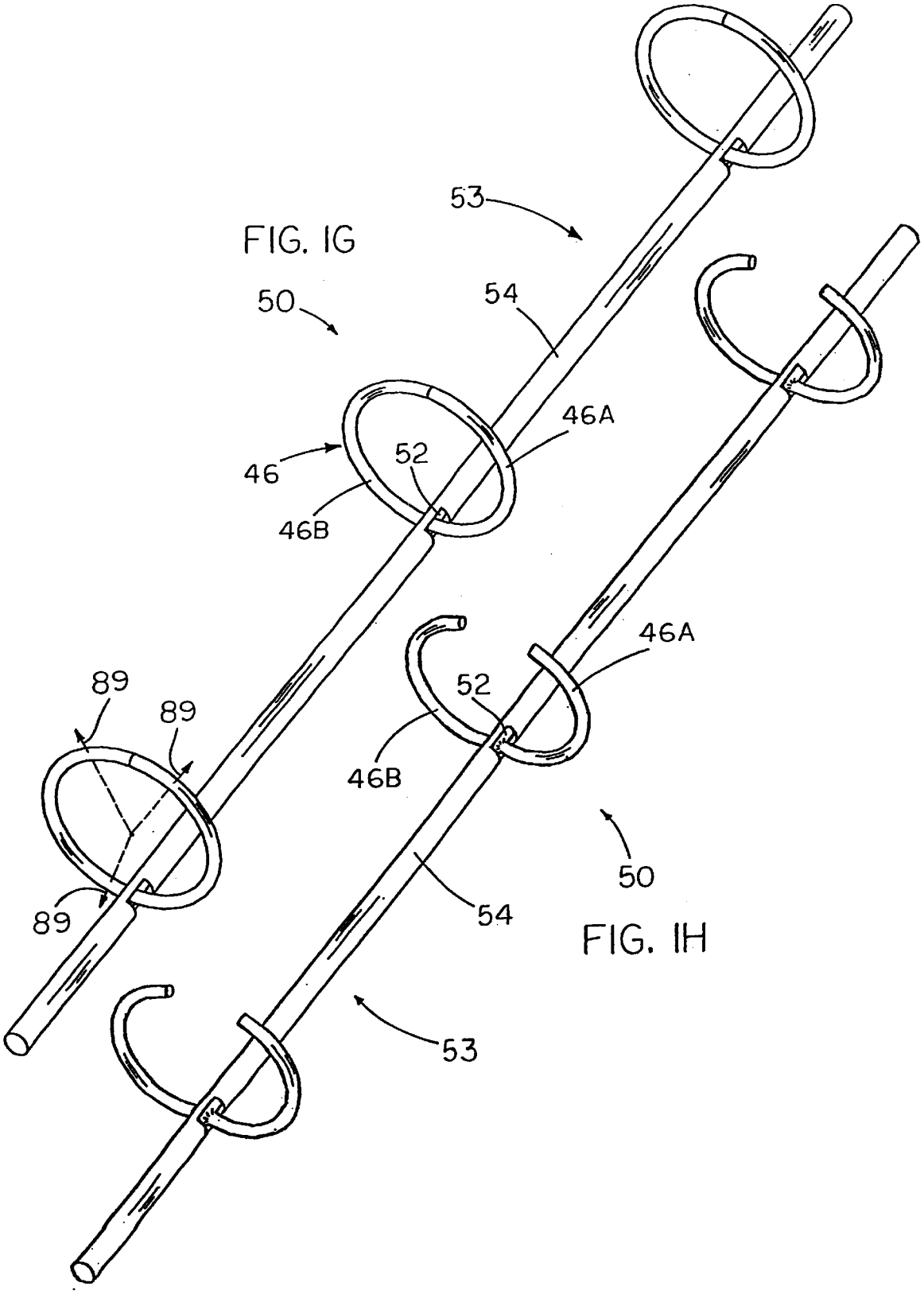
FIG. 1G is a perspective view of the skeleton of FIG. 1A with the rings closed.
FIG. 1H is a perspective view of the skeleton of FIG. 1A with the rings open.
Figures 1J, 11:
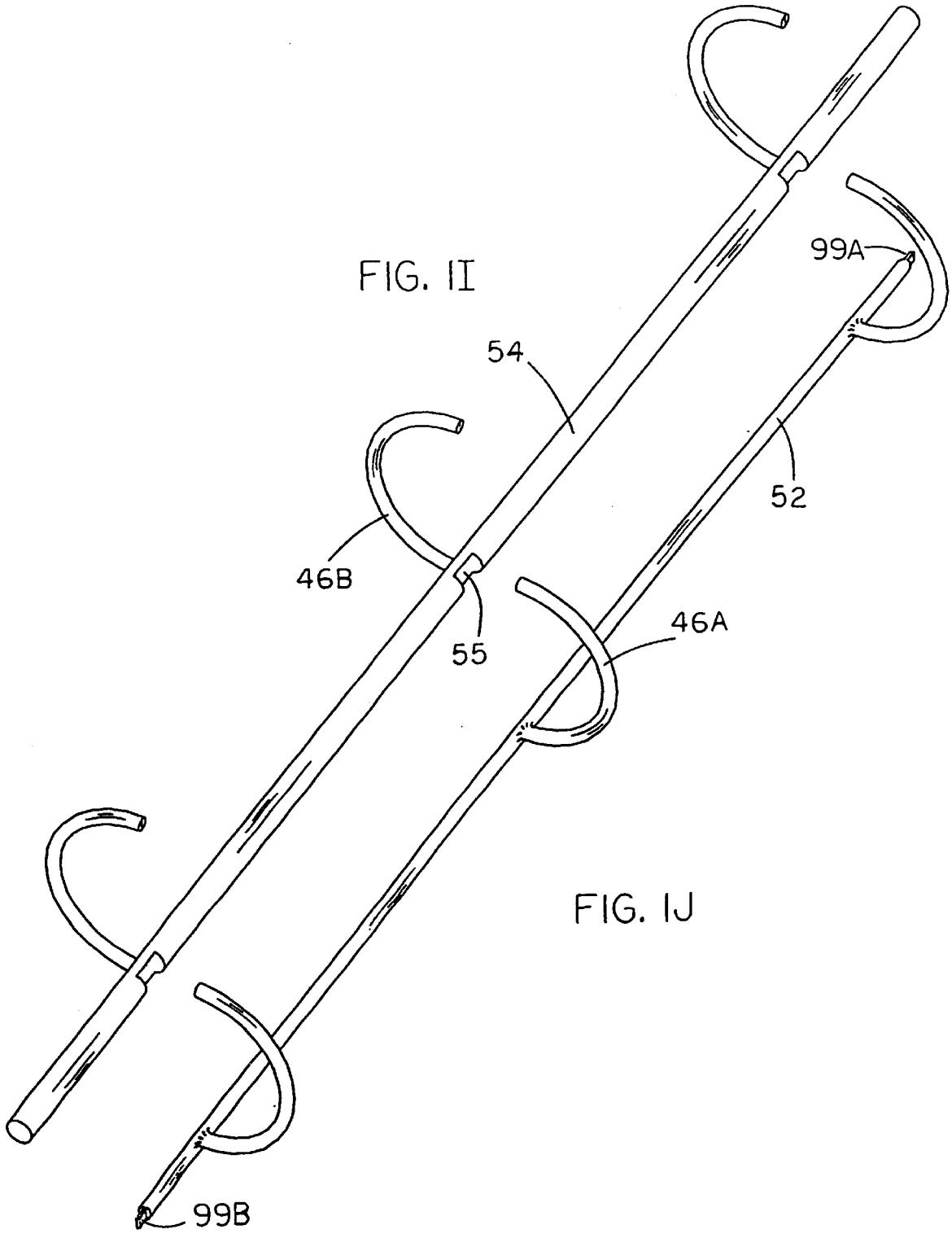
FIG. 1J is a perspective view of additional components of the skeleton of the binder of FIG. 1A. As is apparent from FIGS. 1A, 1G–1H and 1K–1L, the inner rod is preferably inserted into the hollow outer tube prior to the attachment of the ring halves to the inner rod during the manufacture of the spine.
FIG. 11 is a bottom view of an eleventh embodiment of the binder with two opposing and enveloping front cover halves that fasten shut with a hook-and-loop fastener and where one front half is permanently connected to the back cover similar to Embodiment 1 while the other half is permanently interfaced to the back cover similar to Embodiment 10.

FIGS. 1G–1L show perspective and detailed cross-sectional views of skeleton 50 and its components. FIGS. 1G and 1H are perspective views of the skeleton 50 with rings 46 closed and open, respectively. In FIG. 1J, a plurality of ring segments 46A are attached to rod 52 via a weld, braze, adhesive or other appropriate means; similarly, a corresponding number of ring segments 46B are attached to tube 54 as shown in FIG. 1I. When rod 52 is assembled within tube 54, the spaced ring segments 46A protrude through similarly spaced slots 55 defined by tube 54. Preferably, the width of slots 55 approximates the cross-sectional diameter of ring segments 46A, or guide mechanisms of some type—such as cylindrical grooves cut into the inner surface of tube 54 with complementary cylindrical flanges attached to rod 52—are provided to constrain rod 52 from moving longitudinally relative to tube 54. Slots 55 are cut long enough to enable tube 54 to concentrically rotate about rod 52 through a limited angle without interference from ring segments 46A. Tube 54 can be rotated about rod 52 to open or close ring segments 46A relative to ring segments 46B. In this embodiment of a skeleton 50, rod 52 and tube 54 serve as first and second connective elements, respectively, of synchronized switching element 51.

FIGS. 1K and 1L show detailed views of the synchronized switch element 51 of spine 53 in the closed and open states, respectively. Preferably, the synchronized switch element 51 comprises tab 99A of rod 52 which forms a sliding transmission linkage with slot 29B which constrains cylinder 29 to rotate with rod 52, but allows cylinder 29 to slide longitudinally towards and away from rod 52. Cylindrical flanges 77 maintain the longitudinal center axis of rod 52 coincident with the longitudinal center axis of tube 54 to keep tab 99A disposed within slot 29B and ring segments 46A aligned with ring segments 46B. The smaller-diameter portion 29D of cylinder 29 extends through the center of spring 31 and through stop 32. The larger diameter portion 29C of cylinder 29 is in constant opposing contact with spring 31 and the motion of portion 29C is constrained to rotation and longitudinal movement by the inside surface of tube 54. Semi-annular, dual-slotted ledge 28 is disposed within the inner diameter of tube 54, and is preferably defined by or integrally formed as part of the tube 54. Semi-annular ledge 28 defines open notches 28A and 28B divided by tooth 28C. Tongue 29A of cylinder 29 is kept in constant contact with ledge 28 by spring 31 as tongue 29A slides over the tooth 28C to and from the two notches 28A and 28B defined by ledge 28 during operation of the binder 1.

There are four fundamental operations of the binder 1, (i) opening or closing front cover 44 relative to back cover 40 to see and access the contents of the binder 1; (ii) writing on loose-leaf sheets; (iii) opening or closing rings 46 to insert or remove loose-leaf items such as paper and pocket folders; and (iv) handling and storage of the binder including carrying it in hand, standing it on a bookshelf, packing it in briefcases or bookbags, and stacking it horizontally.

The binder 1 is opened like a book from its closed position (FIG. 1B) by spreading its front cover 44 and back cover 40 apart (FIG. 1A) and, in so doing, usually rotating middle cover 42 relative to back cover 40 and front cover 44. As shown in FIGS. 1D–1F, the front cover 44 and forward loose-leaves 72A can be disposed flatly beneath the back cover 40 of binder 1 and latter loose-leaves 72B to minimize the footprint of the binder 1 during use. When front cover 44 and forward loose-leaves 72A are pulled beyond 180 degrees relative to back cover 40, skeleton 50 is able to rotate to accommodate this extended range of motion and thus prevents stress on loose-leaves 72 that could cause them to tear out of the rings 46. The rotation of skeleton 50 also enables forward loose-leaves 72A to lay flat against front cover 44 to provide flat writing surfaces when the binder 1 is open 360 degrees (FIGS. 1E and 1F).

Open slots 58A–58C are defined by the back cover 40 which allow the rings 46 to (i) stand upright when the back cover 40 is closed and (ii) rotate along with the skeleton 50. When the binder is open 180 degrees, skeleton 50 is able to rotate several degrees, typically 5–20 degrees, relative to its upright position because of slots 58A–58C in back cover 40 but is stopped from rotating further by middle cover 42 which presses up against slots 58A–58C when the middle cover 42 is supported by a flat surface. Since middle cover 42 is connected to back cover 40 between conduit 56 and the far parallel edge 40B of back cover 40, when front cover 44 is open 360 degrees relative to back cover 40, middle cover 42 is pulled away from slots 58A–58C and allows for maximum rotation of the rings 46 through the slots 58A–58C. When cover 100 is folded open 360 degrees in a flat formation, a portion of each ring 46 is rotatable about near-ring edge 40A, the pertinence of which is explained below. The angle of rotation of skeleton 50 from its upright position is determined by the relative number of forward loose-leaves 72A flipped beneath back cover 40 to latter loose-leaves 72B; i.e. the more loose-leaves 72 flipped beneath, the greater is the angle of rotation of skeleton 50 from its upright position. Other factors determining the angle that skeleton 50 rotates from its upright position are the diameter of rings 46, the thickness of back cover 40, and whether the binder is placed on a surface with the back cover 40 over front cover 44 (FIG. 1E) or vice versa (FIG. 1F).

A portion of each ring 46 being rotatable about near-ring edge 40A of the flatly-folded cover 100 serves two purposes: (1) it enables loose-leaves 72 to clear edge 40A as they are moved from one side of the back cover 40 to the other side while bound on rings 46 and (2) it enables a first variable segment of each ring 46 to be located on the interior side of back cover 40 while a second variable segment of each ring 46 is concurrently located on the exterior side of back cover 40 which is necessary to enable loose-leaves 72 stacked flatly and bound on rings 46 above back cover 40 to be substantially parallel to loose-leaves 72 stacked flatly and bound on rings 46 below back cover 40. For purpose (2) above to be possible, the inner diameter of each ring 46 must be greater than the thickness of the flat formation of cover 100 which equals the sum of the thicknesses of front cover 44 and back cover 40 which are placed together when cover 100 is open 360 degrees in the flat formation. The front cover 44 may be flexible enough or may have a fold or hinge such that it may be folded against itself while it is flipped back against back cover 40 in order to further reduce the footprint of the binder 1 (See FIG. 13B).

FIG. 1C shows that users can write on the front or back of any loose-leaf 72 when the binder 1 is open 180 degrees. Likewise, when front cover 44 and forward loose-leaves 72A are flipped back against back cover 40 and latter loose-leaves 72B, the user can write on either the front side of the exposed latter loose-leaf 72B or the back side of the exposed forward loose-leaf 72A by positioning the binder as illustrated in FIGS. 1E and 1F, respectively. In this manner, the binder 1 of the present invention allows the user to write on the front or back of any loose-leaf 72 with the minimal binder footprint.

Whenever skeleton 50 is rotated from its upright position, the margin supports 60A–60D provide support for writing so that almost the entire surface of loose-leaves 72 from left edge to right edge and from top to bottom can be written upon. Pads 61A–61B which also assist in this writing-support effort are likely to be only semi-rigid and thus benefit from the added support of margin supports 60A–60D in providing a flat, well-supported, writing surface. The support provided by both margin supports 60A–60D and loose-leaf writing-support pads 61A–61B help to prevent puncturing loose-leaves 72 during writing.

Rotatably disposing spine 53 of skeleton 50 within back cover 40, outside of the loose-leaf stack space 79, provides for a flat writing surface when front cover 44 and any forward loose-leaves 72A are rotated either 180 degrees with respect to back cover 40 or approximately 360 degrees against the underside of back cover 40 and latter loose-leaves 72B. Spine 53 must be able to rotate a with respect to the back cover 40 and be planar therewith in order to avoid the creation of uneven writing surfaces.

Skeleton 50 of FIG. 1A includes a synchronized switch element 51 to simultaneously open all rings 46 to a stable open state (FIGS. 1H and 1L) or to simultaneously close all rings 46 to a stable closed state (FIGS. 1G and 1K). Although, FIGS. 1K and 1L show some components of the synchronized switch element 51 to be disposed on one end of skeleton 50, corresponding mirror-image components of the synchronized switching element 51 may be disposed on the opposite end of skeleton 50, integrally formed with tab 99B, to provide more balanced operation. Opening skeleton 50 involves separating the interfacing free ends of ring segments 46A and ring segments 46B which permits the reception or removal of the loose-leaf sheets (FIGS. 1H and 1L). Closing skeleton 50 involves adjoining the free ends of ring segments 46A and ring segments 46B to form completely closed rings 46 that secure the loose-leaf sheets within the binder (FIGS. 1G and 1K).

To open skeleton 50, any two opposing ring segments 46A and 46B are pulled apart by the user's fingers. This action triggers the synchronized switch element 51 to open all of the rings 46 simultaneously. In operation, the rod 52 of synchronized switching element 51 is caused to rotate relative to tube 54 and is resisted by spring 31 when any of the two opposing ring segments 46A and 46B are pulled apart. As rod 52 rotates relative to tube 54, cylinder 29 is constrained to rotate in sync by tab 99A and slot 29B but is also pushed longitudinally towards rod 52 by the spiral section or tooth 28C of ledge 28 causing the compression of spring 31 between cylinder 29 and stop 32. As rod 52 is rotated half between the closed and open positions, tongue 29A of cylinder 29 is forced out of notch 28A and slides over the tooth 28C thus enabling spring 31 to expand and push tongue 29A into notch 28B thereby stopping the rotation of rod 52. As shown in FIG. 1L, when tongue 29A is disposed in notch 28B, the rings 46 are in their open position and held therein by spring 31 biasing tongue 29A into notch 28B.

To close skeleton 50, any two opposing ring segments 46A and 46B are pushed together by the user's fingers which again triggers the synchronized switching element 51 to close all of the rings 46 simultaneously. The action of pushing any two opposing ring segments 46A and 46B together causes rod 52 of synchronized switching element 51 to rotate relative to tube 54 against the resistance of spring 31. As rod 52 rotates relative to tube 54, cylinder 29 is constrained to rotate in sync by tab 99A and slot 29B but is also pushed longitudinally or linearly towards rod 52 by tooth 28C of annular ledge 28 causing the compression of spring 31 between cylinder 29 and stop 32. As rod 52 is rotated half between the open and closed positions, tongue 29A of cylinder 29 is forced out of notch 28B and slides over tooth 28C thus enabling spring 31 to expand and push tongue 29A into notch 28A thereby stopping the rotation of rod 52. As shown in FIG. 1K, when tongue 29A is disposed in notch 28A, the rings are in their closed position and held therein by spring 31 biasing tongue 29A into notch 28A.

The binder cover 100, when closed, almost completely encompasses loose-leaves 72 and skeleton 50 including rings 46 and thus resembles a book. The encompassing is such that each of 270 rays emanating from the center of one of the rings 46 and spaced at consecutive 1-degree angular increments and intersecting the perimeter of that ring 46 subsequently intersects the cover 100 when the cover 100 is closed. Consequently, it is easier to stand the binder 1 on a shelf, it is less awkward to carry, it is easier to store in containers such as book shelves, brief cases, and back packs, it is more attractive, and it provides more protection to the loose-leaf pages 72 than a binder with a less enveloping cover, such as those with exposed rings.

FIGS. 2A–2E

FIGS. 2A–2E show perspective and sectional views of another preferred embodiment of a binder 2 of the present invention. The binder 2 comprises cover 200 and skeleton 50. Cover 200 includes front cover 144, middle cover 142, and back cover 40. The binder 2 comprises the same back cover 40 and skeleton 50 as the binder 1 shown in FIGS.

1A–1L, but incorporates a different middle cover 142 and front cover 144. Front cover 144 defines holes 74A for receiving rings 46 thereby enabling front cover 144 to be releasably bound by rings 46 in the same manner that loose-leaves 72 are releasably bound by the rings 46. Front cover 144 is connected to middle cover 142 via seam 166 which is disposed between holes 74A and the far parallel edge 144A of front cover 144. The preferred location of seam 166 is nearer holes 74A than the far edge 144A of front cover 144. Middle cover 142 has crease 80 and crease 82 and connects to back cover 40 as in the binder 1 as shown in FIGS. 1A–1C.

Figure 2A:
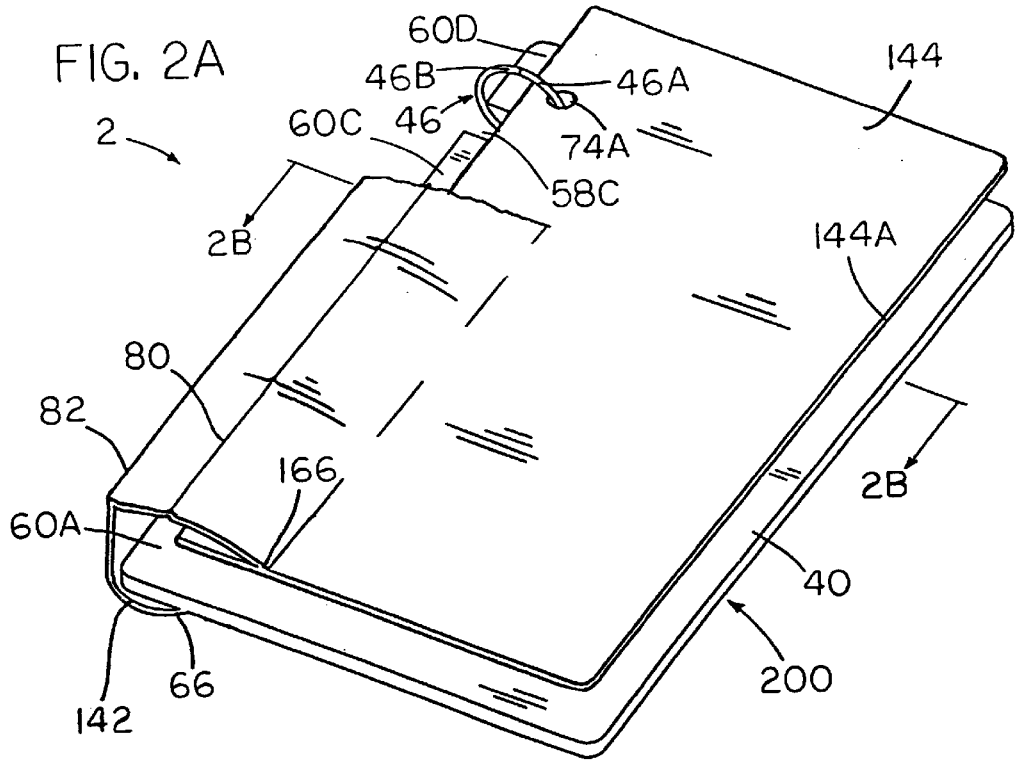
FIG. 2A is a perspective view of a second embodiment of the binder in the closed position where its front cover rides loose-leaf on its rings but is also connected to its middle cover by an attachment seam that is exterior to the binder rings.
Figure 2B:
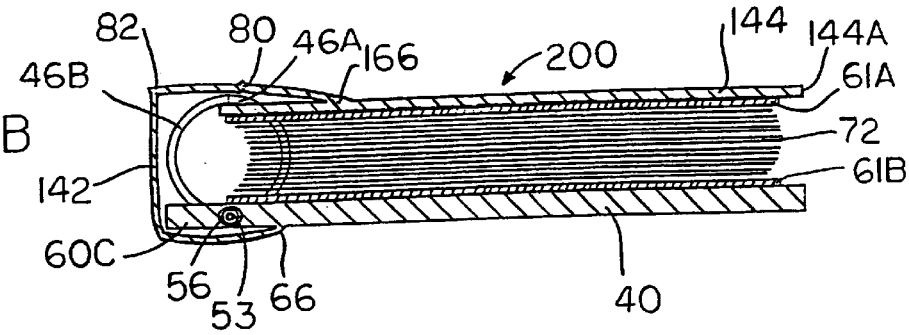
FIG. 2B is a cross-sectional view of FIG. 2A indicated by the section lines 2B—2B in FIG. 2A.
Figure 2C:
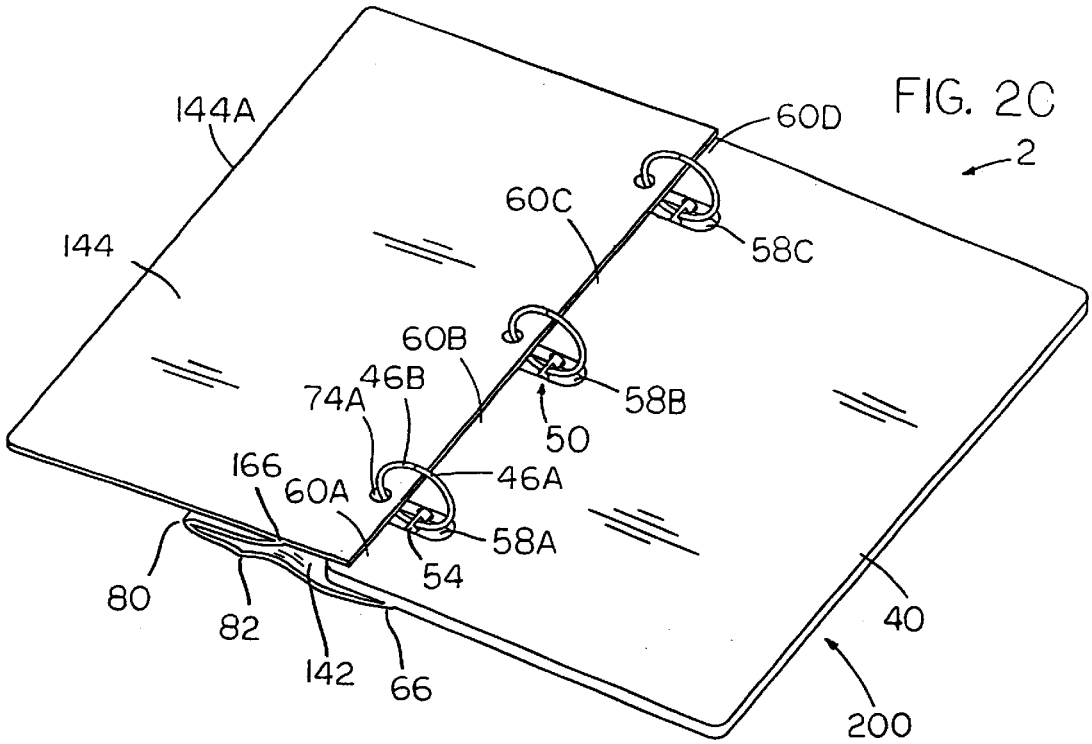
FIG. 2C is a perspective view of the binder of FIG. 2A with loose-leaf pages removed and with the front cover flipped 180 degrees open relative to the back cover while the middle cover folds along an 180-degree-open crease.
Figure 2D:
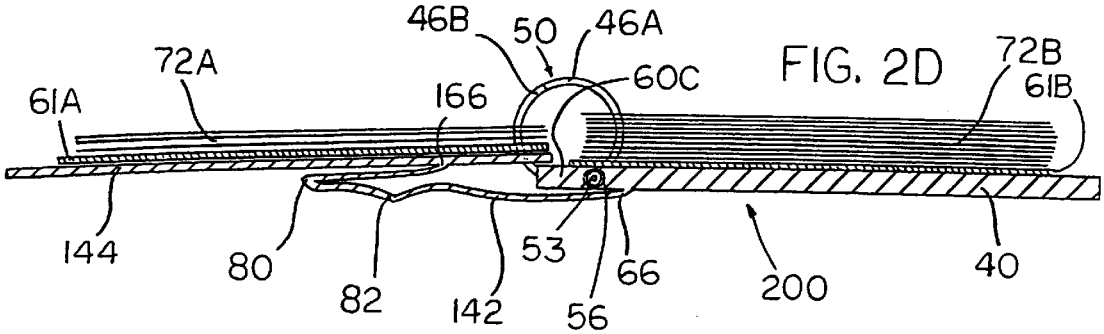
FIG. 2D is the cross section of FIG. 2B where the front cover and forward loose-leaf pages have been flipped 180 degrees open relative to the back cover and the middle cover folds along a 180-degree-open crease.
Figure 2E:
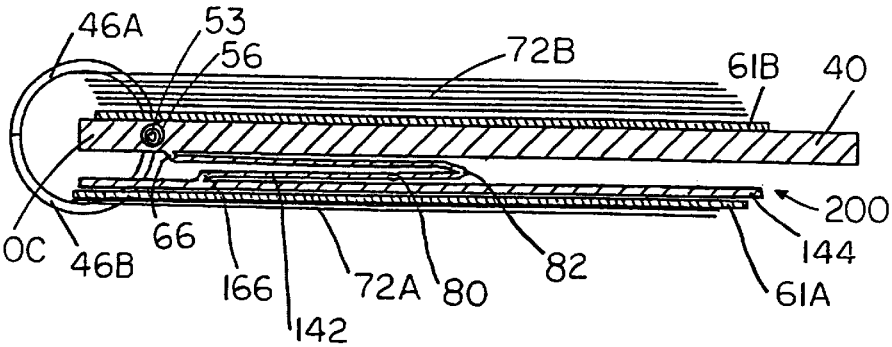
FIG. 2E is the cross section of FIG. 2B where the front cover and forward loose-leaf pages have been flipped 360 degrees flatly beneath the back cover and latter loose-leaf pages and the middle cover folds along a 360-degree-open crease.

Because front cover 144 rides loose-leaf on rings 46, rings 46 constrain the motion of front cover 144. When the binder 2 is opened 180 degrees and placed on a surface or when the binder 2 is opened 360 degrees, rings 46 constrain front cover 144 which in turn forces middle cover 142 to fold upon itself. To encourage smooth folding with a minimal resulting lump, creases 80 and 82 are preferably formed in middle cover 142. When the binder 2 is opened 180 degrees, middle cover 142 tends to fold along crease 80 and when the binder 2 is opened 360 degrees, middle cover 142 tends to fold along crease 82. For illustrative purposes, middle cover 142 has noticeable thickness in FIGS. 2A–2E; in practice middle cover 142 can be paper-thin to minimize any lump it creates when the binder 2 is open 360 degrees. FIG. 2E shows the minimal resulting footprint of the binder 2 provided when cover 200 is open 360 degrees in a flat formation between forward loose-leaves 72A and latter loose-leaves 72B. For purpose (2) recited earlier in the description of the binder 1 shown in FIGS. 1A–1F, the inner diameter of rings 46 is substantially greater than the thickness of the flat formation of cover 200 which equals the sum of the thickness of back cover 40 plus the thickness of front cover 144 plus twice the thickness of middle cover 142.

Another advantage of the binder 2 of the present invention is more compact storage due to less wasted interior space of the binder. Since front cover 144 rests flatly on loose-leaves 72 when the binder is closed (FIGS. 2A and 2B), there is no air pocket between the top loose-leaf 72 and front cover 144. This advantage is significant when considering the limited space of a briefcase or bookbag. The binder 2 of the present invention provides the advantages of an enveloping cover for the rings 46 while creating only a minimal footprint when opened approximately 180 degrees or 360 degrees.

FIGS. 3A–3E

FIGS. 3A–3E show perspective and sectional views of yet another preferred embodiment of a binder 3 of the present invention. The binder 3 comprises cover 300 and skeleton 50. Cover 300 includes front cover 244, middle cover 242, and back cover 40. The binder 3 comprises the same back cover 40 and skeleton 50 as the binder 1 shown in FIGS. 1A–1L, but incorporates a different middle cover 242 and a different front cover 244. Front cover 244 has loops 84 for receiving rings 46 so that it can be releasably bound by the rings 46. Front cover 244 is connected to middle cover 242 in the same manner as the front cover 44 is connected to middle cover 42 in binder 1 as shown in FIGS. 1A–1C. Creases 180A, 180B and 182 are preferably formed in middle cover 242 which is connected to back cover 40 in the same manner as the middle cover 42 of binder 1 is connected to back cover 40 as shown in FIGS. 1A–1C.

Figure 3A:
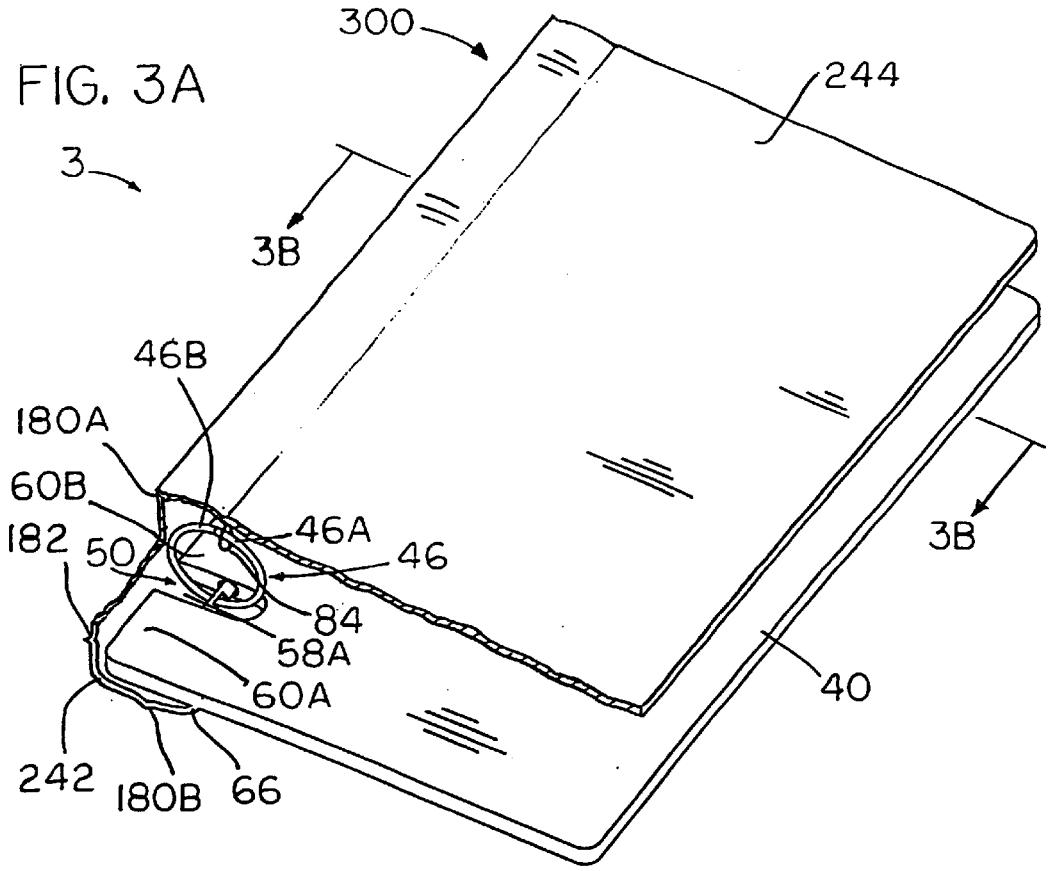
FIG. 3A is a perspective view of a third embodiment of the binder in the closed position where its front cover rides loose-leaf on its rings via cover-ring connection loops.
Figure 3B:
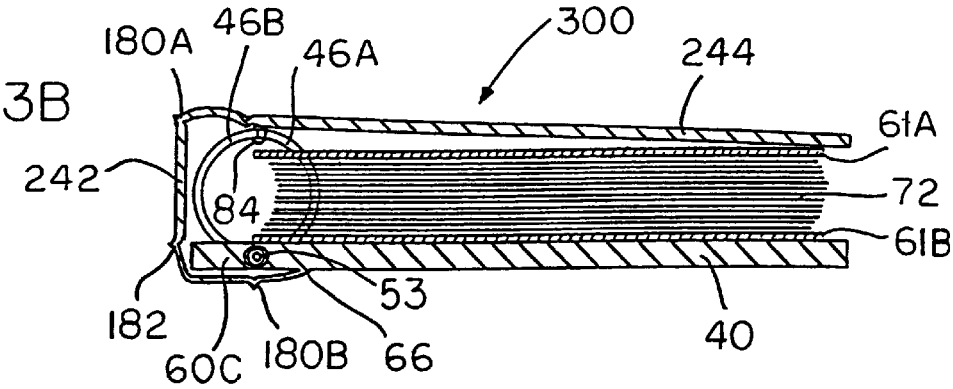
FIG. 3B is a cross-sectional view of FIG. 3A indicated by the section lines 3B—3B in FIG. 3A.
Figure 3C:
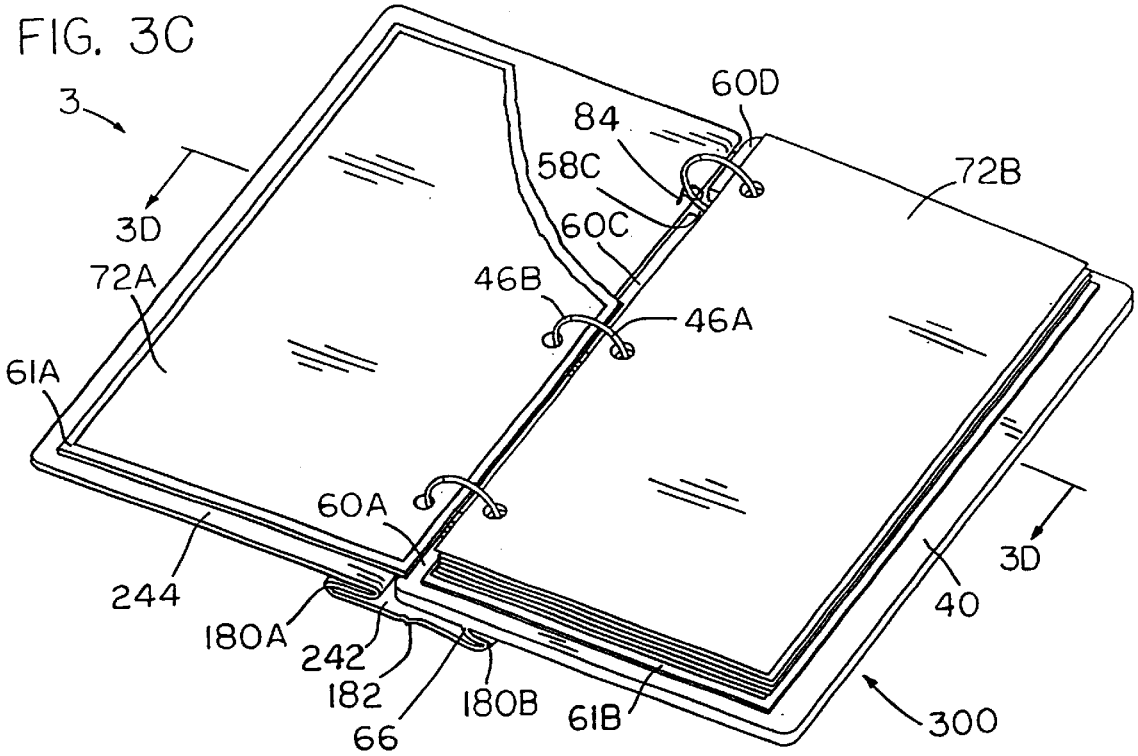
FIG. 3C is a perspective view of the binder of FIG. 3A with the front cover and forward loose-leaf pages flipped 180 degrees open relative to the back cover and with the middle cover folded along two 180-degree-open creases.
Figure 3D:
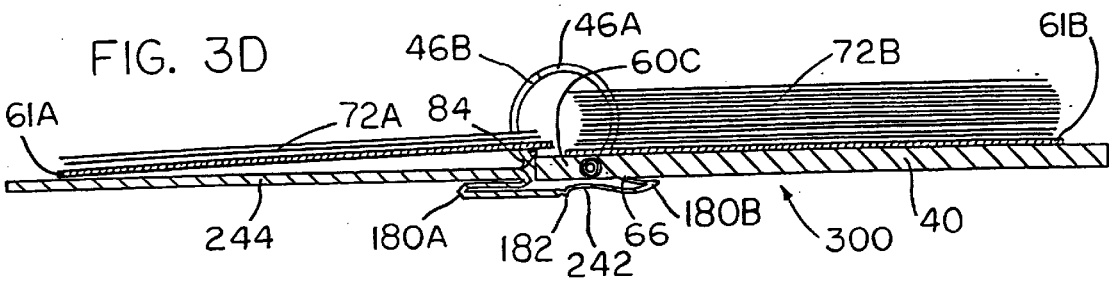
FIG. 3D is a cross-sectional view of FIG. 3C indicated by the section lines 3D—3D in FIG. 3C.
Figure 3E:
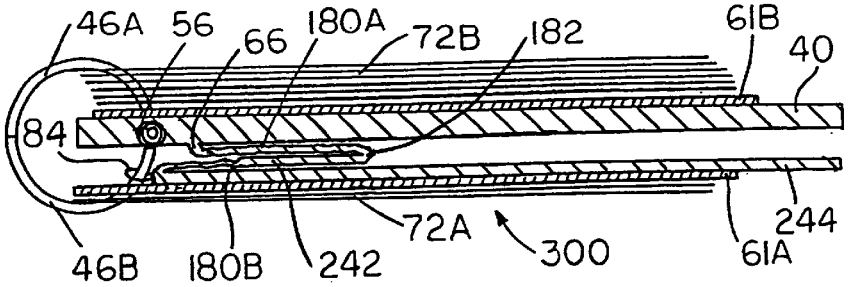
FIG. 3E is the cross-section of FIG. 3B where the front cover and forward loose-leaf pages have been flipped 360 degrees flatly beneath the back cover and latter loose-leaf pages and the middle cover folds along a 360-degree-open crease.

Because front cover 244 of the binder 3 of the present invention rides loose-leaf on rings 46, rings 46 constrain the motion of front cover 244. When the binder 3 is opened 180 degrees and placed on a surface or when the binder 3 is opened 360 degrees, rings 46 constrain front cover 244 which in turn forces middle cover 242 to fold upon itself as shown in FIGS. 3D–3E. To encourage smooth folding with a minimal resulting lump, creases 180A, 180B and 182 are preferably formed in middle cover 242. When the binder 3 is opened 180 degrees, middle cover 242 tends to fold along crease 180A and crease 180B as shown in FIG. 3D, but when the binder 3 is opened 360 degrees, middle cover 242 tends to fold along crease 182 as shown in FIG. 3E. FIG. 3E shows the minimal resulting footprint of binder 3 of the present invention when opened about 360 degrees. Because front cover 244 of the binder 3 rests on rings 46, the binder provides the familiar, slightly triangular look-and-feel of known ring binders when closed, and also provides the advantages of an enveloping cover previously discussed with respect to the binder 1 of the present invention.

FIGS. 4A–4D

FIGS. 4A–4D show perspective and bottom views of an additional embodiment of a binder 4 of the present invention. The binder 4 comprises the same skeleton 50 as the binder 1 shown in FIGS. 1A–1L and cover 400. Cover 400 includes back cover 140, middle cover 342, and front cover 344. Middle cover 342 has two small middle cover portions 342A separated by a large middle cover portion 342B which are all pivotable about spine 53 of skeleton 50. Middle cover 342 has conduit 56B to hold spine 53 of skeleton 50. Middle cover portion 342B pivots about spine 53 in a manner similar to how back cover 40 pivots about spine 53 in the binder 1 shown in FIGS. 1A–1C. Slots 158A–158C and margin supports 160A–160D are defined by middle cover portion 342B.

Figure 4A:
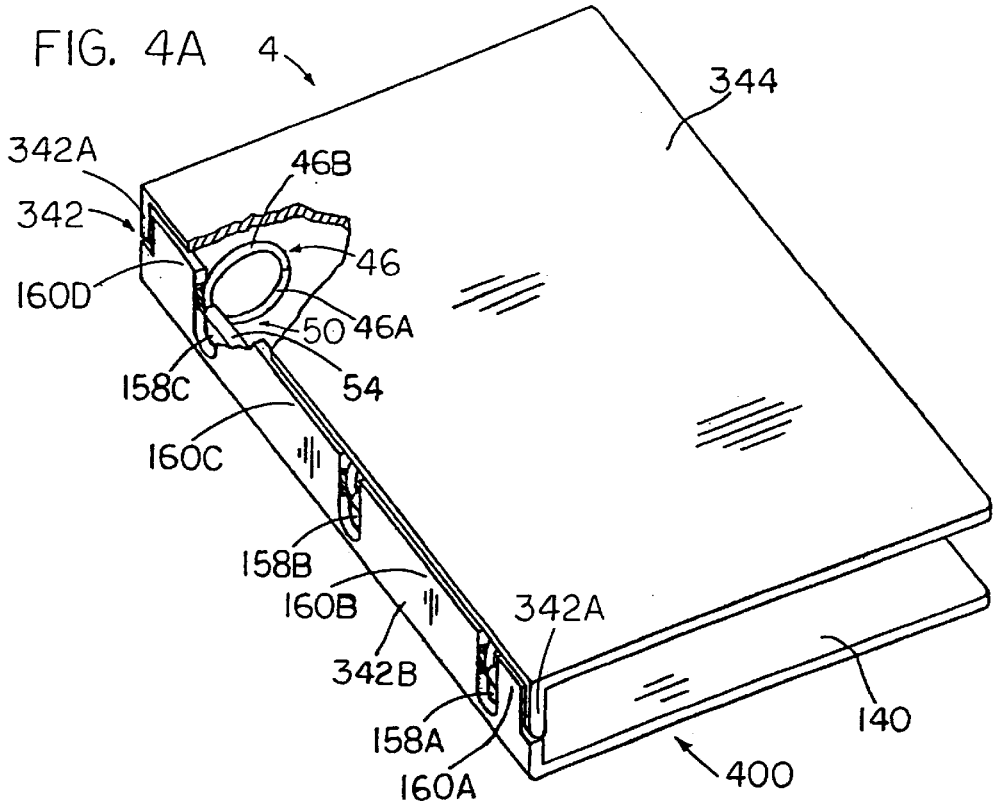
FIG. 4A is a perspective view of a fourth embodiment of the binder where part of the middle cover is interfaced to the front cover and is rotatable about the spine of the binder skeleton and the other part of the middle cover is interfaced to the back cover and is also rotatable about the spine of the binder skeleton.
Figure 4B:
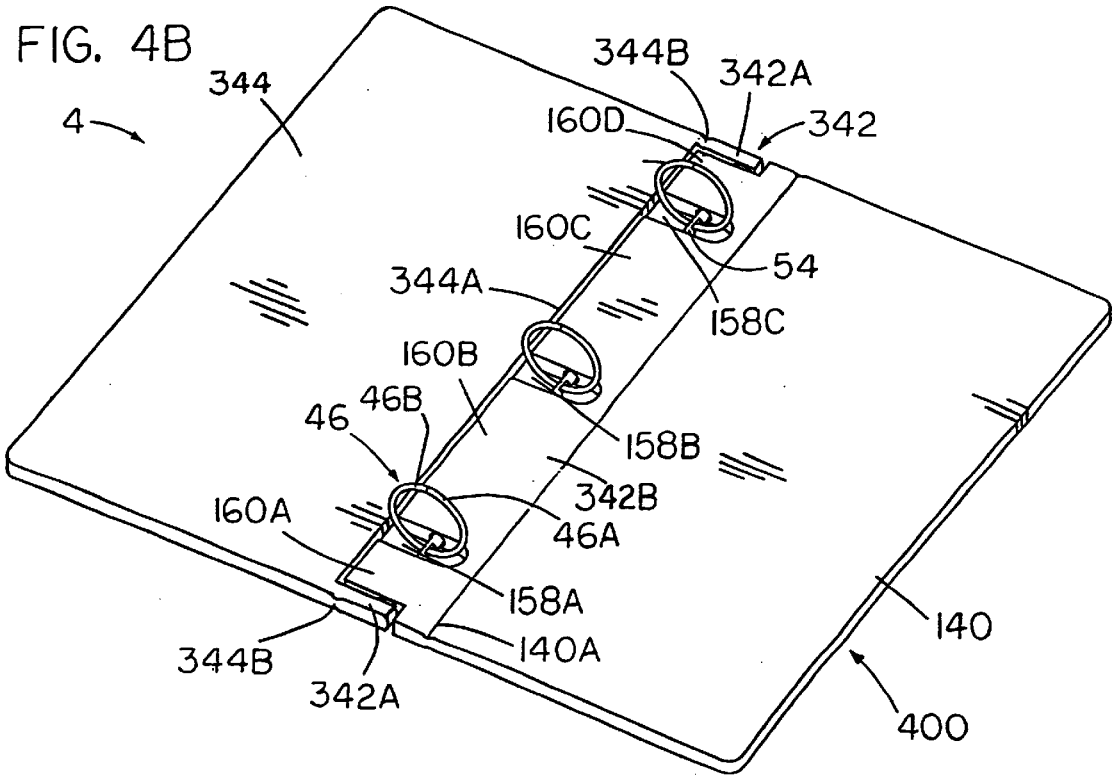
FIG. 4B is a perspective view of the binder of FIG. 4A with the front cover flipped 180 degrees open relative to the back cover and with the middle cover stretched flush between them.
Figure 4C:
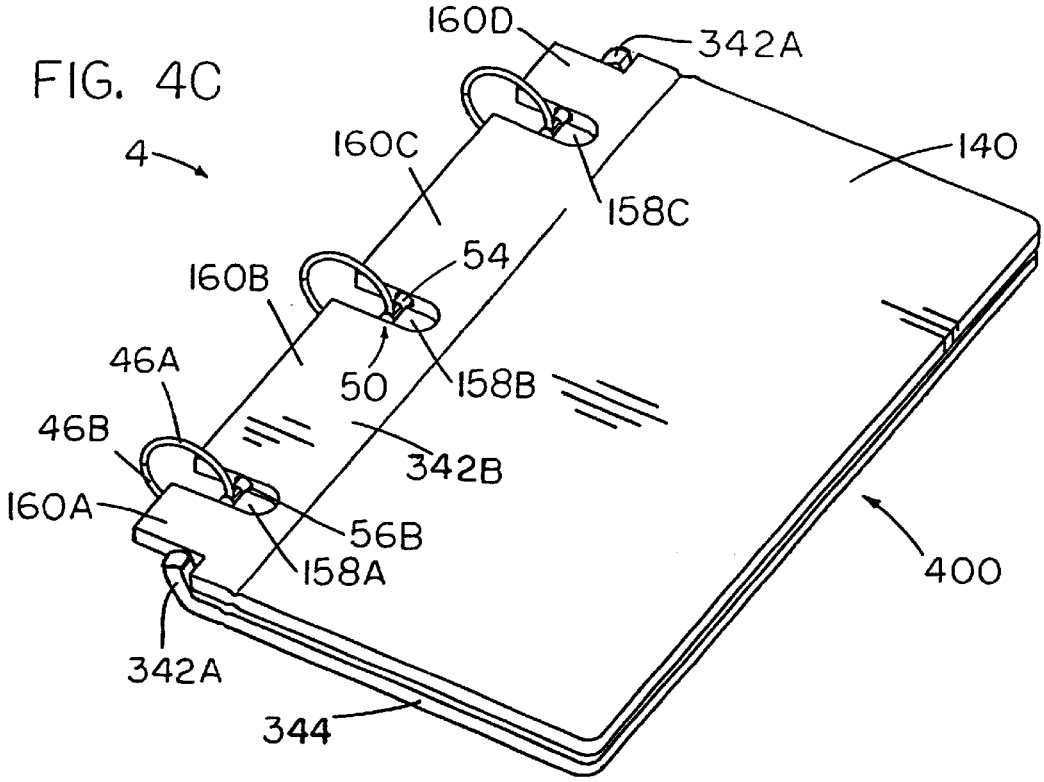
FIG. 4C is a perspective view of the binder of FIG. 4A with the front cover flipped 360 degrees open relative to the back cover while the segment of the middle cover that is interfaced to the front cover has been rotated roughly 180 degrees relative to the segment of the middle cover interfaced to the back cover.

When the binder 4 is open 360 degrees (FIGS. 4C and 4D), skeleton 50 has been rotated within middle cover portion 342B to allow for the extended range of motion similar to how skeleton 50 can be rotated within back cover 40 of the binder 1. In both the 180-degree and 360-degree open positions, middle cover portion 342B behaves like an extension of back cover 140; the two provide one mostly planar surface to support loose-leaves 72. This is possible because middle cover portion 342B is the same thickness as back cover 140 except near the constricted neck or crease 140A where middle cover portion 342B and back cover 140 are connected or integrally formed (FIG. 4B). The addition of writing-support pads 61A and 61B (see FIGS. 1E and 1F) to the binder 4 could cover any crevices that might lead to puncturing loose-leaves 72 during the writing process.

Figure 4D:
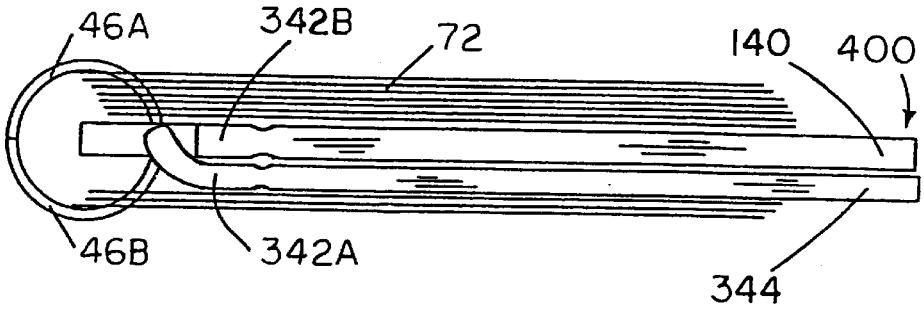
FIG. 4D is a bottom view of the binder of FIG. 4C with loose-leaf pages added.

Middle cover portions 342A are connected to or integrally formed with an edge 344A of front cover 344 with creases 344B disposed therebetween. Middle cover portions 342A pivot about respective ends of skeleton 50. Middle cover portions 342A do not interfere with the rotation of skeleton 50. When the binder 4 is open 360 degrees, middle cover portions 342A curve around middle cover 342B to enable front cover 344 to lie flat against back cover 140 as shown in FIG. 4D.

FIGS. 5A–5B

Figure 5A:
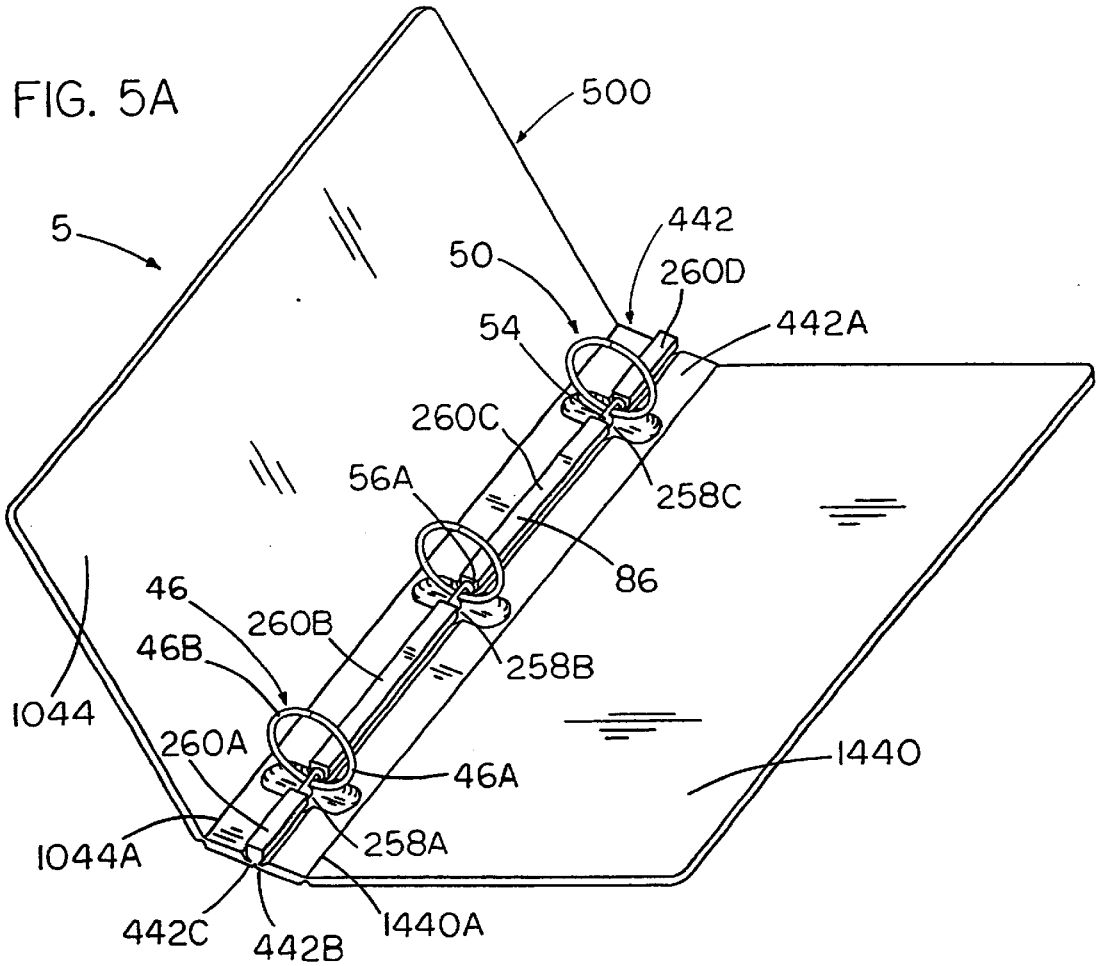
FIG. 5A is a perspective view of a fifth embodiment of the binder with its front and back covers interfaced to a middle cover with a middle beam that is rotatable about the spine of the skeleton.
Figure 5B:
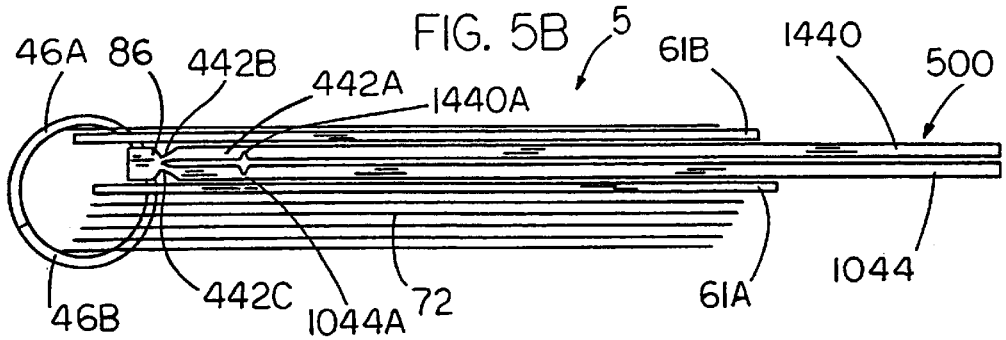
FIG. 5B is a bottom view of the binder of FIG. 5A with loose-leaf pages added and where the front cover and forward loose-leaf pages have been flipped 360 degrees flatly beneath the back cover and latter loose-leaf pages.

FIGS. 5A and 5B show perspective and bottom views of yet an additional embodiment of a binder 5 of the present invention. The binder 5 comprises the same skeleton 50 as the binder 1 and cover 500. Cover 500 includes back cover 1440, middle cover 442, and front cover 1044. Middle cover 442 of the binder 5 comprises a base 442A, a beam 86 disposed on base 442A and creases 442B and 1D 442C disposed at the respective junctures of the beam 86 with base 442A. The spine 53 of skeleton 50 is rotatably disposed in conduit 56A. Slots 258A–258C are defined by middle cover 442. Margin supports 260A–260D are defined by beam 86 of middle cover 442. The base 442 A of middle cover 442 and front cover 1044 are joined together at crease or fold 1044A. The base 442A and back cover 1440 are joined at crease or fold 1440A.

Although skeleton 50 can rotate relative to middle cover 442, only limited rotation is needed, the amount of rotation needed being influenced by the amount of loose-leaves 72 on one side of beam 86 of middle cover 442 compared with the other side. When the binder 5 is open 360 degrees (FIG. 5B), the skeleton 50 need not rotate substantially because of the manner in which the base 442A folds upon itself at creases 442B and 442C to enable front cover 1044 to lie flat against back cover 1440. To enable middle cover 442, back cover 1440 and front cover 1044 to form two parallel planar surfaces when the binder is open 360 degrees, the base 442A of middle cover 442 as well as back cover 1440 and front cover 1044 are half as thick as beam 86 of middle cover 442. Optional writing-support pads 61A and 61B cover crevices associated with folds 442B and 442C and slots 258A–258C. When cover 500 is folded flatly open 360 degrees, beam 86 coincides with the near-ring edge of flatly-folded cover 500 and a portion of each ring 46 is rotatable about this edge.

FIGS. 6A–6B

Figure 6A:
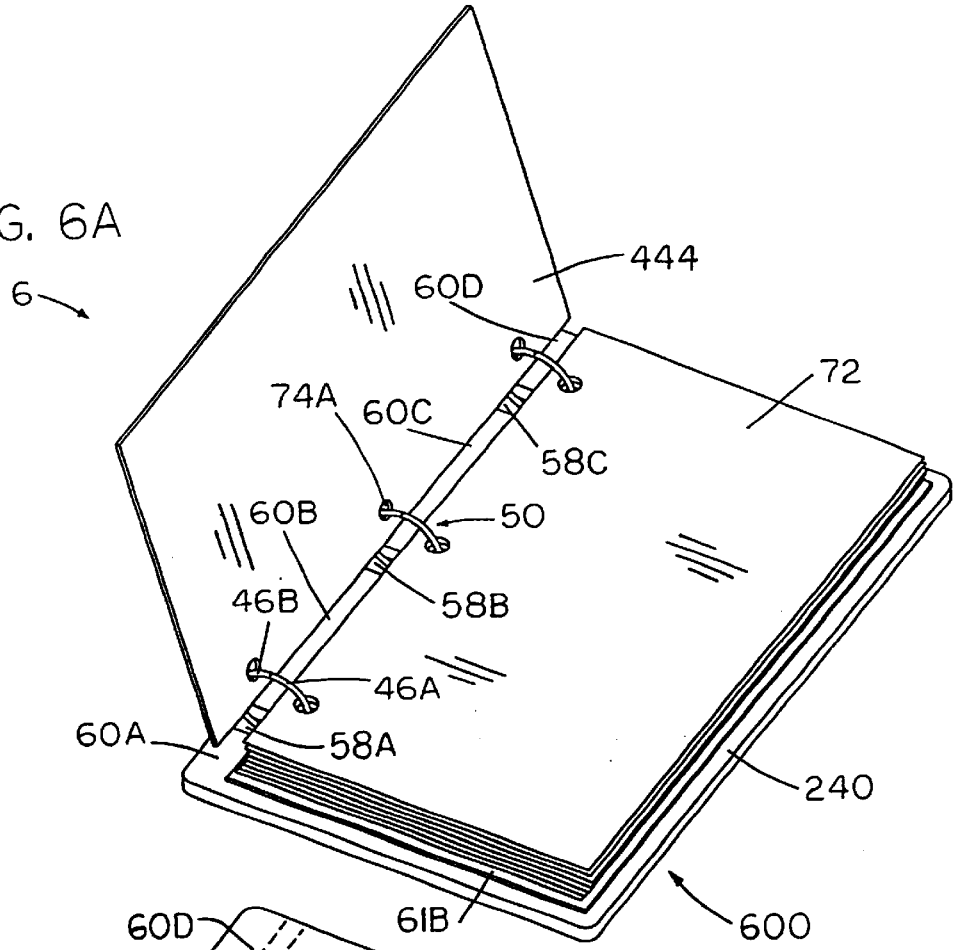
FIG. 6A is a perspective view of a sixth embodiment of the binder with a loose-leaf front cover, no middle cover, and the back cover rotatable about the spine of the binder skeleton.
Figure 6B:
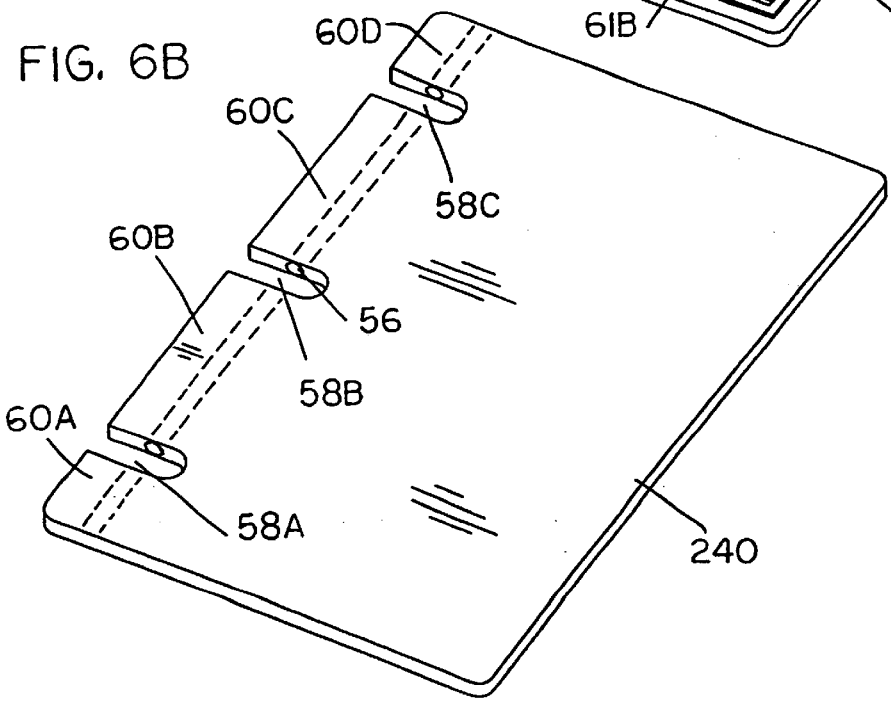
FIG. 6B is a perspective view of the back cover of the binder of FIG. 6A.

FIG. 6A shows a perspective view of another embodiment of a binder 6 of the present invention comprising cover 600 and skeleton 50. FIG. 6B shows a perspective view of back cover 240. Cover 600 includes back cover 240 and front cover 444. The binder 6 of the present invention is similar to the binder 2 shown in FIGS. 2A–2E except that the binder 6 has no enveloping middle cover 42. Spine 53 of skeleton 50 is rotatably disposed in conduit 56 defined by back cover 240 such that spine 53 is a pivot of back cover 240. Like the front cover 144 of the binder 2 shown in FIGS. 2A–2E, front cover 444 of the binder 6 of the present invention defines holes 74A for receiving rings 46 thereby enabling front cover 444 to be releasably bound by the rings 46. Since there is no middle cover, the binder 6 of the present invention is more economical to manufacture and easier to open and close than similar binders having middle covers.

FIGS. 7A–7B

Figure 7A:
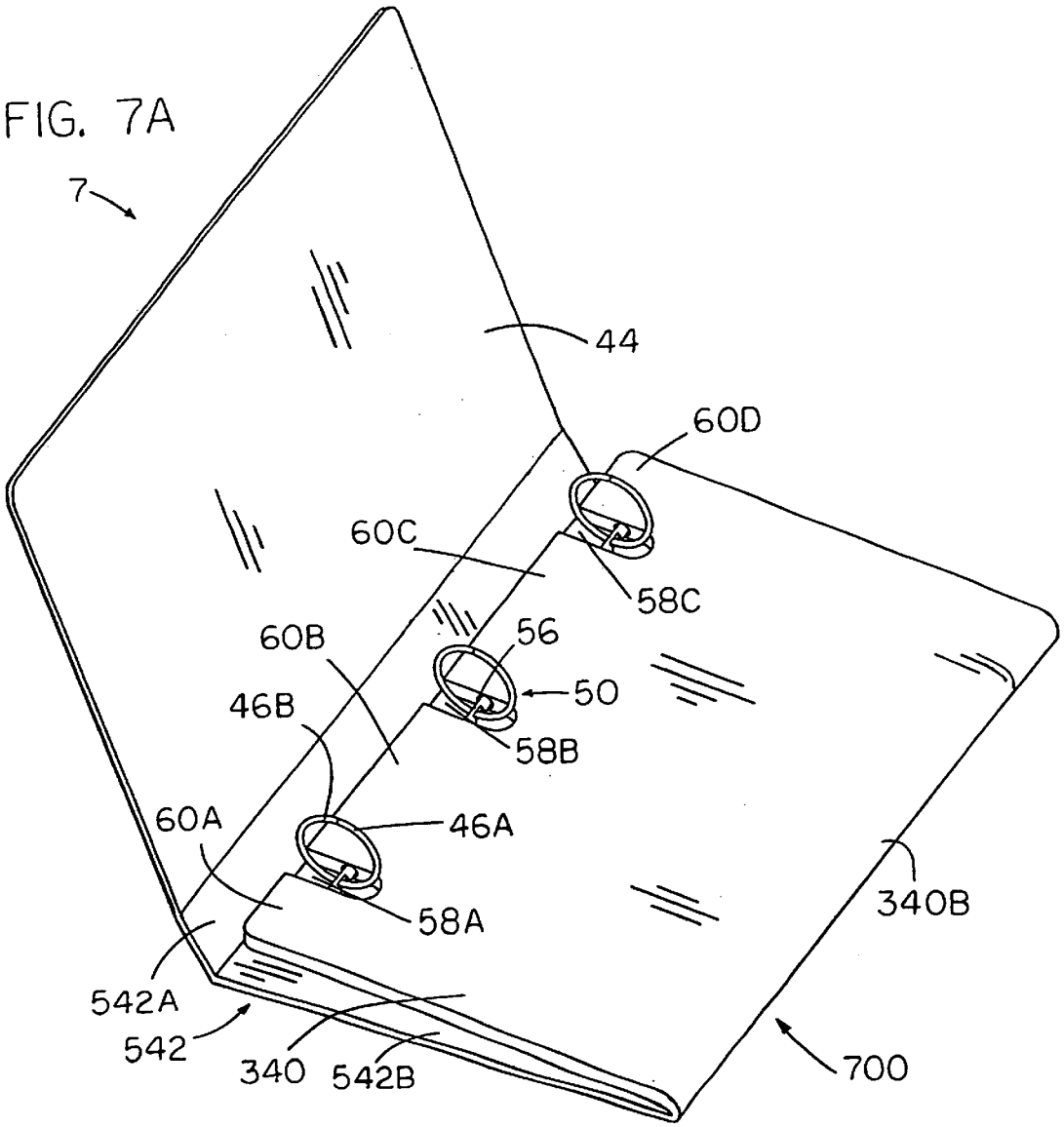
FIG. 7A is a perspective view of a seventh embodiment of the binder having a quad-planar cover, composed of a back cover interfaced to a bi-planar middle cover that interfaces to a front cover, and having the spine of the binder skeleton rotatably disposed adjacent a free edge of the back cover.
Figure 7B:
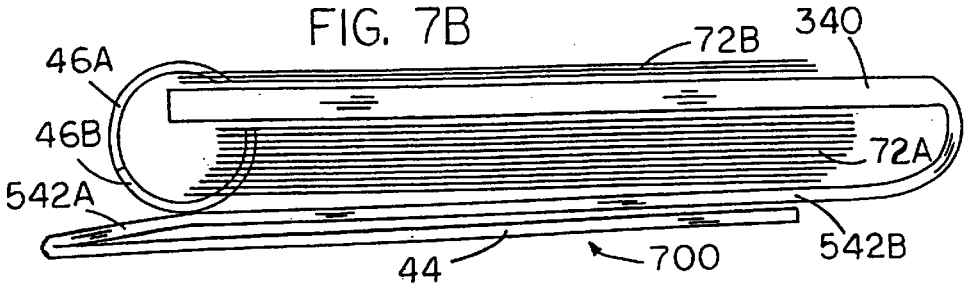
FIG. 7B is a bottom view of the binder of FIG. 7A where forward loose-leaf pages have been flipped flatly beneath the cover segment containing the skeleton and beneath the latter loose-leaf pages and where the cover has been folded into a "Z" shape.

FIGS. 7A and 7B are perspective and bottom views of yet an additional preferred embodiment of a binder 7 of the present invention. The binder 7 comprises cover 700 and skeleton 50. Cover 700 includes back cover 340, middle cover 542, and front cover 44. The binder 7 is a variation of the binder 1 of the present invention having middle cover 542, which has been enlarged and is attached or integrally formed with the far edge 340B of back cover 340. Middle cover 542 is a bi-planar middle cover having middle cover portion 542A and middle cover portion 542B. The binder 7 of the present invention opens to 180 degrees similar to the binder 1 shown in FIGS. 1A–1F, but opens differently to the 360 degree position. FIG. 7B shows the binder 7 cover folded in a "Z" shape when opened 360 degrees and forward loose-leaves 72A are sandwiched between back cover 340 and middle cover portion 542B. When cover 700 is open 360 degrees, only back cover 340 of cover 700 is in flat formation between forward loose-leaves 72A and latter loose-leaves 72B. The inner diameter of rings 46 is substantially greater than the thickness of the flat formation of back cover 340 for a purpose (2) recited earlier in the description of the binder 1.

FIG. 8

Figure 8:
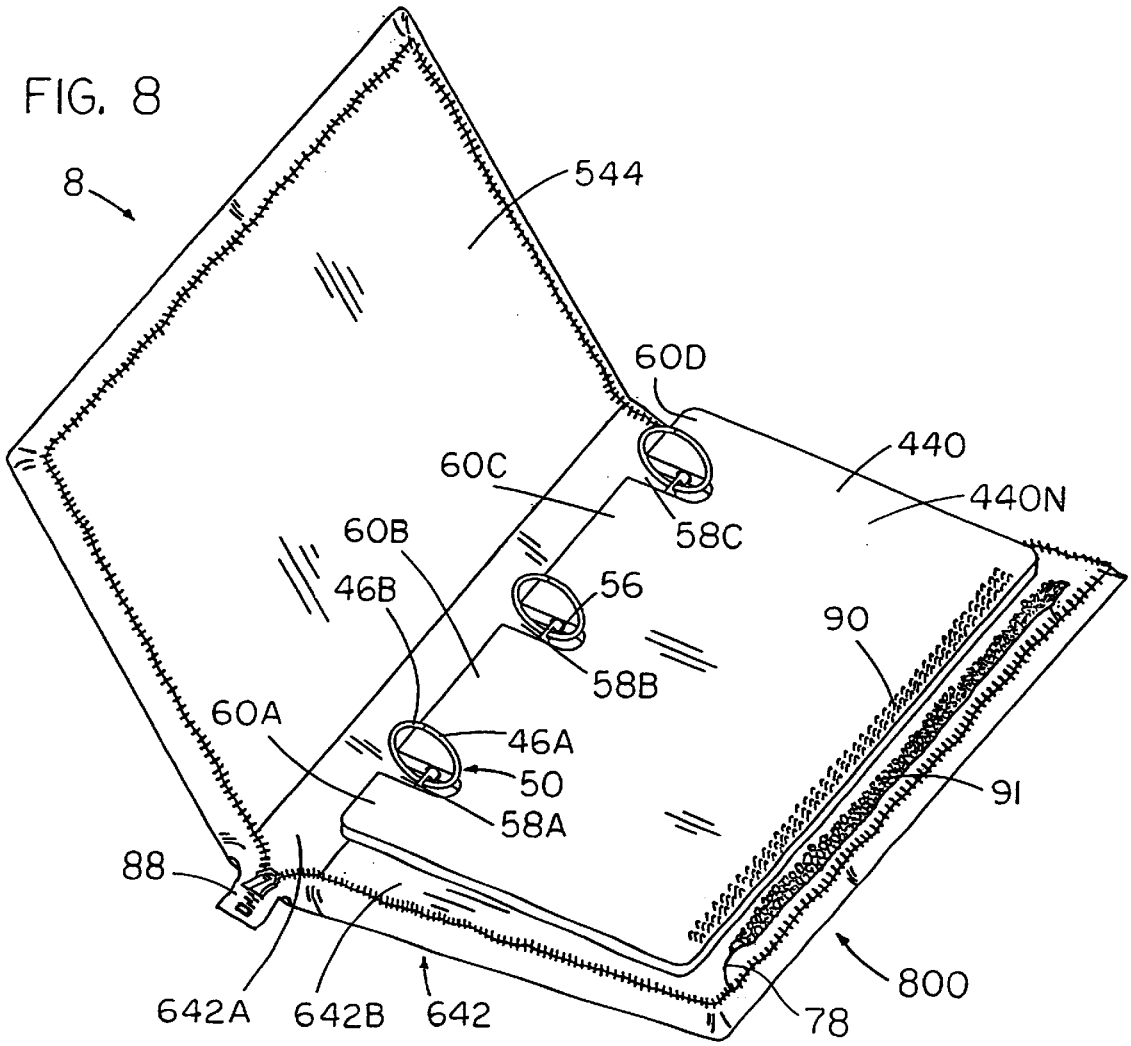
FIG. 8 is a perspective view of an eighth embodiment of the binder which is similar to the seventh embodiment but is also zipper-closable and the back cover is attached or detached via a hook-and-loop fastener.

FIG. 8 is a perspective view of yet another preferred embodiment of a binder 8 of the present invention. The binder 8 comprises cover 800 and skeleton 50. Cover 800 includes back cover 440, middle cover 642, front cover 544, and zipper 88. The binder 8 is similar to the binder 7 shown in FIGS. 7A–7B since back cover 440 connects to middle cover portion 642B of the binder 8 much like back cover 340 connects to middle cover portion 542B of the binder 7. The binder 8, however, also comprises a zipper 88 for securely enclosing back cover 440, skeleton 50 and loose-leaves 72 (not shown) for improved storage and handling capability. Middle cover 642 has portions 642A and 642B. In addition, back cover 440 is releasably attached to middle cover portion 642B via a loop 91 and hook 90 fastener. Hooks 90 are disposed on the back cover interior surface 440N and loops 91 are disposed on a flap 78 attached to middle cover 642B.

Since zipper 88 can become an encumbrance during usage, back cover 440 can be detached from the other cover sections of the binder. Spine 53 of skeleton 50 is disposed in conduit 56 of back cover 440. When the back cover 440 is detached from middle cover portion 642B, the binder 8 then resembles the binder 6 and can be used in a similar fashion bearing a minimal footprint when the forward loose-leaves 72A are flipped back against back cover 440. If zipper 88 is not an inconvenience, back cover 440 can be left attached to middle cover 642, and forward loose-leaves 72A can be flipped beneath back cover 440 by sandwiching them between back cover 440 and middle cover portion 642B.

FIG. 9

Figure 9:
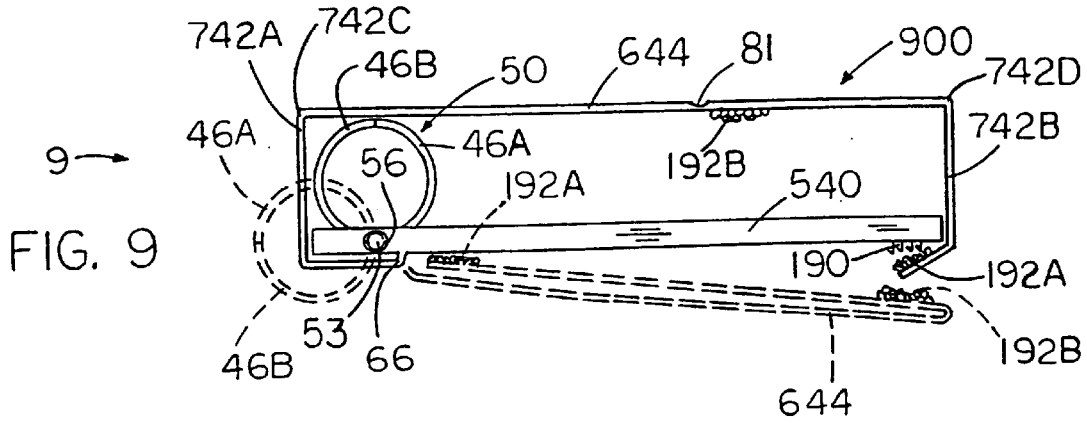
FIG. 9 is a bottom view of a ninth embodiment of the binder which is similar to embodiment one but with a second middle cover segment that is interfaced to the front cover and that connects via hook-and-loop fastener to the back cover to fasten the binder shut.

FIG. 9 shows a bottom view of an additional preferred embodiment of a binder 9 of the present invention. The binder 9 comprises cover 900 and skeleton 50. Cover 900 includes back cover 540, middle covers 742A and 742B, and front cover 644. The binder 9 is similar to the binder 1 shown in FIGS. 1A–1F but also comprises a dual-purpose fastener comprising loops 190 and hooks 192A and 192B and an extra middle cover 742B. Middle cover 742A and middle cover 742B are disposed on opposite sides of the binder 9. Crease or hinge 742C is disposed between middle cover 742A and front cover 644 while crease or hinge 742D is disposed between front cover 644 and middle cover 742B. Several rows of hooks 190 are disposed on back cover 540 which cooperate with the rows of loops 192A and 192B disposed on middle cover 742B and front cover 644, respectively. The dual purpose fastener is composed of hooks 190 and alternative attachment positions at loops 192A or loops 192B.

When the binder 9 is closed, hooks 190 fasten to loops 192A. When the binder 9 is opened 360 degrees as substantially shown in broken lines in FIG. 9, front cover 644 is folded upon itself at crease 81 and hooks 190 fasten to loops 192B to hold front cover 644 securely in place against back cover 540. The addition of middle cover 742B lets the binder 9 enclose rings 46 and inserted loose-leaves 72 on four sides when the binder 9 is closed and thus provides improved storage and handling. When the binder 9 is opened 360 degrees in a flat formation, front cover 644, middle cover 742A, and middle cover 742B are disposed beneath the wide portion of back cover 540, as divided by conduit 56, to avoid interfering with the rotation of rings 46 and to minimize the footprint of the binder 9. For purpose (2) recited earlier in the description of the binder 1 shown in FIGS. 1A–1F, the inner diameter of rings 46 is substantially greater than the thickness of the flat formation of cover 900 which equals the sum of the thickness of back cover 540 plus twice the thickness of front cover 644.

FIG. 10

Figure 10:
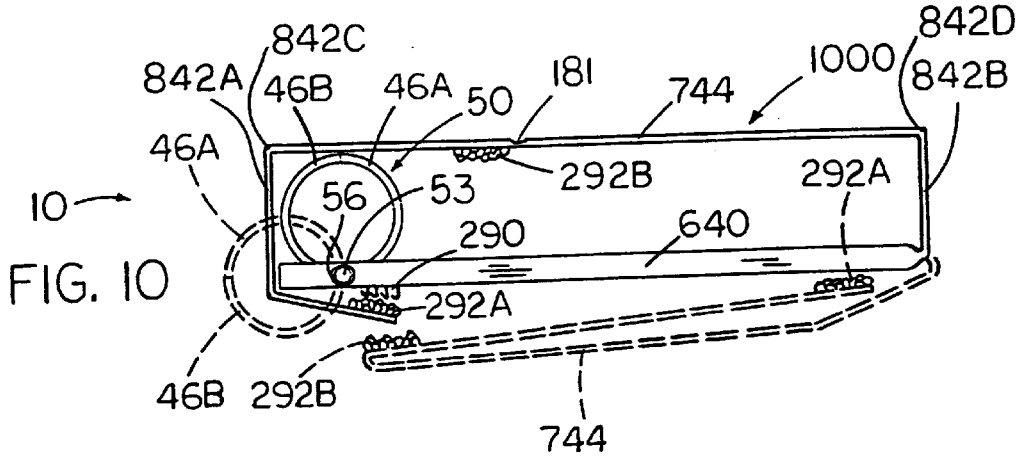
FIG. 10 is a bottom view of a tenth embodiment of the binder and is similar to embodiment 9, but switches the position of permanent middle-cover-back-cover attachment with that of the hook-and-loop middle-cover-back-cover attachment position.
Figure 11:
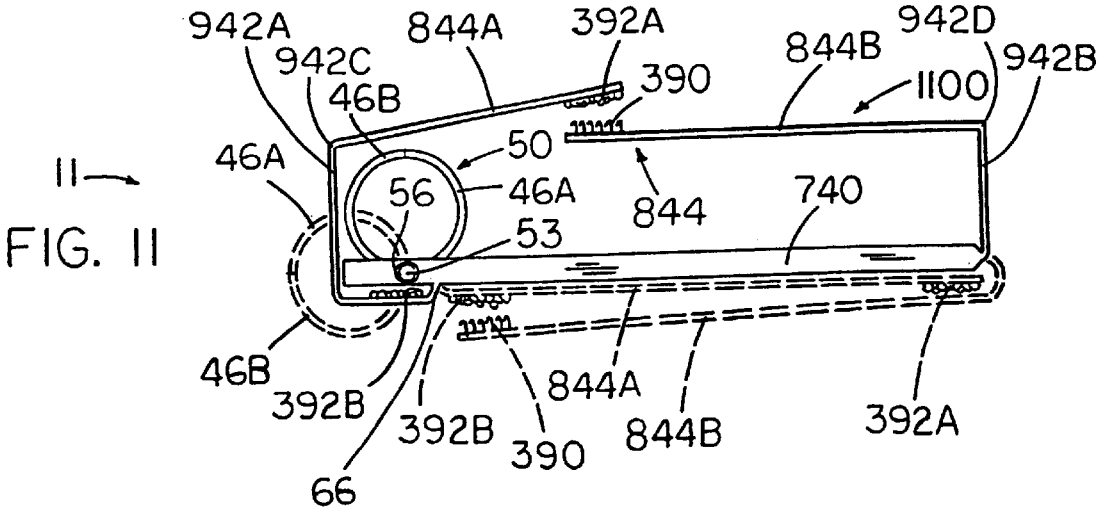

FIG. 10 shows a bottom view of yet another preferred embodiment of a binder 10 of the present invention. The binder 10 comprises cover 1000 and skeleton 50. Cover 1000 includes back cover 640, middle covers 842A and 842B, and front cover 744. The binder 10 is similar to the binder 9 of FIG. 9 in that the binder 10 comprises a dual purpose fastener comprising hooks 290 and loops 292A and 292B and an extra middle cover segment 842B. Crease or hinge 842C is disposed between middle cover 842A and front cover 744 while crease or hinge 842D is disposed between front cover 744 and middle cover 842B. Whereas middle cover 742A, front cover 644, and middle cover 742B are rotated clockwise to a position underneath back cover 540 in the binder 9 in FIG. 9, middle cover 842B, front cover 744, and middle cover 842A of the binder 10 are rotated counterclockwise to a position underneath back cover 640. Thus, the respective front covers 644 and 744 of the binders 9 and 10 open in opposite directions. In addition, the binder 10, like the binder 9, encloses rings 46 and inserted loose-leaves on four sides when closed and uses dual-purpose hook-and-loop fasteners.

The fastener of the binder 10 comprises rows of hooks 290 disposed on back cover 640 and alternative attachment positions comprising rows of loops 292A and 292B disposed on middle cover 842A and front cover 744, respectively. When the binder 10 is closed, the rows of hooks 290 fasten to the rows of loops 292A. When the binder 10 is opened 360 degrees as substantially shown in broken lines in FIG. 10, front cover 744 is folded upon itself at crease 181 and the rows of hooks 290 fasten to the rows of loops 292B to hold front cover 744 securely in place against back cover 640.

FIG. 11

FIG. 11 shows a bottom view of another preferred embodiment of a binder 11 of the present invention. The binder 11 comprises cover 1100 and skeleton 50. Cover 1100 includes back cover 740, middle covers 942A and 942B, and front cover 844. Front cover 844 has releasably connecting portions 844A and 844 B. The binder 11 shares similarities with the binder 9 of FIG. 9 and the binder 10 of FIG. 10. The binder 11 of the present invention comprises a front-middle cover segment made up of front cover portion 844A and middle cover 942A that is permanently attached to back cover 740 near conduit 56. The binder 11 also comprises a front-middle cover segment made up of front cover portion 844B and middle cover 942B that is permanently attached to the back cover 740. Crease or hinge 942C is disposed between middle cover 942A and front cover portion 844A while crease or hinge 942D is disposed between front cover portion 844B and middle cover 942B. The two front-middle cover segments fasten together above back cover 740 when the binder 11 is closed or below back cover 740 when the binder 11 is open. The dual purpose hook-and-loop fastener of binder 11 comprises rows of hooks 390 and alternative attachment positions comprising rows of loops 392A and 392B.

When the binder 11 is closed, hooks 390 fasten to loops 392A. When the binder 11 is opened 360 degrees as substantially shown in the broken lines of FIG. 11, front cover portion 844B is folded upon front cover portion 844A and hooks 390 fasten to loops 392B to hold front cover portion 844A and front cover portion 844B securely in place against back cover 740. Like the binder 9 of FIG. 9 and the binder 10 of FIG. 10, the binder 11 of the present invention encloses rings 46 and inserted loose-leaves 72 on four sides when closed and when open 360 degrees, middle cover 942A, middle cover 942B, front cover portion 844A, and front cover portion 844B are disposed beneath the wide portion of back cover 740, as divided by conduit 56, to avoid interfering with the rotation of rings 46.

FIG. 12

Figure 12:
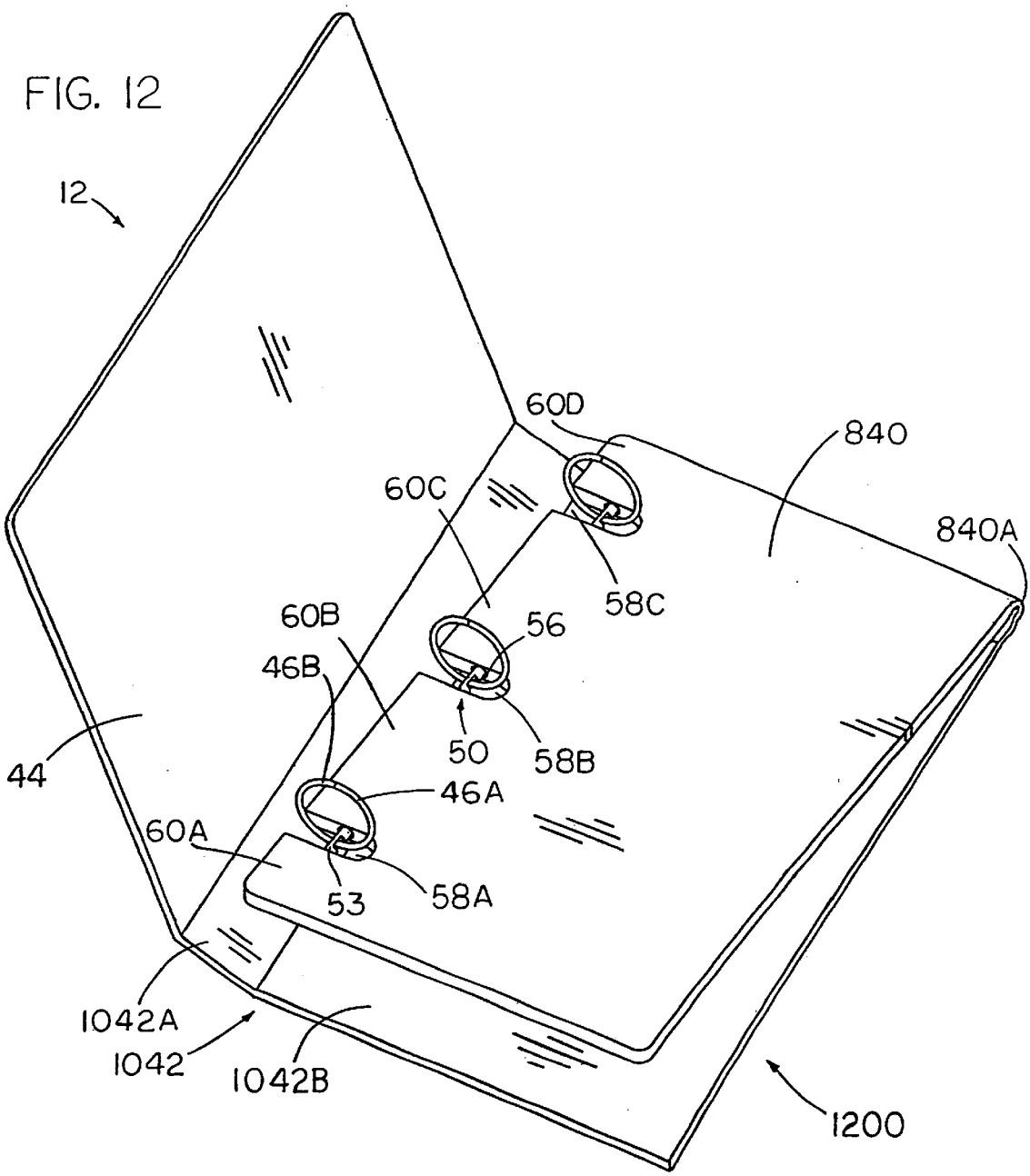
FIG. 12 is a perspective view of a twelfth embodiment of the binder having a quad-planar cover composed of a back cover which is rotatable about the spine of the skeleton and whose top edge is interfaced to the top edge of one of the planar segments of a bi-planar middle cover.

FIG. 12 shows a perspective view of yet an additional embodiment of a binder 12 of the present invention. The binder 12 comprises cover 1200 and skeleton 50. Cover 1200 includes back cover 840, middle cover 1042, and front cover 44. The binder 12 differs from most of the binders presented thus far in how middle cover 1042, having portions 1042A and 1042B, avoids interfering with the rotation of rings 46 of skeleton 50 when forward loose-leaves 72A are flipped beneath back cover 840 and latter loose-leaves 72B. The middle cover portion 1042B is connected to the back cover 840 with a hinge joint or fold 840A. As shown in FIG. 12, middle cover portion 1042A is disposed between middle cover portion 1042B and front cover 44.

When loose-leaves 72 are to be flipped beneath back cover 840, back cover 840 is pivoted up about fold 840A which is preferably expandable to accommodate a large volume of loose-leaves 72 flipped underneath the back cover 840. Forward loose-leaves 72A are then flipped 360 degrees around back cover 840 causing the rotation of rings 46. Back cover 840 is subsequently pivoted back toward its original position which sandwiches the forward loose-leaves 72A between back cover 840 and middle cover portion 1042B. To write on the reverse side of a loose-leaf, back cover 840 is flipped from the front side of middle cover portion 1042B up against the back side thereof so that the reverse side of the desired loose-leaf is exposed. To minimize the footprint of the binder, front cover 44 can be folded against one side of middle cover portion 1042B while back cover 840 is folded against the other side of middle cover portion 1042B. Alternatively, front cover 44 can be sandwiched between middle cover portion 1042B and back cover 840.

FIGS. 13A–13B

Figure 13A:
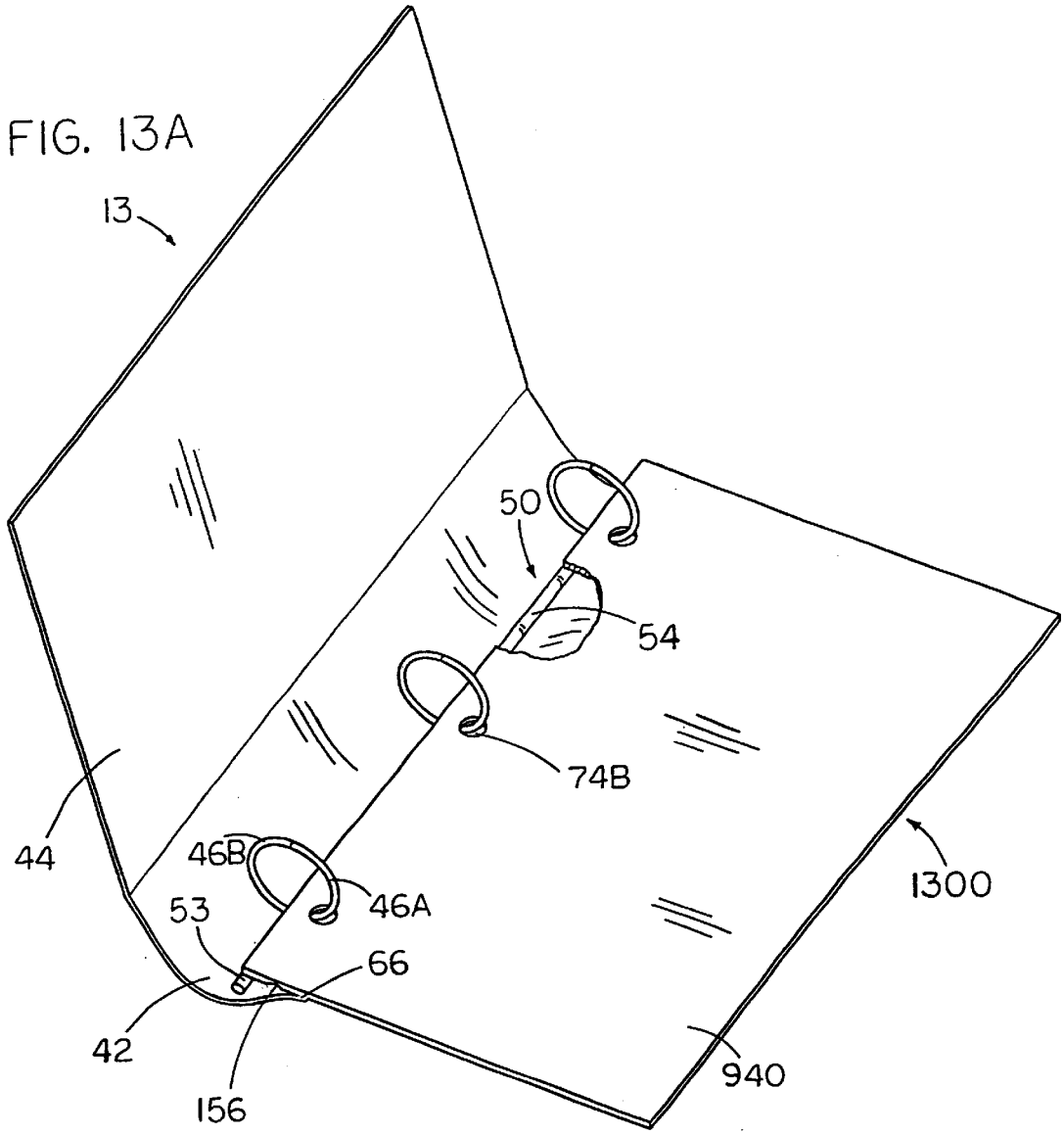
FIG. 13A is a perspective view of a thirteenth embodiment of the binder with the middle cover attached to the back cover in a manner similar to binder 1 but the back cover rides loose-leaf on the rings and the skeleton is not embedded in the cover.
Figure 13B:
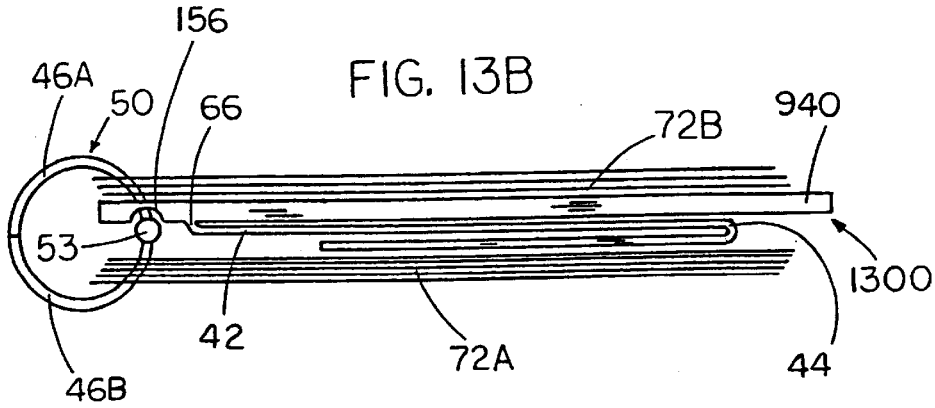
FIG. 13B is a bottom view of the binder of FIG. 13A with the front cover flipped 360 degrees open relative to the back cover and with the front cover folded upon itself.

FIGS. 13A and 13B are perspective and bottom views, respectively, of an additional embodiment of a binder 13 of the present invention. The binder 13 comprises cover 1300 and skeleton 50. Cover 1300 includes front cover 44, middle cover 42, and back cover 940. Like the binder 1 of FIG. 1A, middle cover 42 of the binder 13 attaches to back cover 940 at seam 66. Back cover 940 has holes 74B to enable it to be releasably attached to rings 46 and has open conduit 156 which intersects holes 74B. Spine 53 of skeleton 50 is not disposed within back cover 940. However, when the binder 13 is open 360 degrees as shown in FIG. 13B, the open conduit 156 defined by back cover 940 receives tube 54 of spine 53 to minimize or eliminate the lump caused by spine 53 so that back cover 940 can lie flat. Because back cover 940 hangs in a loose-leaf manner on rings 46 via holes 74B, spine 53 and rings 46 are able to rotate relative to back cover 940 as needed when the binder 13 is open 360 degrees. Front cover 44 is preferably flexible enough to fold against itself to minimize the binder's footprint when open 360 degrees. When the binder 13 is closed, skeleton 50 is surrounded by back cover 940, middle cover 42, and front cover 44 so that rings 46 are not exposed thus making the binder 13 more attractive and easy to handle.

FIGS. 14A–14C

Figure 14A:
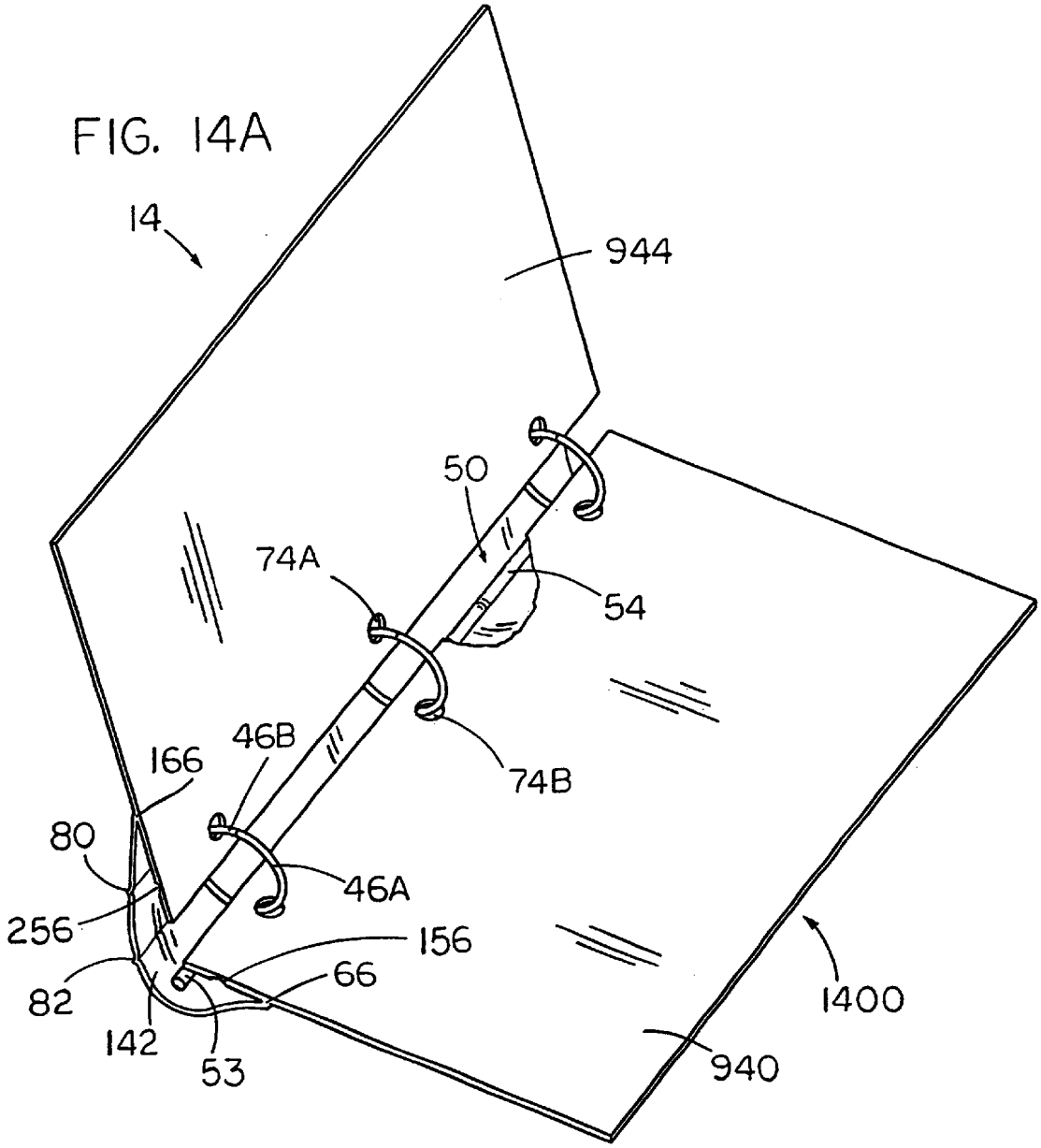
FIG. 14A is a perspective view of a fourteenth embodiment of the binder with the middle cover attached to the front and back covers in a manner similar to binder 2 but both the front and back covers ride loose-leaf on the rings and the skeleton is not embedded in the cover.
Figure 14B:
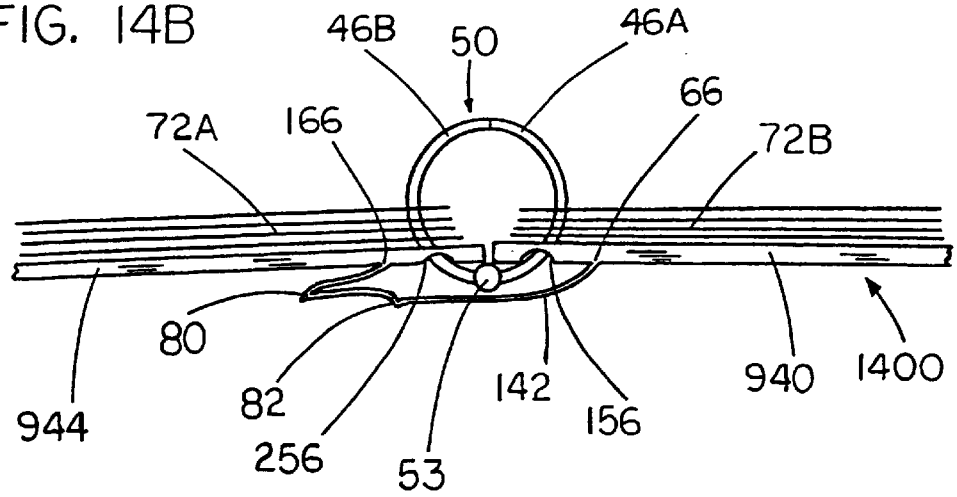
FIG. 14B is a bottom view of the binder of FIG. 14A with the front cover flipped 180 degrees open relative to the back cover and with the middle cover folded along a 180-degree-open crease.
Figure 14C:
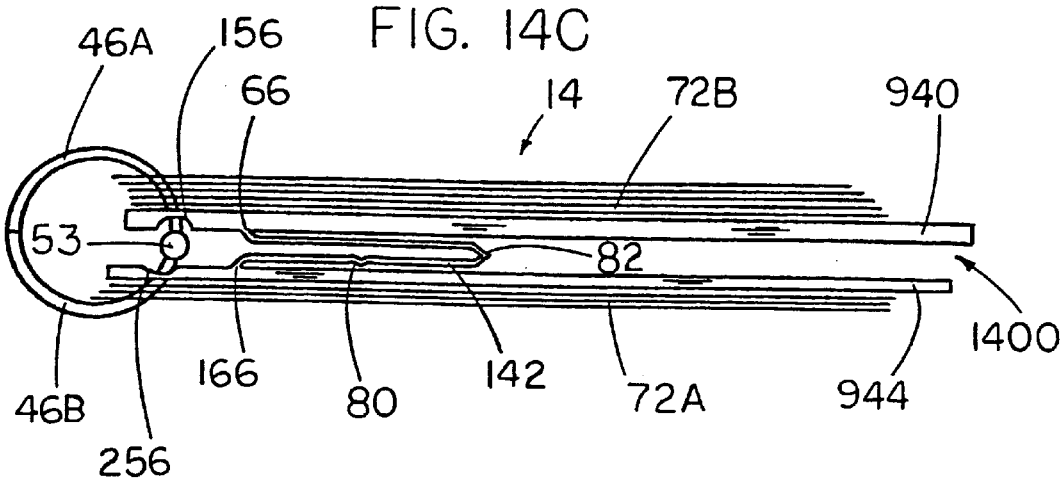
FIG. 14C is a bottom view of the binder of FIG. 14A with the front cover flipped 360 degrees open relative to the back cover and with the middle cover folded along a 360-degree-open crease.

FIGS. 14A–14C are perspective and bottom views of a further preferred embodiment of a binder 14 of the present invention. The binder 14 comprises cover 1400 and skeleton 50. Cover 1400 includes middle cover 142, back cover 940, and front cover 944. Like the binder 2 of FIGS. 2A–2E, middle cover 142 of the binder 14 attaches to back cover 940 and front cover 944 at seams 66 and 166, respectively. Front cover 944 has holes 74A to enable it to be releasably attached to rings 46 and has open conduit 256 which intersects holes 74A. Likewise, back cover 940 has holes 74B to enable it to be releasably attached to rings 46 and has open conduit 156 which intersects holes 74B. Spine 53 of skeleton 50 is not disposed within back cover 940. When the binder 14 is open 360 degrees as shown in FIG. 14C, middle cover 142 folds flat along crease 82 and the open conduits 156 and 256 defined by the back cover 940 and front cover 944, respectively, receive tube 54 of spine 53 to minimize or eliminate the lump caused by spine 53 so that back cover 940 can lie flat relative to front cover 944. When the binder 14 is open 180 degrees as shown in FIG. 14B, middle cover 142 tends to fold flat along crease 80. When the binder 14 is open 360 degrees, spine 53 and rings 46 are able to rotate relative to front cover 944 and back cover 940 as needed depending upon the number of forward loose-leaves 72A. When the binder 14 is closed, skeleton 50 is surrounded by back cover 940, middle cover 142, and front cover 944 so that rings 46 are not exposed thus making the binder 14 more attractive and easy to handle.

FIG. 15

Figure 15:
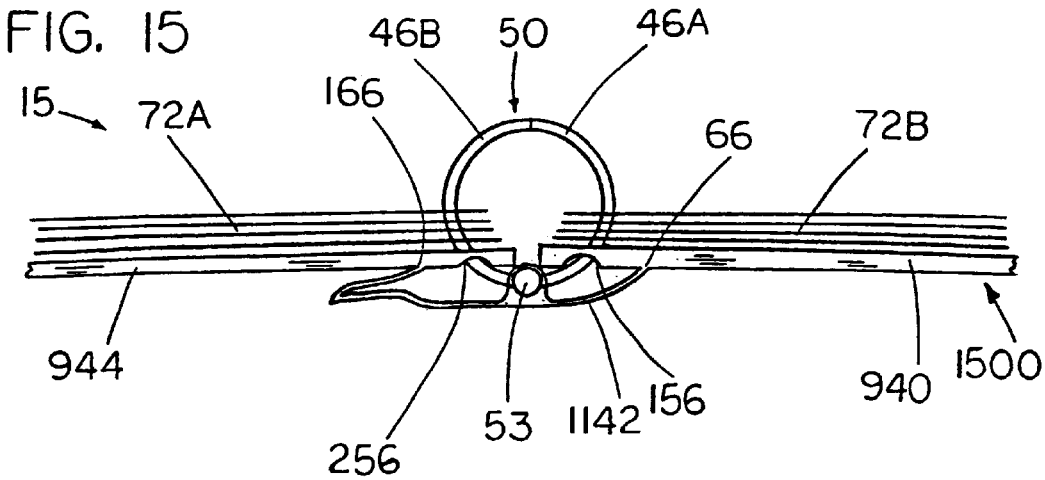
FIG. 15 is a bottom view of a fifteenth embodiment of the binder with the front cover open 180 degrees relative to the back cover, the skeleton embedded in the middle cover, the front and back covers ride loose-leaf on the rings, and the middle cover is connected to the front and back cover at attachment seams exterior to the rings.

FIG. 15 is a bottom view of another preferred embodiment of a binder 15 of the present invention. The binder 15 comprises cover 1500 and skeleton 50. Cover 1500 includes back cover 940, front cover 944 and middle cover 1142. Spine 53 of skeleton 50 is disposed within the middle cover 1142. Skeleton 50 is able to rotate relative to back cover 940 because middle cover 1142 is preferably very thin and flexible and defines slots similar to the slots 258A–258C of binder 5 shown in FIG. 5A. When the binder 15 is open 360 degrees, thin and flexible middle cover 1142 folds flat and open conduits 156 and 256 receive spine 53 wrapped in part of middle cover 1142 to minimize or eliminate the lump caused by spine 53 so that back cover 940 can lie flat relative to front cover 944.

Figure 16:
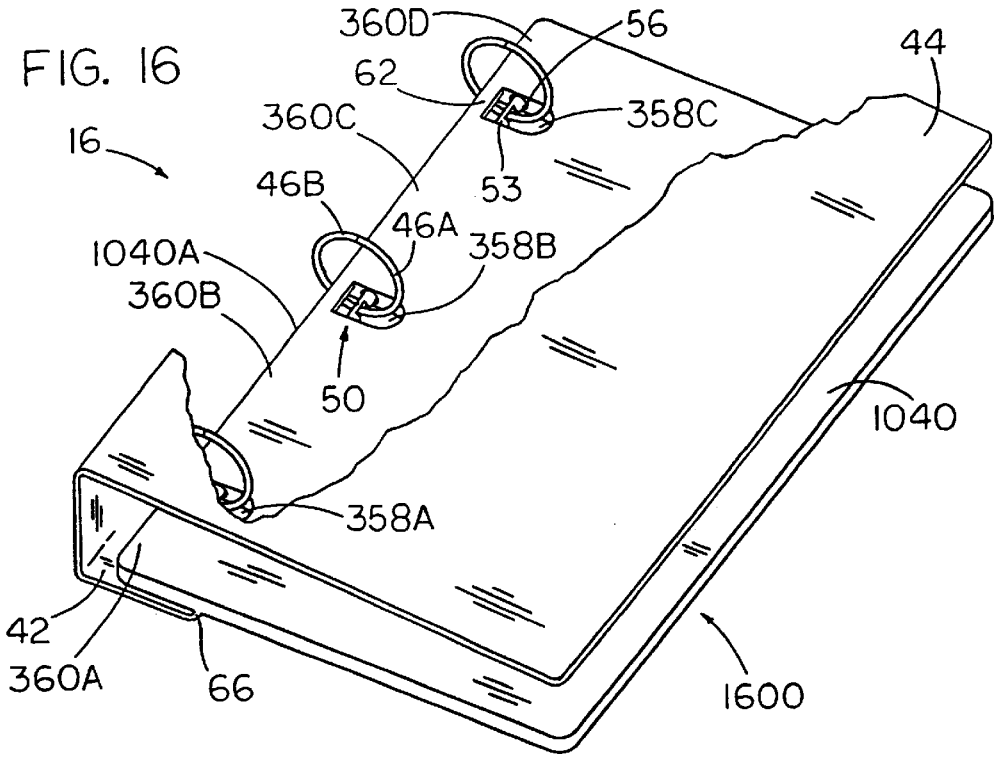
FIG. 16A is a perspective view of a sixteenth embodiment of the binder which is similar to binder 1 but with openings instead of slots.

FIG. 16 Description/Operation

FIG. 16A is a perspective view of yet a further embodiment of a binder 16 of the present invention. The binder 16 comprises cover 1600 and skeleton 50. Cover 1600 includes middle cover 42, front cover 44, and back cover 1040. Back cover 1040 defines margin supports 360A–360D divided by openings 358A–358C. Bridges 62 span openings 358A–358C at edge 1040A of back cover 1040. Bridges 62 have a smaller thickness than back cover 1040 to enable rings 46 to stand upright when the binder 16 is closed. Skeleton 50 and rings 46 are able to rotate relative to back cover 1040. By enabling rings 46 to stand upright when the binder 16 is closed and permitting spine 53 and rings 46 to adequately rotate relative to back cover 940 when the binder 16 is open 360 degrees, openings 358A–358C are nearly functionally equivalent to slots 58A–58C of the binder 1 of FIG. 1A.

FIG. 17

Figure 17:
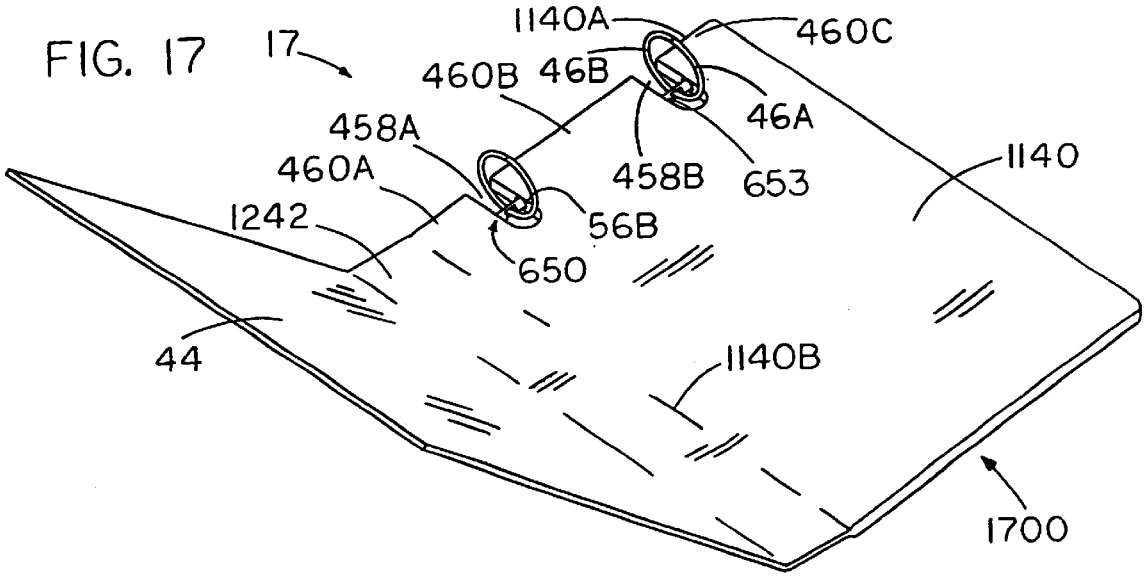
FIG. 17 is a perspective view of a seventeenth embodiment of the binder with the skeleton embedded near the top edge of the back cover so that loose-leaves hang from the top of the back cover.

FIG. 17 shows a perspective view of yet another preferred embodiment of a binder 17 of the present invention. The binder 17 comprises cover 1700 and skeleton 650. Cover 1700 includes back cover 1140, middle cover 1242, and front cover 44. The back cover 1140 defines slots 458A and 458B interspaced between margin supports 460A–460C. As shown in FIG. 17, spine 653 of skeleton 650 is disposed within conduit 56B defined by the top edge 1140A of back cover 1140. Middle cover 1242 is disposed between back cover 1140 and front cover 44. Loose-leaves are flipped over the top edge 1140A of back cover 1140 while middle cover 1242 and front cover 44 are flipped around the side edge 1140B of back cover 1140 in order to minimize the footprint of the binder 17.

FIGS. 18A–18B

Figure 18A:
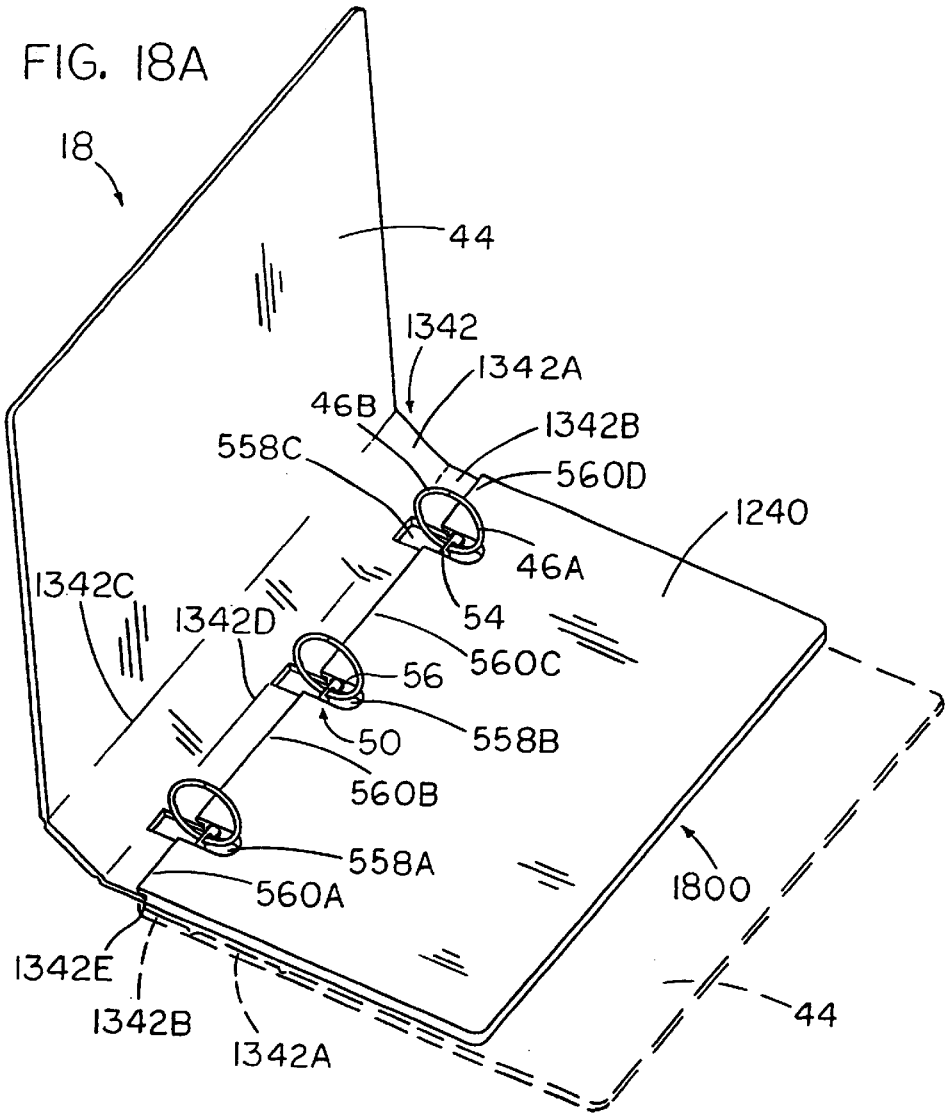
FIG. 18A is a perspective view of an eighteenth embodiment of the binder where the back cover is rotatable about the spine of the skeleton, the planar segment of the bi-planar middle cover which interfaces with the back cover folds 180 degrees relative to the back cover and slot-holes that are half in the back cover and half in the middle cover are bisected by this fold and enable the rings to rotate counterclockwise without interfering with the back or middle cover.
Figure 18B:
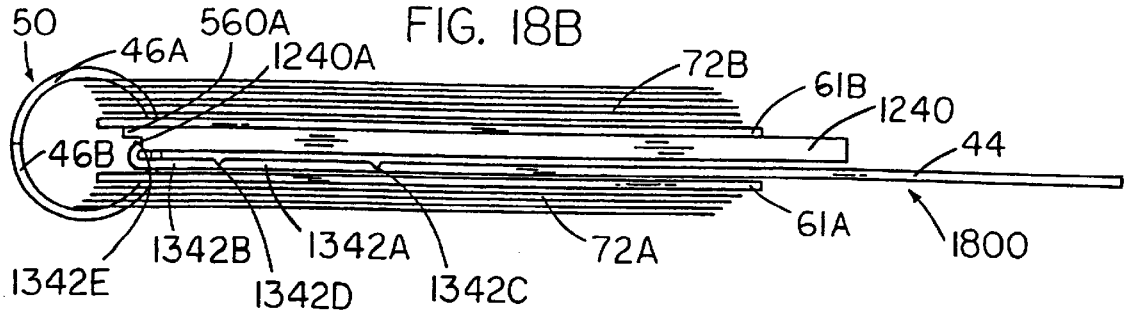
FIG. 18B is a bottom view of the binder of FIG. 18A with the front cover flipped 180 degrees open relative to the back cover and with the addition of writing-support pads and loose-leaves.

FIGS. 18A and 18B are perspective and bottom views of another preferred embodiment of a binder 18 of the present invention. The binder 18 comprises cover 1800 and skeleton 50. Cover 1800 includes front cover 44, back cover 1240 and a bi-planar middle cover 1342. Middle cover 1342 has middle cover portion 1342A and middle cover portion 1342B. As shown in FIG. 18A, middle cover portion 1342A is disposed between front cover 44 and middle cover portion 1342B which is disposed between middle cover portion 1342A and back cover 1240. Crease 1342C is preferably disposed between front cover 44 and middle cover portion 1342A and crease 1342D is preferably disposed between middle cover portion 1342A and middle cover portion 1342B. Middle cover portion 1342B and back cover 1240 each define half of the total area of slots 558A–558C interspaced between margin supports 560A–560D. The perimeters of slots 558A–558C are closed and completely surrounded by middle cover portion 1342B and back cover 1240.

Slots 558A–558C are roughly O-shaped and exposed when the binder 18 is closed. The slots 558A–558C fold in half along a fold 1342E between middle cover portion 1342B and back cover 1240 to become roughly U-shaped when front cover 44, middle cover portion 1342A and middle cover portion 1342B are flipped back against back cover 1240 to minimize the footprint of the binder 18 as shown in FIG. 18B and in dotted lines in FIG. 18A. The folding of slots 558A–558C prevents back cover 1240, middle cover portion 1342A and middle cover portion 1342B from interfering with the rotation of rings 46 through the plane of back cover 1240. When cover 1800 is folded flatly open 360 degrees, a portion of each ring 46 is rotatable around the near-ring edge 1240A.

This construction of the binder 18 does not require the attachment of middle cover portion 1342B to the wide portion of back cover 1240 as divided by conduit 56. As shown in FIG. 18B, one edge of middle cover portion 1342B is connected to the edge 1240A of back cover 1240 near margin supports 560A–560D. The fold 1342E adjacent to back cover 1240 can be relocated to enable the edge of middle cover portion 1342B to interface to the edge 1240A of back cover 1240 on either side of back cover 1240 as divided by conduit 56. Forward loose-leaves 72A and latter loose-leaves 72B and pads 61A and 61B lie parallel and flat when the binder 18 is open 360 degrees as shown in FIG. 18B.

FIGS. 19A–19C

Figure 19A:
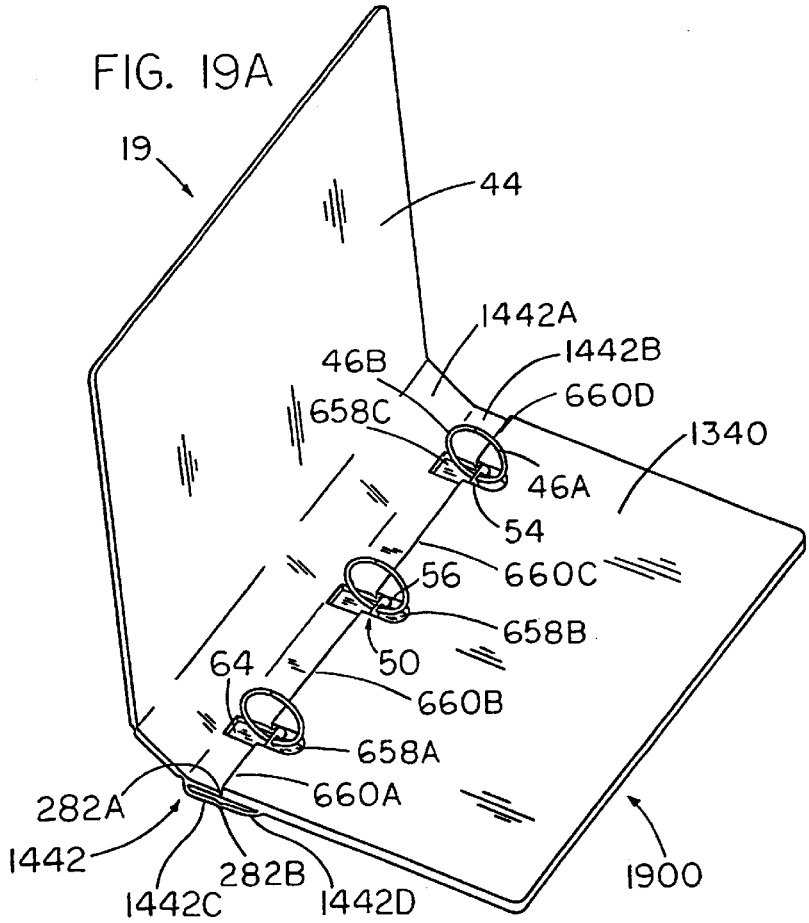
FIG. 19A is a perspective view of a nineteenth embodiment of the binder which is similar to binder 18 with the addition of a folding slot cover.
Figure 19B:
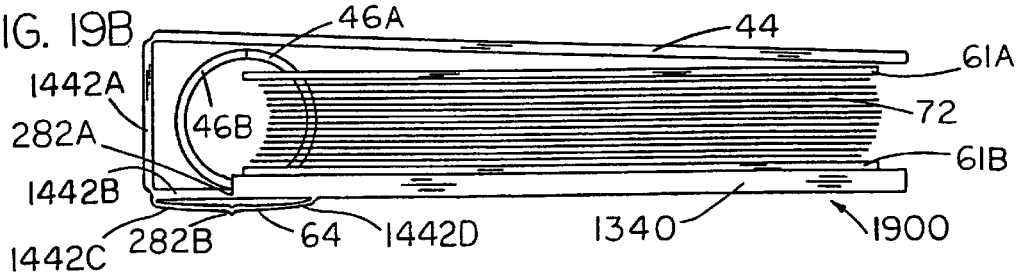
FIG. 19B is a bottom view of the binder of FIG. 19A with the front cover in its closed position relative to the back cover and the folding slot cover in its stretched position and with the addition of writing-support pads and loose-leaves.
Figure 19C:
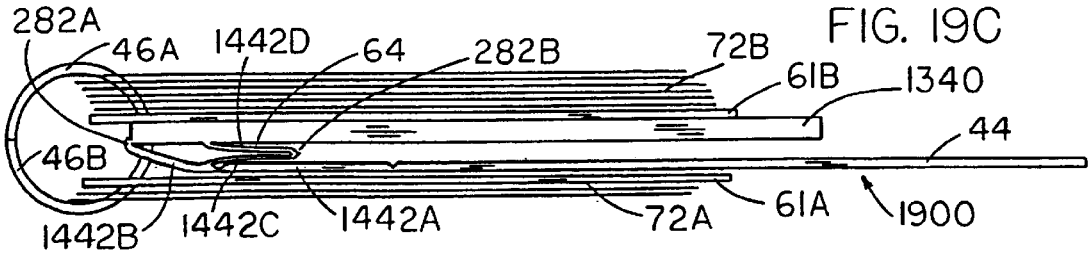
FIG. 19C is a bottom view of the binder of FIG. 19A with the front cover flipped 360 degrees open relative to the back cover and the folding slot cover in its folded position and with the addition of writing-support pads and loose-leaves.

FIGS. 19A–19C are perspective and bottom views, respectively, of yet another preferred embodiment of a binder 19 of the present invention. The binder 19 comprises cover 1900 and skeleton 50. Cover 1900 includes back cover 1340, middle cover 1442 and front cover 44. Middle cover 1442 has portions 1442A–1442D. Back cover 1340 defines margin supports 660A–660D and half of the area of each of the slots 658A–658C, the other halves of which being defined by the middle cover portion 1442B. Unlike the margin supports 560A–560D of the binder 18 shown in FIGS. 18A–18B, the margin supports 660A–660D have the same thickness as the back cover 1340 and are shorter than margin supports 560A–560D of the binder 18. Like the slots 558A–558C of the binder 18 shown in FIGS. 18A–18B, slots 658A–658C fold in half along the fold 282A between middle cover portion 1442B and back cover 1340 when the binder 19 is open 360 degrees. Slot cover 64, having middle cover portions 1442C and 1442D, attaches to middle cover portion 1442B and back cover 1340 and completely spans slots 658A–658B to hide them when the binder 19 is closed as shown in FIG. 19B. Slot cover 64 defines a crease 282B between middle cover portions 1442C and 1442D which allows it to fold neatly away from slots 658A–658C when the binder 19 is open 360 degrees.

FIGS. 20A–20C

Figure 20A:
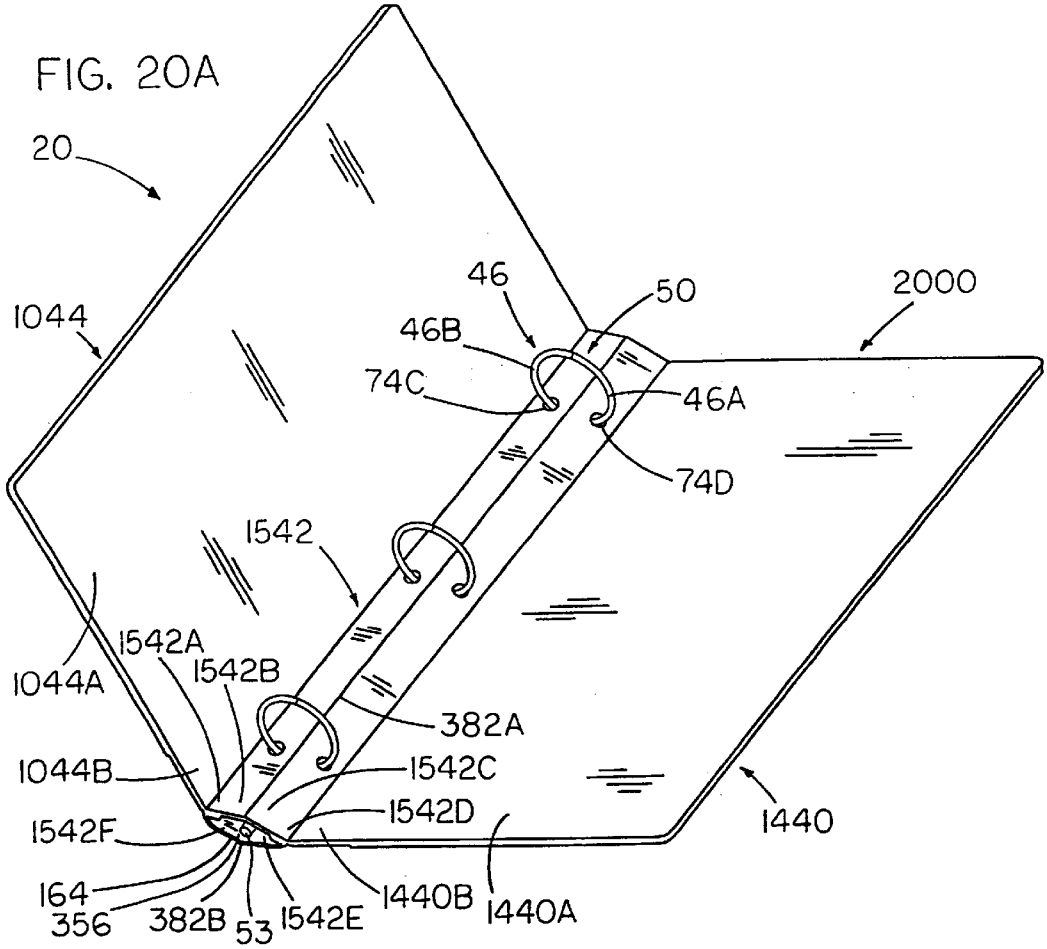
FIG. 20A is a perspective view of a twentieth embodiment of the binder where the skeleton is embedded in a conduit and where the rings of the skeleton are looped through holes in the middle cover.
Figure 20B:
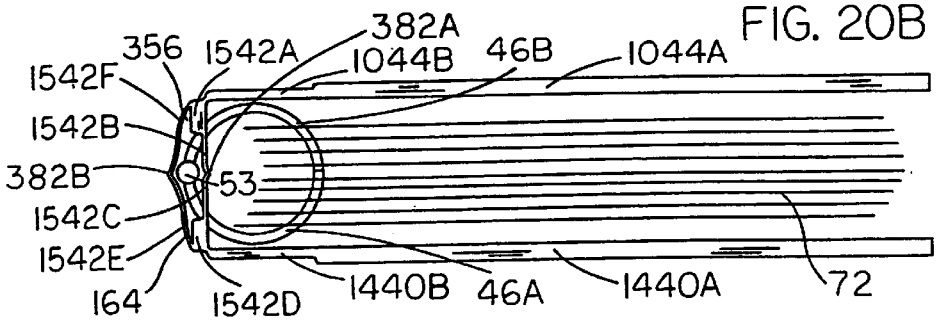
FIG. 20B is a bottom view of the binder of FIG. 20A with the front cover in its closed position relative to the back cover and with the addition of loose-leaves.
Figure 20C:
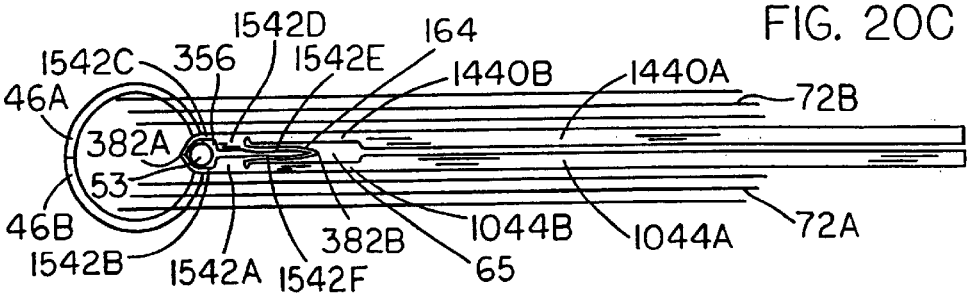
FIG. 20C is a bottom view of the binder of FIG. 20A with the front cover flipped 360 degrees open relative to the back cover and with the addition of loose-leaves.

FIGS. 20A–20C are a perspective and two bottom views, respectively, of yet another preferred embodiment of a binder 20 of the present invention. The binder 20 comprises cover 2000 and skeleton 50. Cover 2000 includes front cover 1044, middle cover 1542, and back cover 1440. Middle cover 1542 has middle cover portions 1542A–1542F that are connected together to define conduit 356. Skeleton 50 is disposed within conduit 356 such that rings 46 are looped through middle cover holes 74C–74D. Conduit 356 changes shape as front cover 1044 is opened relative to back cover 1440. Middle cover portions 1542A–1542D snugly enwrap spine 53 as the binder 20 is opened 360 degrees as seen in FIG. 20C. Spine 53 is a pivot about which cover 2000 can rotate when cover 2000 is flatly-folded open 360 degrees. As the binder 20 is opened from its closed position to its 360 degree position, front cover 1044 and middle cover portion 1542A rotate about fold 382A and spine 53 until they abut back cover 1440 and middle cover portion 1542D, respectively. When cover 2000 is folded flatly open 360 degrees, a transient near-ring edge coinciding with fold 382A exists and a portion of each ring 46 is rotatable about this edge.

Middle cover portions 1542A and 1542D, front cover portion 1044A and back cover portion 1440A are preferably the same thickness so as to form parallel planar surfaces when binder 20 is open 360 degrees. Middle cover portions 1542B and 1542C have reduced thickness relative to middle cover portions 1542A and 1542D to accommodate spine 53 when the binder 20 is open 360 degrees. Front cover 1044 has front cover portions 1044A and 1044B. Back cover 1440 has back cover portions 1440A and 1440B. The thickness of front cover portion 1044B and back cover portion 1440B is less than the thickness of front cover portion 1044A and back cover portion 1440A, respectively, so that a channel 65 is formed when the binder 20 is open 360 degrees as seen in FIG. 20C. Channel 65 accommodates ring-hole cover 164 that folds neatly via crease 382B into channel 65 as the binder 20 is opened 360 degrees. Ring-hole cover 164 includes middle cover portions 1542E–1542F and hides rings 46 and middle cover holes 74C–74D when the binder 20 is in its closed position as seen in FIG. 20B to give the binder 20 the aesthetic appearance and handling of a bound book. The binder 20 is similar to the binder 5 in that the thickness of the folded middle cover 1542 is substantially equal to the sum of the thickness of front cover 1044 and back cover 1440 as seen when the binder is open 360 degrees in FIG. 20C.

FIGS. 21A–21B

Figure 21A:
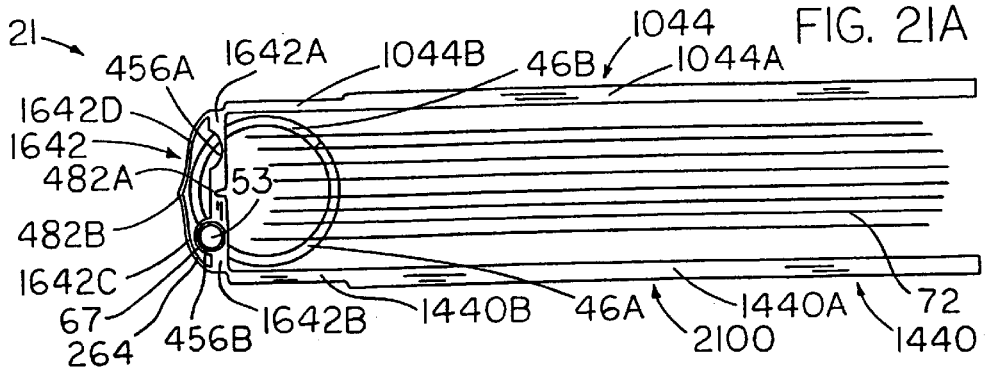
FIG. 21A is a bottom view of a twenty-first embodiment of the binder in the closed position which is similar to the binder 20 but where the skeleton is embedded in a middle cover conduit of a constant cross-sectional shape.
Figure 21B:
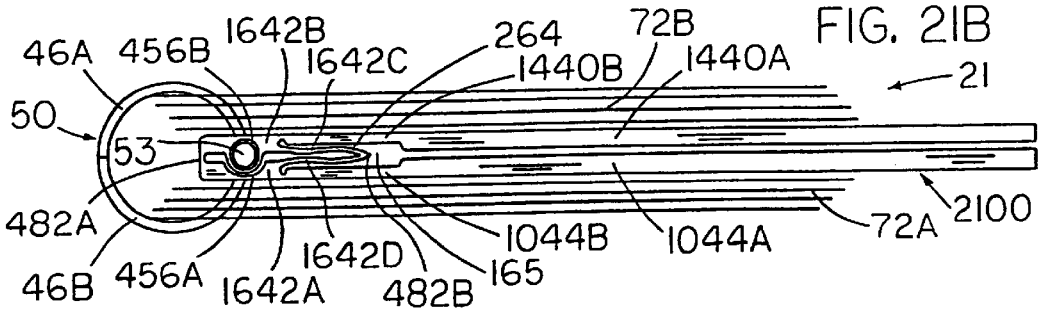
FIG. 21B is a bottom view of the binder of FIG. 21A with the front cover flipped 360 degrees open relative to the back cover.

FIGS. 21A–21B are bottom views of yet another preferred embodiment of a binder 21 of the present invention. The binder 21 comprises cover 2100 and skeleton 50. Cover 2100 includes front cover 1044, middle cover 1642 and back cover 1440. Middle cover 1642 has middle cover portions 1642A–1642D. Middle cover portion 1642B contains conduit 456B. Spine 53 of skeleton 50 is disposed within conduit 456B and creates middle cover lump 67 in middle cover portion 1642B. Middle cover portion 1642A contains conduit 456A which receives middle cover-lump 67 when the binder 21 is open 360 degrees as shown in FIG. 21B. Rings 46 are looped through middle covers 1642A–1642B of the binder 21 in a similar manner as rings 46 are looped through middle covers 1542A–1542B of the binder 20.

As the binder 21 is opened from its closed position in FIG. 21A to its 360 degree position in FIG. 21B, front cover 1044 and middle cover portion 1642A rotate about fold 482A until they abut back cover 1440 and middle cover 1642B, respectively, to minimize the footprint of the binder 21. Middle cover 1642A, middle cover 1642B, front cover 1044 and back cover 1440 form parallel planar surfaces when the binder 21 is open 360 degrees. Front cover 1044 has front cover portions 1044A and 1044B. Back cover 1440 has back cover portions 1440A and 1440B. The thickness of front cover portions 1044B and back cover portions 1440B is less than the thickness of front cover portions 1044A and back cover portions 1440A, respectively, so that a channel 165 is formed when the binder 21 is open 360 degrees as seen in FIG. 21B. Channel 165 accommodates ring-hole cover 264 that folds neatly via crease 482B into channel 165 as the binder 21 is opened 360 degrees. Ring-hole cover 264, having middle cover portions 1642C–1642D, gives the binder 21 the aesthetic appearance and handling of a bound book when the binder 21 is closed as seen in FIG. 21A. The binder 21 is similar to the binder 5 and the binder 20 in that the thickness of the folded middle cover 1642 is substantially equal to the sum of the thickness of front cover 1044 and back cover 1440 as seen when the binder 21 is open 360 degrees in FIG. 21B.

FIGS. 22A–22B

Figure 22A:
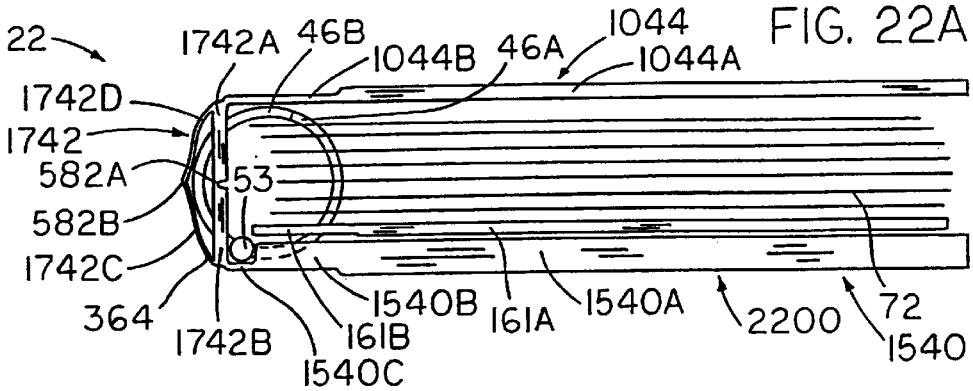
FIG. 22A is a bottom view of a twenty-second embodiment of the binder in a closed position which is similar to the binder 21, but where the skeleton is not embedded in any conduit of the cover so that the middle cover rides loose-leaf on the rings.
Figure 22B:
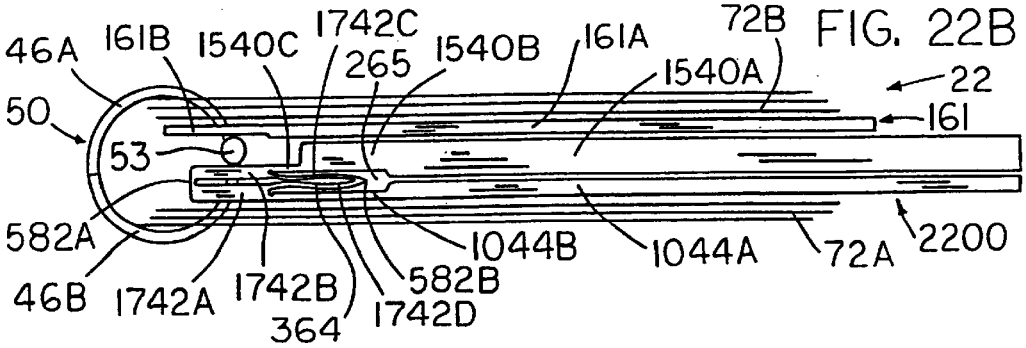
FIG. 22B is a bottom view of the binder of FIG. 22A with the front cover flipped 360 degrees open relative to the back cover.

FIGS. 22A–22B are bottom views of yet another preferred embodiment of a binder 22 of the present invention. The binder 22 comprises cover 2200 and skeleton 50. Cover 2200 includes front cover 1044, middle cover 1742 and back cover 1540. Middle cover 1742 includes middle cover portions 1742A–1742D. Rings 46 are looped through middle cover portions 1742A–1742B of the binder 22 in a similar manner as rings 46 are looped through middle cover portions 1542A–1542B of the binder 20. However, middle cover portions 1742A–1742B are releasably bound to rings 46 in the same manner as loose-leaves 72 are releasably bound to rings 46.

As the binder 22 is opened from its closed position in FIG. 22A to its 360 degree open position in FIG. 22B, front cover 1044 and middle cover portion 1742A rotate about fold 582A until they abut back cover 1540 and middle cover 1742B, respectively, to minimize the footprint of the binder 22. Middle cover portion 1742A, middle cover portion 1742B, front cover 1044, writing-support pad 161 and back cover 1540 form parallel planar surfaces when the binder 22 is open 360 degrees. Writing-support pad 161 has portions 161A–161B where 161B is of reduced thickness relative to 161A to hinder spine 53 from causing a lump in the writing surface. Front cover 1044 has front cover portions 1044A and 1044B. Back cover 1540 includes back cover portions 1540A–C. The thickness of back cover portion 1540C is reduced relative to back cover portion 1540B so as to accommodate spine 53 when the binder 22 is in the closed position. The thickness of front cover portion 1044B and back cover portion 1540B is less than the thickness of front cover portion 1044A and back cover portion 1540A, respectively, so that a channel 265 is formed when binder 22 is open 360 degrees as seen in FIG. 22B. Channel 265 accommodates ring-hole cover 364 that folds along crease 582B into channel 265 as the binder 22 is opened 360 degrees. Ring-hole cover 364 has middle cover portions 1742C–1742D and gives the binder 22 the aesthetic appearance and handling of a bound book when the binder 22 is closed as seen in FIG. 22A.

FIGS. 23A–23E

FIGS. 23A–23E are bottom views of yet another preferred embodiment of a binder 23 of the present invention. The binder 23 comprises skeleton 550, one or more staple-thin fasteners 68 and cover 2300. Cover 2300 includes front cover 1144, middle cover 1842 and back cover 1640. Middle cover 1842 has middle cover portions 1842A–1842C. Skeleton 550 includes spine 553 and rings 746.

Figure 23A:
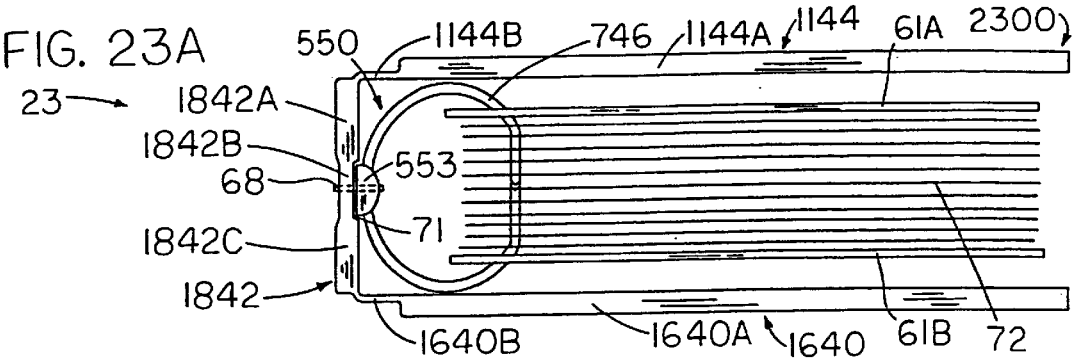
FIG. 23A is a bottom view of a twenty-third embodiment of the binder in a closed position having a flexible middle cover and a skeleton with a conventional arc-shaped spine which is firmly attached to the cover via a staple-thin rivet and is able to rotate via the flexibility of the middle cover.
Figure 23B:
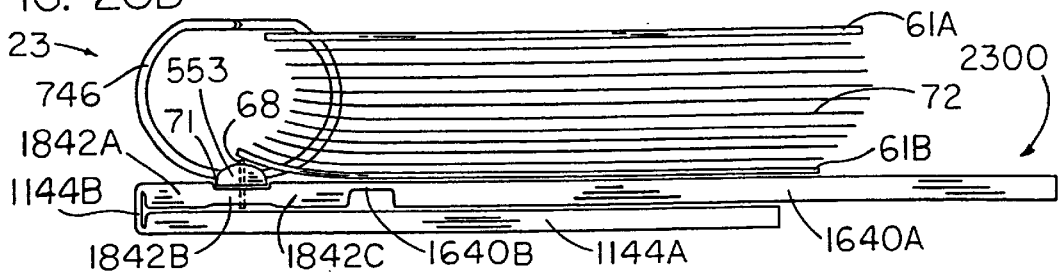
FIG. 23B is a bottom view of the binder of FIG. 23A with its front cover open 360 degrees and with all its loose-leaves resting above the back cover.
Figure 23C:
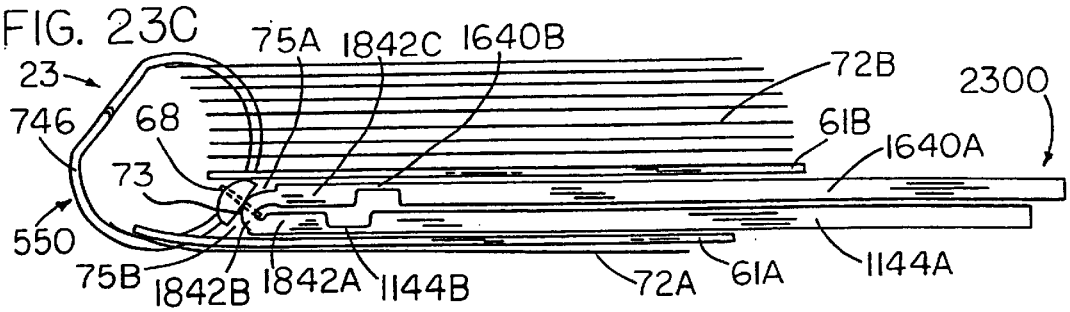
FIG. 23C is a bottom view of the binder of FIG. 23A, but with its front cover, a writing-support pad, and one forward loose-leaf flipped beneath the back cover and latter loose-leaves.
Figure 23D:
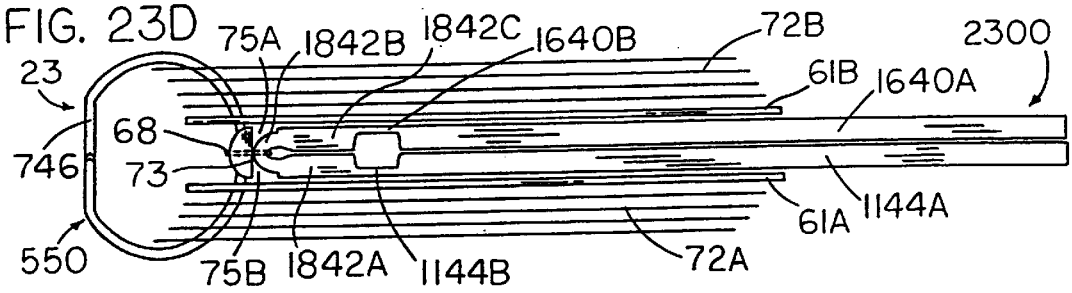
FIG. 23D is a bottom view of the binder of FIG. 23A, but with its front cover, a writing-support pad, and half the loose-leaves flipped beneath the back cover and remaining half of the loose-leaves.
Figure 23E:
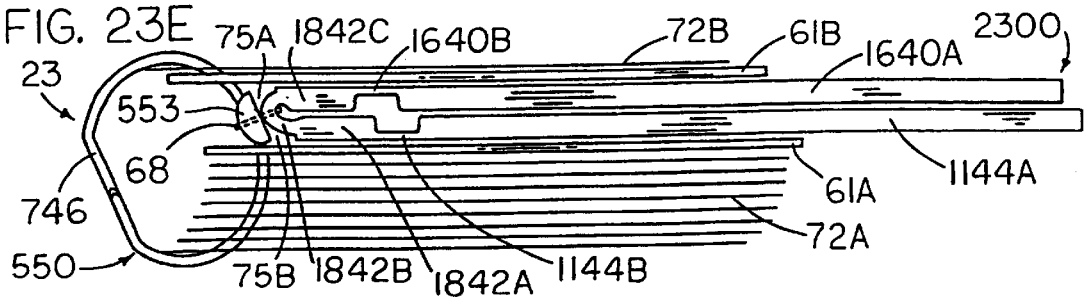
FIG. 23E is a bottom view of the binder of FIG. 23A, but with its front cover, a writing-support pad, and all but one forward loose-leaf flipped beneath the back cover and the one remaining latter loose-leaf.

Conventional spine 553 has an arc-shaped cross-section and has a switching element to simultaneously open and close rings 746. Skeleton 550 is fixed to middle cover portion 1842B via one or more staple-thin fasteners 68. Middle cover portion 1842B is of reduced thickness relative to middle cover portion 1842A and middle cover portion 1842C preferably creating recess 71 to contain spine 553. Recess 71 aids in providing a flat writing surface when the binder 23 is open 180 degrees by lowering spine 553 partially into the plane of front cover 1144 and back cover 1640. The reduced thickness of middle cover portion 1842B also facilitates its greater flexibility relative to middle cover portions 1842A and 1842C enabling it to have a small radius of curvature illustrated in FIGS. 23C–23E such that middle cover portion 1842A is able to lie flatly against middle cover portion 1842C. Furthermore, fastener 68 is purposefully staple-thin so as not to hinder the folding of middle cover 1842. The folding of middle cover 1842 creates a transient near-ring edge 73 in cover 2300. To facilitate the flipping of front cover 1144 and one or more forward loose-leaves 72A 360 degrees such that they lie parallel to back cover 1640 and latter loose-leaves 72B, skeleton 550 must be able to incrementally rotate in a stable and controlled manner relative to front cover 1144 and back cover 1640. Because skeleton 550 is fastened to middle cover portion 1842B, it cannot freely rotate relative to middle cover portion 1842B; but skeleton 550 rotates relative to front cover 1144 and back cover 1640 via the flexibility of middle cover portion 1842B. As illustrated in FIGS. 23C–23E, skeleton 550 is not strongly biased to a particular angular position when front cover 1144 is flipped 360 degree beneath back cover 1640 and can incrementally rotate as needed depending upon the number of forward loose-leaves 72A to be flipped beneath back cover 1640; back cover 1640 and middle cover portion 1842A slide against front cover 1144 and middle cover portion 1842B to facilitate the amount of necessary rotation of skeleton 550. Staple-thin fasteners 68 can be affixed loosely to allow freer rotation of skeleton 550 relative to middle cover portion 1842B. To provide a flat writing surface, writing-support pads 61A and 61B blanket crevices 75A–75B between spine 553 and middle cover portions 1842A and 1842C, respectively.

When cover 2300 is open 360 degrees, spine 553 is rotatably disposed on middle cover 1842 such that rings 746 of skeleton 550 can rotate about near-ring edge 73 of the flatly-folded cover 2300. Since spine 553 is riveted to cover 2300, it is not a pivot about which cover 2300 can rotate. However, when the binder 23 is flatly folded open 360 degrees, the flexibility and small radius of curvature of middle cover 1842 enable spine 553 to be substantially axially disposed relative to the rotation of rings 746 and the oppositely rotating front cover 1144 and back cover 1640. All points of front cover 1144, back cover 1640, and rings 746 rotate through substantially the same size angle about spine 553 as most of the flatly-folded cover 2300 rotates about spine 553. In this case, front cover 1144 and back cover 1640 share the same angular rotation about spine 553 even though front cover 1144 and back cover 1640 slide radially in opposite directions relative to spine 553.

Front cover 1144 comprises front cover portions 1144A–1144B and back cover 1640 comprises back cover portions 1640A–1640B. Front cover portion 1144B is of reduced thickness enabling the folding of front cover portion 1144A beneath middle cover 1842 and back cover 1640 as shown in FIG. 23B. Likewise, back cover portion 1640B is of reduced thickness enabling the folding of back cover portion 1640A beneath middle cover 1842 and front cover 1144.

The binder 23 is similar to the binder 5 in that the thickness of the folded middle cover 1842 is substantially equal to the sum of the thickness of front cover 1144 and back cover 1640 as seen when the binder is open 360 degrees in FIGS. 23C–23E. Moreover, the LSCPL of spine 553 is less than or equal to sum of the thickness of front cover 1144 and back cover 1640 which minimizes or eliminates any potential lump caused by spine 553 when it is positioned between forward loose-leaves 72A and latter loose-leaves 72B when the binder 23 is open 360 degrees. Also the major diameter of the rings 746 is much larger than the LSCPL dimension of spine 553. The many elements of the binder 23 described in detail above work in concert to enable front cover 1144 and forward loose-leaves 72A to lie flat and parallel to back cover 1640 and latter loose-leaves 72B when the binder 23 is opened 360 degrees.

As the binder 23 is opened from its closed position to its 360 degree position, front cover 1144 and middle cover portion 1842A rotate about middle cover portion 1842B until they abut back cover 1640 and middle cover portion 1842C, respectively, as shown in FIGS. 23C–23E. Middle cover portion 1842A, middle cover portion 1842C, front cover portion 1144A and back cover portion 1640A are preferably the same thickness to form parallel planar surfaces when the binder 23 is open 360 degrees.

Partially elliptical rings 746 have a major diameter that is greater than or equal to the sum of their cut-off minor diameter plus the LSCPL of spine 553. This enables the loose-leaf capacity of rings 746 when the binder 23 is open 360 degrees to be greater than or equal to the capacity of the binder 23 when it is open 180 degrees and is typically loaded.

FIGS. 24A–24C

Figure 24A:
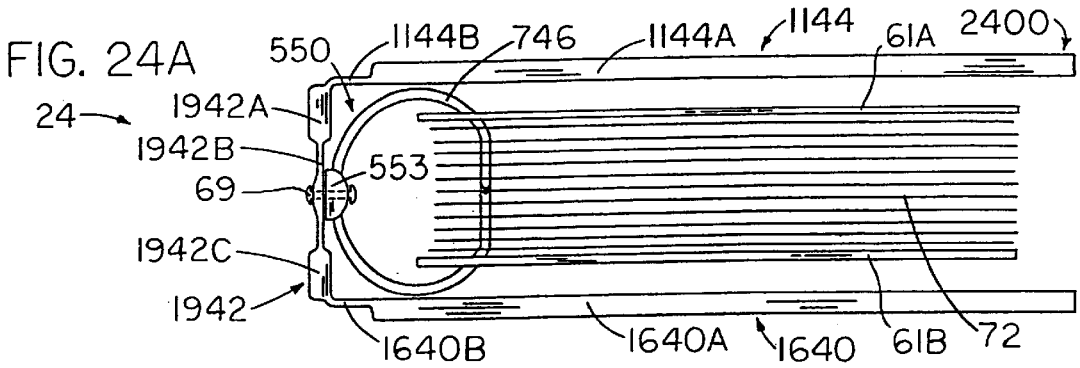
FIG. 24A is a bottom view of a twenty-fourth embodiment of the binder in the closed position which is similar to the binder 23 but with a thinner, more flexible middle cover and a conventional round rivet that attaches its skeleton to its middle cover.
Figure 24B:
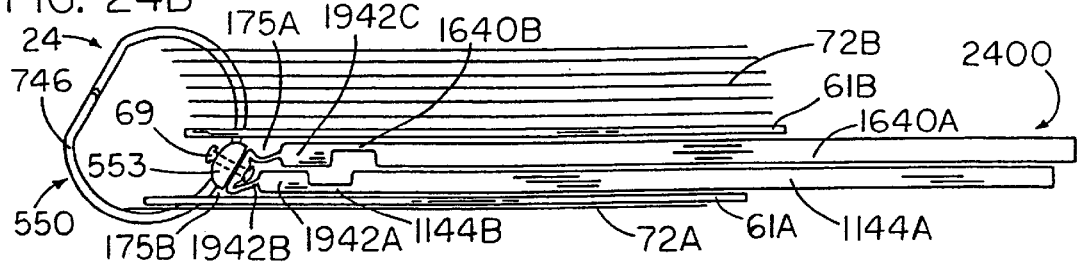
FIG. 24B is a bottom view of the binder of FIG. 24A, but with its front cover, a writing-support pad, and one forward loose-leaf flipped beneath the back cover and latter loose-leaves.
Figure 24C:
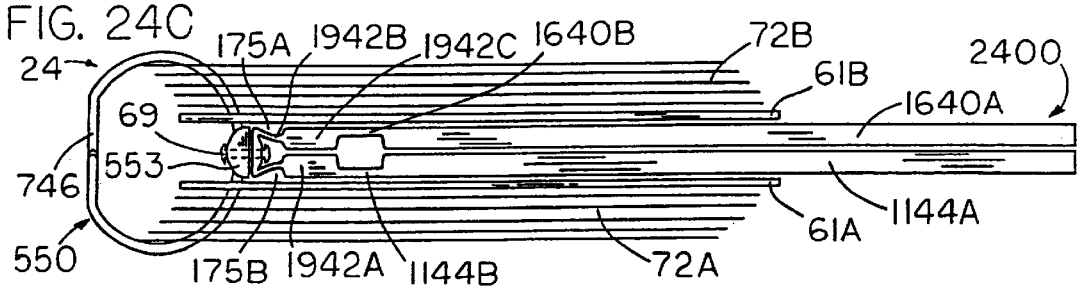
FIG. 24C is a bottom view of the binder of FIG. 24A, but with its front cover, a writing-support pad, and half the loose-leaves flipped beneath the back cover and remaining half of the loose-leaves.

FIGS. 24A–24C are bottom views of yet another preferred embodiment of a binder 24 of the present invention. The binder 24 comprises skeleton 550, one or more round rivets 69, and cover 2400. Cover 2400 includes front cover 1144, middle cover 1942, and back cover 1640. The binder 24 comprises the same skeleton 550, front cover 1144 and back cover 1640 as the binder 23 shown in FIGS. 23A–23E, but incorporates a different middle cover 1942 and round rivets 69 in place of middle cover 1842 and staple-thin fasteners 68 of the binder 23. Skeleton 550 is fixed to middle cover 1942 via round rivets 69. Middle cover 1942 includes middle cover portions 1942A–1942C. Like middle cover portion 1842B, middle cover portion 1942B is of reduced thickness relative to middle cover portions 1942A and 1942C. But middle cover portion 1942B of the binder 24 is longer and thinner than middle cover portion 1842B of the binder 23 which enables middle cover portion 1942B to accommodate round rivets 69 as well as staple-thin fasteners 68. Because middle cover portion 1942B is thin and flexible, middle cover portion 1942B prevents round rivets 69 from causing a lump between middle cover portions 1942A and 1942C by providing the extra room that round rivets 69 require relative to staple-thin fasteners 68. Middle cover portion 1942B is also shaped so as to deter the edges of round rivets 69 from cutting into and damaging middle cover 1942 during repeated usage of the binder 24. To provide a flat writing surface, writing-support pads 61A and 61B blanket crevices 175A–175B between spine 553 and middle cover portions 1942A and 1942C, respectively.

FIGS. 25A–25B

Figure 25A:
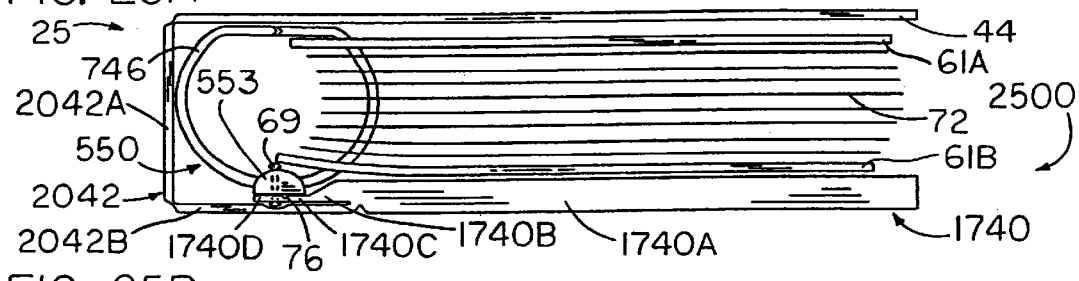
FIG. 25A is a bottom view of a twenty-fifth embodiment of the binder in the closed position which has the same skeleton as the binders 23 and 24, but whose skeleton rotates via a hinge joint in its back cover.
Figure 25B:
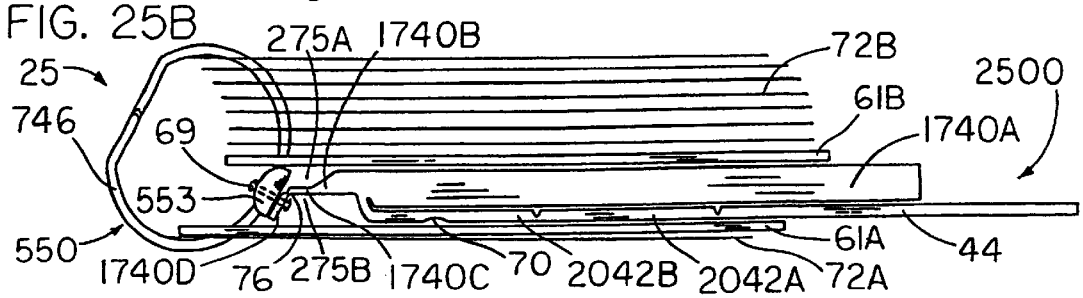
FIG. 25B is a bottom view of the binder of FIG. 25A, but with its front cover, a writing-support pad, and one forward loose-leaf flipped beneath the back cover and latter loose-leaves.

FIGS. 25A–25B are bottom views of yet another preferred embodiment of a binder 25 of the present invention. The binder 25 comprises skeleton 550, one or more round rivets 69, and cover 2500. Cover 2500 includes front cover 44, middle cover 2042, and back cover 1740. The binder 25 has the same skeleton 550 as the binder 23 shown in FIGS. 23A–23E. Back cover 1740 has portions 1740A–1740D. Skeleton 550 is fixed to back cover 1740 via round rivets 69. To facilitate the flipping of front cover 44 and one or more forward loose-leaves 72A 360 degrees such that they lie parallel to back cover 1740 and latter loose-leaves 72B, skeleton 550 must be able to incrementally rotate in a stable and controlled manner relative to front cover 44 and back cover 1740. Because skeleton 550 is riveted to back cover portion 1740D, it cannot freely rotate relative to back cover portion 1740D; but skeleton 550 rotates relative to front cover 44 and most of back cover 1740 via a hinge joint 76 between back cover portions 1740D and 1740C. Thus rings 746 are rotatable about a near-ring edge of back cover portion 1740C. Skeleton 550 is not strongly biased to a particular angular position when front cover 44 is flipped 360 degrees beneath back cover 1740, as illustrated in FIG. 25B. Skeleton 550 can incrementally rotate as needed depending upon the number of forward loose-leaves 72A to be flipped beneath back cover 1740. Spine 553 is substantially axially disposed relative to opposite rotations of large back cover portion 1740A and rings 46. Middle cover 2042 has middle cover portions 2042A–2042B and is attached to the wide side of back cover 1740 as divided by hinge joint 76 such that middle cover 2042 does not interfere with the rotation of skeleton 550 as front cover 44 and forward loose-leaves 72A are flipped beneath back cover portions 1740A–1740C.

Back covers portions 1740C–1740D are of reduced thickness relative to back cover portion 1740A which aids in providing a flat writing surface when the binder 25 is open 180 degrees by lowering spine 553 partially into the plane of back cover portion 1740A. Back cover portion 1740B is a small wedge-shaped segment connecting back cover portion 1740C with back cover portion 1740A. To provide a flat writing surface, writing-support pads 61A and 61B blanket crevices 275A–275B between spine 553 and back cover portion 1740A as illustrated in FIG. 25B. Rivet groove 70 accommodates round rivet 69 when the binder 25 is in its closed position.

The binder 25 is similar to other embodiments of the present invention in that the LSCPL of spine 553 is less than or equal to sum of the thickness of front cover 44 and back cover 1740A which minimizes or eliminates any potential lump caused by spine 553 when it is positioned between forward loose-leaves 72A and latter loose-leaves 72B when binder 25 is open 360 degrees. The binder 25 is also similar to the binder 1 in the manner that its middle cover 2042 is attached to its back cover 1740 to avoid interfering with the rotation of its skeleton 550.

FIGS. 26A–26C

Figures 26A, 26B, 26C:
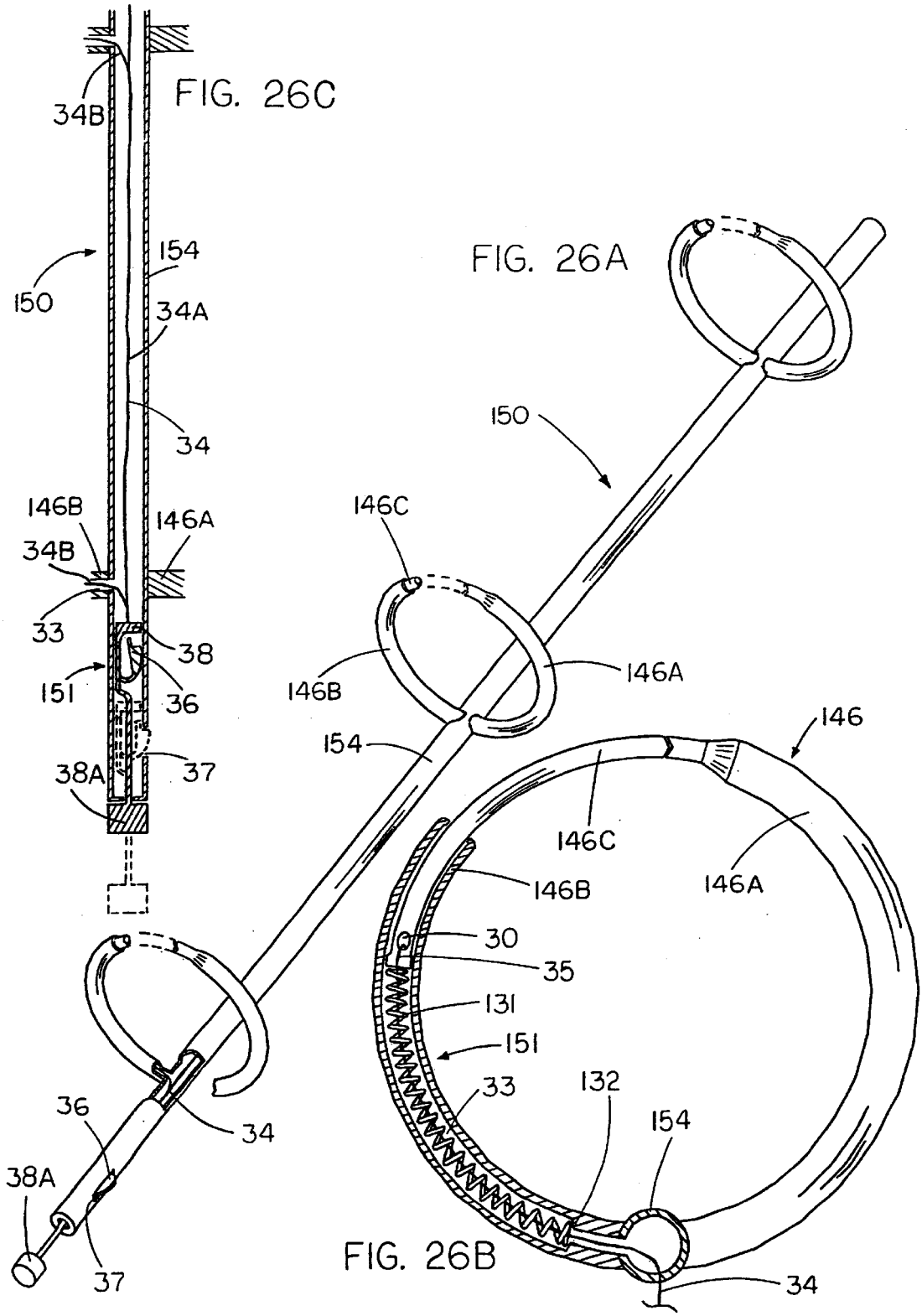
FIG. 26A is a perspective view of a second embodiment of a skeleton for use with the binder displaying the position of the skeleton actuator knob when the rings are in the open position.
FIG. 26B is a bottom, partial cross-sectional view of the skeleton of FIG. 26A displaying the construction of the synchronized switching element when the rings are in the closed position.
FIG. 26C is a front cross-sectional view of the skeleton of FIG. 26A displaying the construction of the synchronized switching element and actuator knob position when the rings are in the closed position.

FIGS. 26A–26C show perspective, bottom and front views, respectively, of another preferred embodiment of a skeleton 150 of the binder of the present invention with detailed sectional portions of the synchronized switching element 151 thereof. In this embodiment of a skeleton 150, cable 34 and tube 154 serve as the first and second connective elements, respectively, of synchronized switching element 151. Rings 146 have ring segments 146A–146C. Ring segments 146A and ring segments 146B are attached to tube 154 via weld, braze, or other appropriate means. Ring segments 146B are hollow and their conduits 33 are constricted at one end by ledges or stops 132. Conduit 33 houses spring 131 and receives part of ring segment 146C. Stop 132 supports one end of spring 131 which constantly exerts a pushing force on ring segments 146C both when skeleton 150 is open or closed.

In the closed position shown in FIG. 26B, ring segments 146C are pressed up against ring segments 146A. Ring segments 146C are capable, albeit constrained, to slide into ring segments 146B which have the same curvature as ring segments 146C. One end of ring segment 146C defines an opening or needle eye 30. Cable 34 comprises a trunk segment 34A with three branch segments 34B with each branch segment 34B terminating with a loop 35. Each conduit 33, spring 131, and stop 132 of the three ring segments 146B of skeleton 150 are threaded by one of the branch segments 34B of cable 34. Each of ring segments 146C is attached to cable 34 via a chain link between its needle eye 30 and a corresponding loop 35.

FIG. 26C shows the trunk-end of cable 34 attaches to pull-lock 38 which has knob 38A. Pull-lock 38 is also attached to spring 36. Spring 36 is extended to its lock position through slot 37 when skeleton 150 is locked open as seen in FIG. 26A and as shown in broken lines of FIG. 26C. FIGS. 26A–26C show rings 146 to be circular. However, other ring shapes are possible as long as portions of ring segments 146B and 146C have the same curvature to enable retraction of ring segment 146C into ring segment 146B.

To open skeleton 150, knob 38 A of pull-lock 38 is pulled away from tube 154 against the resistance of springs 131 until spring 36 spring locks into slot 37. Meanwhile, pull-lock 38 pulls cable 34 which simultaneously retracts the three ring segments 146C into the three ring segments 146B to lock open all three rings 146.

To close skeleton 150, spring 36 is pressed in to release cable 34 which is dragged to its closed position by springs 131 which also extend the ring segments 146C out of the ring segments 146B until they hit up against the ring segments 146A. Rings 146 stay closed because of the compression loading of springs 131.

FIGS. 27A–27B

Figure 27A:
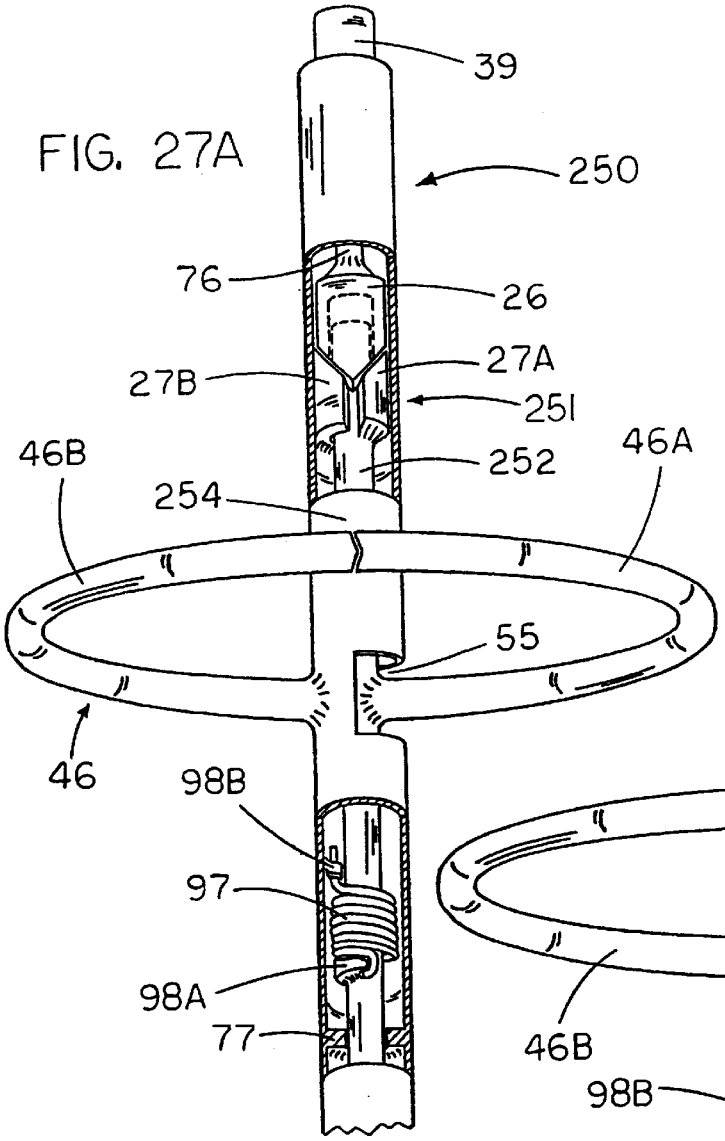
FIG. 27A is a perspective view of a third embodiment of a skeleton for use with the binder having sectional portions displaying the construction of the synchronized switching element when the rings are in the closed position.
Figure 27B:
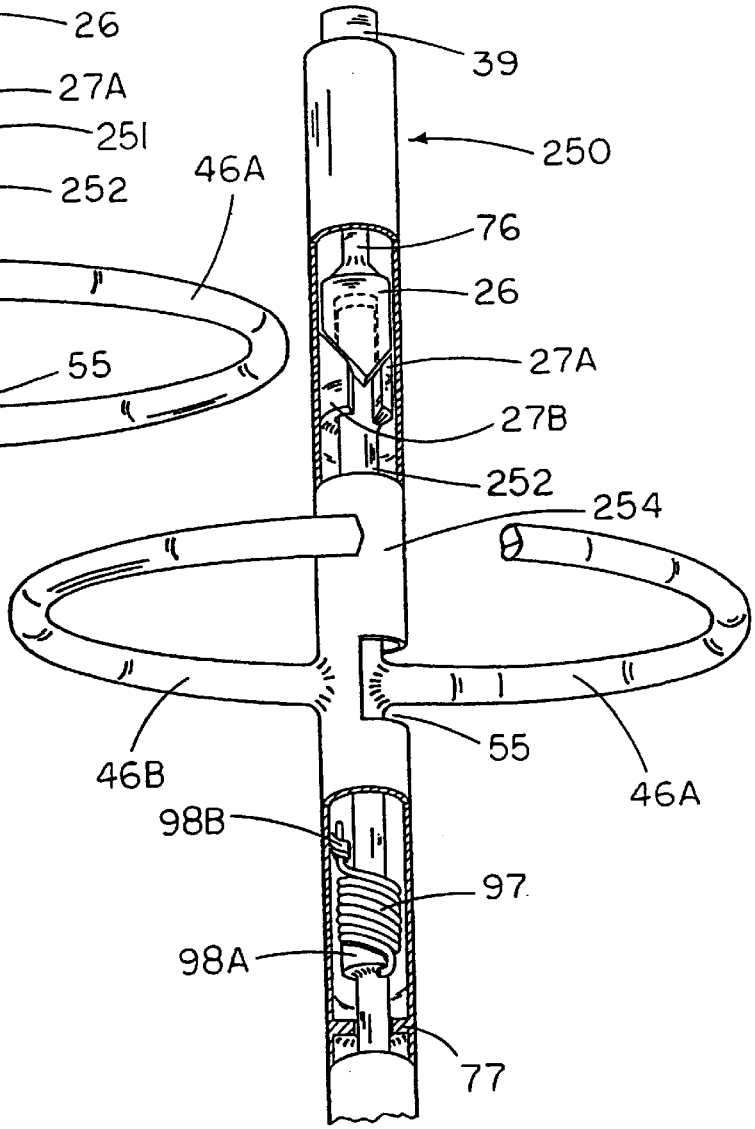
FIG. 27B is a perspective view of the skeleton of FIG. 27A with sectional portions displaying the construction of the synchronized switching element when the rings are in the open position.

FIGS. 27A and 27B show perspective views of a further preferred embodiment of a skeleton 250 of the binder of the present invention, with detailed sectional portions showing the synchronized switching element 251 of skeleton 250. Ring segments 46A are attached to rod 252 via weld, braze or other appropriate means. Similarly, ring segments 46B are attached to tube 254. When rod 252 is assembled within tube 254, the spaced ring segments 46A protrude through similarly spaced slots 55 of tube 254. Tube 254 rotates about rod 252 through a limited angle to open and close ring segments 46A relative to ring segments 46B. Cylindrical flanges 77 maintain the longitudinal axis of rod 252 coincident with the longitudinal axis of tube 254.

Synchronized switching element 251 includes spring 97 which is torsionally loaded when skeleton 250 is either open or closed and which is always resisting the opening of ring segments 46A relative to ring segments 46B. Catch 98A which is attached to, or integrally formed as a part of, rod 252 constrains one arm of torsion spring 97, while catch 98B which is attached to, or integrally formed as a part of, tube 254 constrains the other arm of torsion spring 97. Ledge 27A extends from rod 252 while ledge 27B extends from tube 254. Both ledge 27A and ledge 27B are in contact with wedge 26 which is able to longitudinally slide along, as well as rotate around, the rod 252. Wedge 26 is kept in contact with ledge 27A and ledge 27B via push rod 76 and torsion spring 97. Push rod 76 and push button 39 are on opposite ends of a two-state mechanical switch common to ball-point pens for extending and retracting the ball-point. In ball-point pens, this two-state mechanical switch depends upon the constant resistance of a compression spring; in skeleton 250, the constant resistance is supplied by torsion spring 97 via linkages (rod 252 and ledges 27A and 27B) to wedge 26.

When push rod 76 is in the retracted position shown in FIG. 27A, push button 39 is up and the rings are closed. When push button 39 is depressed or clicked down, push rod 76 is pushed and locked into its extended position. As push rod 76 is extended, it pushes on wedge 26 which angularly separates ledge 27A from ledge 27B which in turn forces rod 252 to rotate relative to tube 254 which causes ring segments 46A to open relative to ring segments 46B. Since push rod 76 is locked in place, ring segments 46A remained locked open relative to ring segments 46B as shown in FIG. 27B. When push button 39 is depressed a second time, it unlocks push rod 76 from its extended position allowing torsion spring 97 to act upon rod 252 and tube 254 to close ring segments 46A and ring segments 46B as well as ledge 27A and ledge 27B as shown in FIG. 27A. As ledge 27A and ledge 27B close, they force wedge 26 and push rod 76 to their closed and retracted positions, respectively, and push rod 76 forces push button 39 to its original up position. Although FIGS. 27A and 27B show some components of synchronized switching element 251 to be disposed on one end of skeleton 250, corresponding mirror-image components of the synchronized switching element 251 may be disposed on the opposite end of skeleton 250 to provide more balanced operation.

FIGS. 28A–28B

Figure 28A:
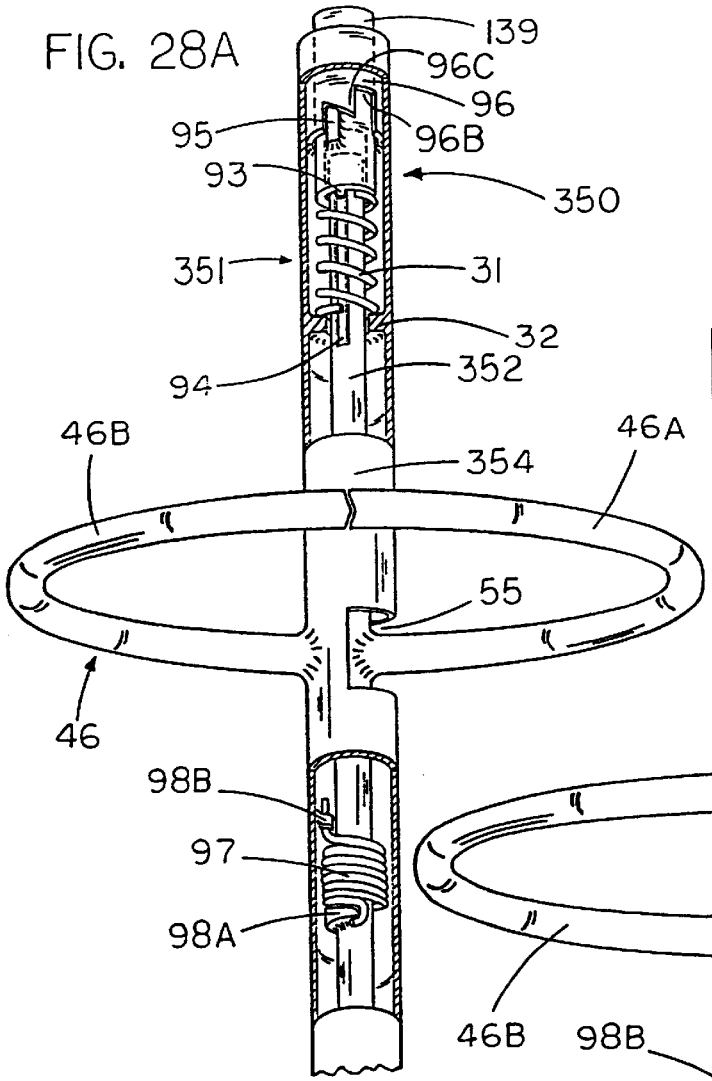
FIG. 28A is a perspective view of a fourth embodiment of a skeleton for use with the binder having sectional portions displaying the construction of the synchronized switching element when the rings are in the closed position.
Figure 28B:
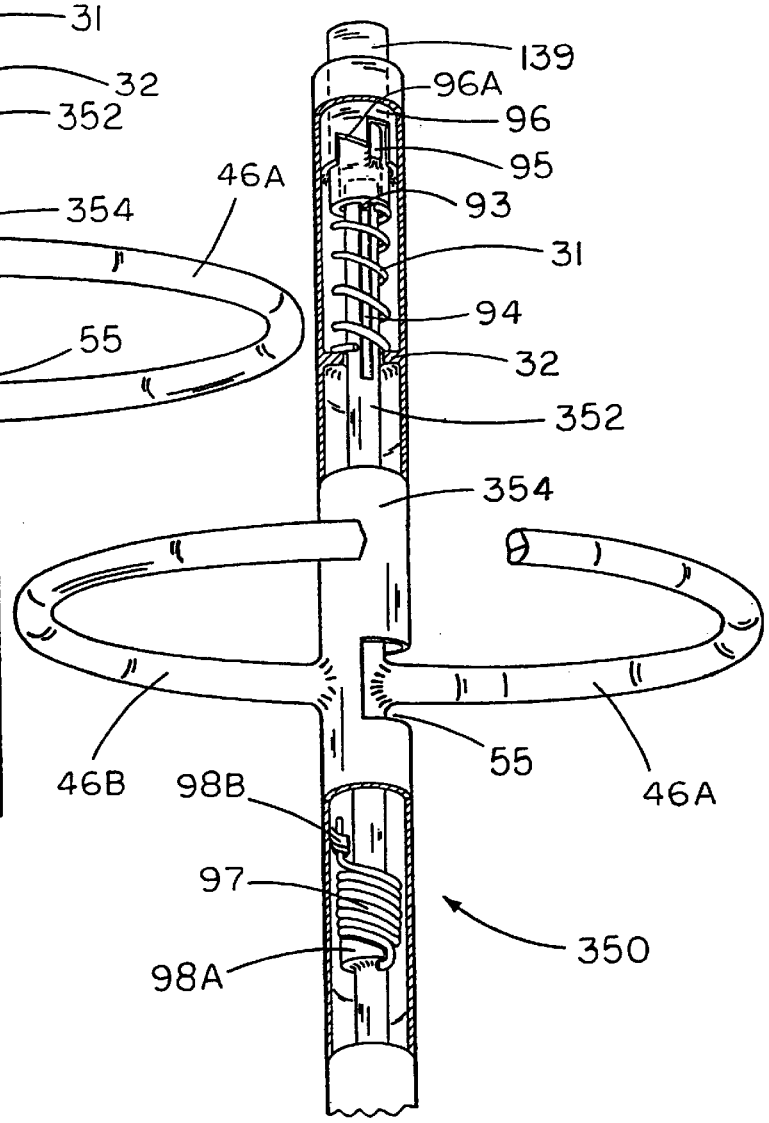
FIG. 28B is a perspective view of the skeleton of FIG. 28A with sectional portions displaying the construction of the synchronized switching element when the rings are in the open position.

FIGS. 28A and 28B show perspective views of yet another preferred embodiment of skeleton 350 of the binder of the present invention, with detailed sectional portions showing the synchronized switching element 351 of skeleton 350. Ring segments 46A are attached to rod 352 via weld, braze or other appropriate means. Similarly, ring segments 46B are attached to tube 354. When rod 352 is assembled within tube 354, the spaced ring segments 46 A protrude through similarly spaced slots 55 of tube 354. Tube 354 rotates about rod 352 through a limited angle to open and close ring segments 46A relative to ring segments 46B. Synchronized switching element 351 includes spring 97 which is torsionally loaded when skeleton 350 is either open or closed and which is always resisting the opening of ring segments 46A relative to ring segments 46B. Catch 98A which is attached to, or integrally formed with, rod 352 constrains one arm of torsion spring 97 while catch 98B which is attached to, or integral with, tube 354 constrains the other arm of torsion spring 97. Stop 32 protrudes from the inner wall of tube 354. Spring 31 which loosely spirals around rod 352 is compressed between stop 32 and push button 139. Spring 31 always has some amount of compression loading, albeit less when skeleton 350 is in the open state. Cylindrical, hollow push button 139 can slide longitudinally along rod 352 a limited distance like a sleeve on a rod. Tooth 93, which protrudes from the inner wall of push button 139 into groove 94 of rod 352, constrains push button 139 to rotate in sync with rod 352. Pawl 95 protrudes from the outer wall of push button 139 and slides along the limited path of ledge 96. Pawl 95 constrains to the longitudinal and rotational motion of push button 139. Ledge 96 protrudes from the inner wall of tube 354. Stop 32 also acts as a flange to maintain the longitudinal axis of rod 352 coincident with the longitudinal axis of tube 354.

To open skeleton 350, ring segments 46A and ring segments 46B are pulled apart. This action causes rod 352 to rotate relative to tube 354 and is resisted by torsion spring 97. As rod 352 rotates relative to tube 354, push button 139 is constrained to rotate in sync because of its tooth 93 within groove 94, but push button 139 is also pushed longitudinally towards rod 352 by a spiral section of ledge 96 that acts on pawl 95. The movement of push button 139 towards rod 352 causes the compression of spring 31 between push button 139 and stop 32. As rod 352 forces pawl 95 to rotate, pawl 95 is forced out of slot 96 A, slides over tooth 96C of ledge 96 and is forced into slot 96B by spring 31 thereby locking push button 139 in its extended state which corresponds to the open position of skeleton 350 as shown in FIG. 28B. When pawl 95 is disposed in slot 96B, the user can release the rings 46 because pawl 95 is obstructed from rotating back by the tooth 96C of ledge 96 and thus pawl 95 is able to resist the torsional closing force of torsion spring 97.

To close skeleton 350, push button 139 is pressed towards rod 352 against the resistance of spring 31. This action causes pawl 95 to move out of slot 96B and slide over tooth 96C of ledge 96 where the pawl 95 is then forced into slot 96A by spring 31 which allows torsion spring 97 to act to close the rings 46 of skeleton 350. Torsion spring 97 twists catch 98A relative to catch 98B causing rod 352 to rotate relative to tube 354 until ring segments 46A are closed against ring segments 46B. Although, FIGS. 28A and 28B show some components of synchronized switching element 351 to be disposed on one end of skeleton 350, corresponding mirror-image components of synchronized switching element 351 may be disposed on the opposite end of skeleton 350 to provide more stable operation.

Skeleton embodiments 150, 250 and 350 can be used in place of skeleton embodiment 50 in each and every of the preferred embodiments that incorporate skeleton 50 of the present invention via a small modification to the covers to allow access to the actuators: knob 38A, button 39 and button 139. This modification is simply a hole in the top and bottom edges of the covers of the respective embodiments of the binders of the present invention.

FIGS. 29A–29C

FIGS. 29A–29B show perspective and side views, respectively, of a further preferred embodiment of a skeleton 450 of the binder of the present invention. FIG. 29C shows a side cross-sectional view of the rod 452 of skeleton 450. Skeleton 450 comprises three rings 246 and rod 452. FIG. 29C shows that rings 246 comprise ring segments 246A and ring segments 246B the ends of which define tabs 47 and slots 48, respectively. Also, nubs 49A and nubs 49B protrude from ring segments 246A and ring segments 246B, respectively. Ring segments 246A have a small hollow free end into which tabs 47 can be inserted. Skeleton 450 is assembled by inserting ring segments 246A through holes 57 defined by skeleton 450 and sliding the rings 246 so that only nubs 49A and not nubs 49B pass through light-bulb shaped hole 57. Then each ring 246 is rotated about the portion of ring 246 disposed within hole 57 to stand rings 246 upright relative to rod 452 as shown in FIG. 29A.

Each ring 246 is opened or closed individually. To open ring 246, tab 47 is pushed down relative to slot 48 and pulled out of the hollow tip of ring segment 246A to unhitch tabs 47 from slots 48. The body of ring 246 acts like a spring which is free of tension or compression in its open position as shown in FIG. 29B. To close rings 246, force is exerted to insert tabs 47 of ring segments 246B into slots 48 of ring segments 246A until the tabs 47 are hitched in slots 48 and locked therein by the spring loading of rings 246 that exists when rings 246 are in the closed position. Since the front covers of many of the preferred embodiments of the binders of the present invention often rests on the rings of the skeleton, the rotation of the tops of rings 246 towards skeleton 450 can help minimize binder thickness when the binder is closed.

FIGS. 30A–30F

FIG. 30A is the bottom view of another preferred embodiment of a ring component 346 of the present invention and FIGS. 30B–30F are bottom views of binder 1, shown in FIGS. 1A–1L, with its skeleton 50 incorporating rings 346 in placed of rings 46. FIGS. 30B–30F show rings 346 in different positions as varying numbers of forward loose-leaves 72A are flipped beneath back cover 40.

Ring 346 comprises ring segments 346A–346B and the portion of spine 53 intersected by ring segments 346A–346B. Ring segment 346A has ring segments 346P–346Q and ring segment 346B has ring segments 346R–346S. The shape of ring 346 is a cut-off ellipse that is derived from an ellipse and chord P1Q1 parallel to its major axis. Rings segments 346Q and 346S coincide with chord P1Q1. The ellipse's minor axis bisects chord P1Q1 on one side of the major axis and bisects spine 53 on the opposite side of the major axis.

Figure 30B:
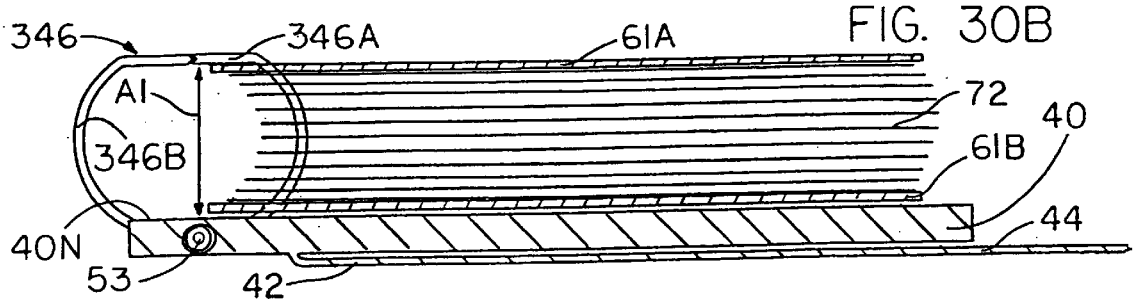
FIGS. 30B–30F are bottom views of the binder of FIG. 1 with its rings replaced with rings of FIG. 30A.
Figure 30C:
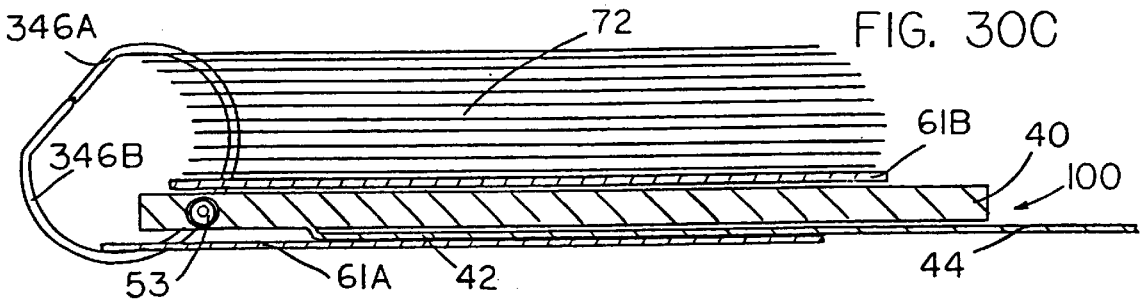
Figure 30D:
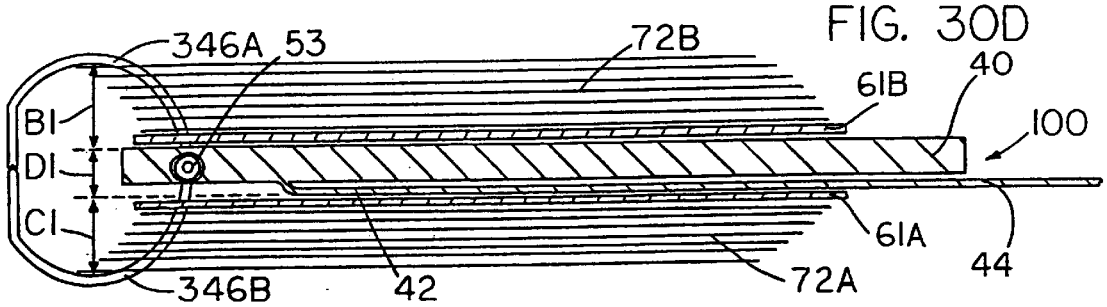
Figure 30E:
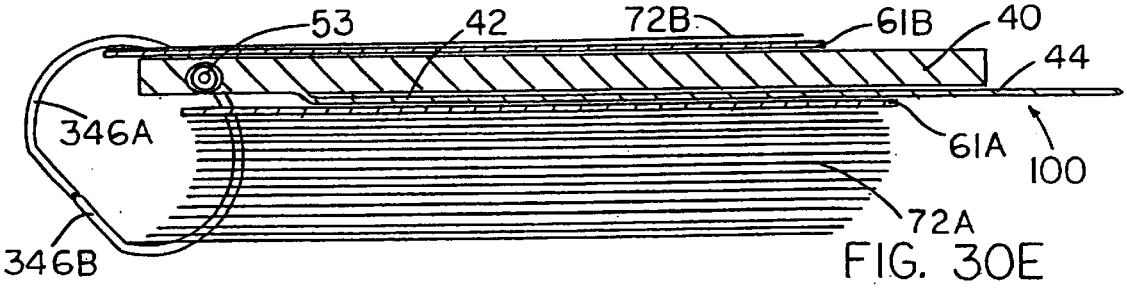
Figure 30F:
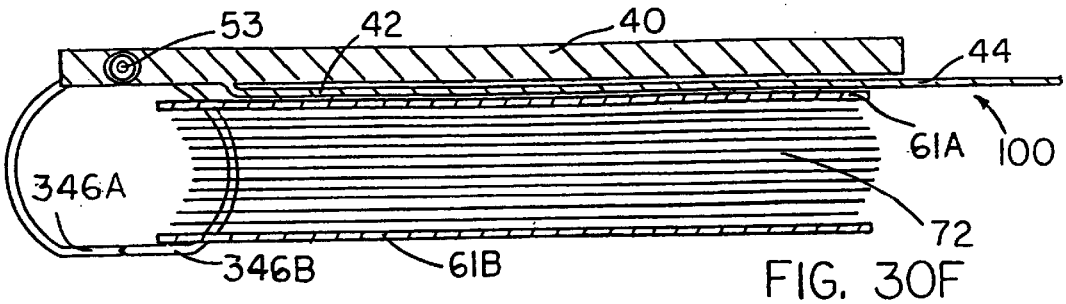
Figure 31B:
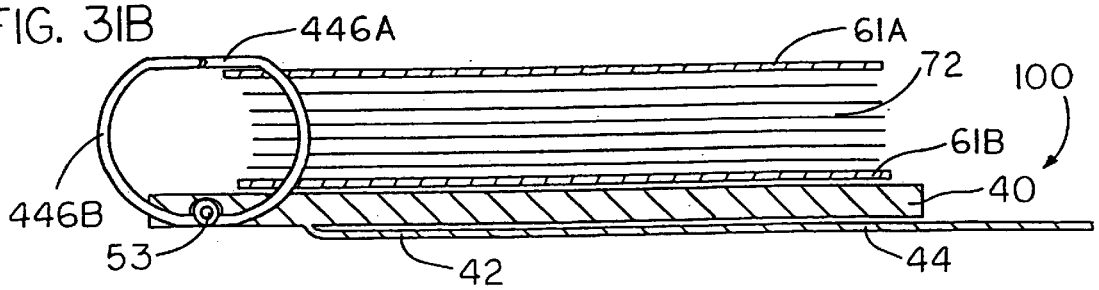
FIGS. 31B–31F are bottom views of the binder of FIG. 1 with its rings replaced with rings of FIG. 31A.
Figure 31C:
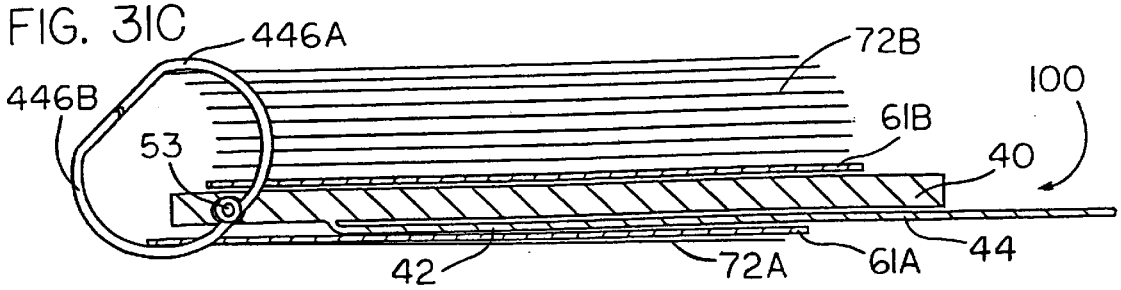
Figure 31D:
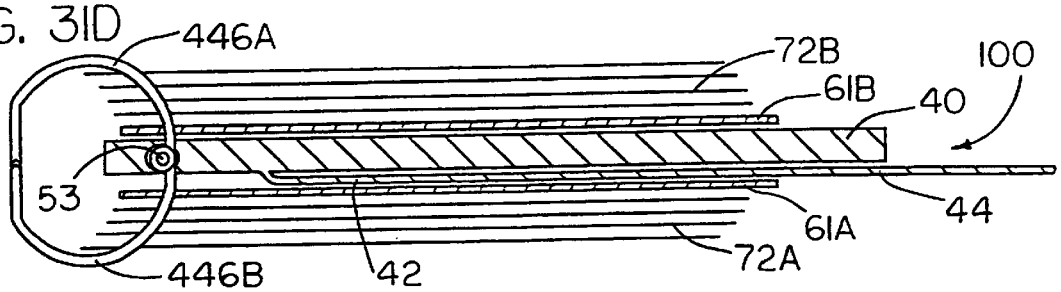
Figure 31E:
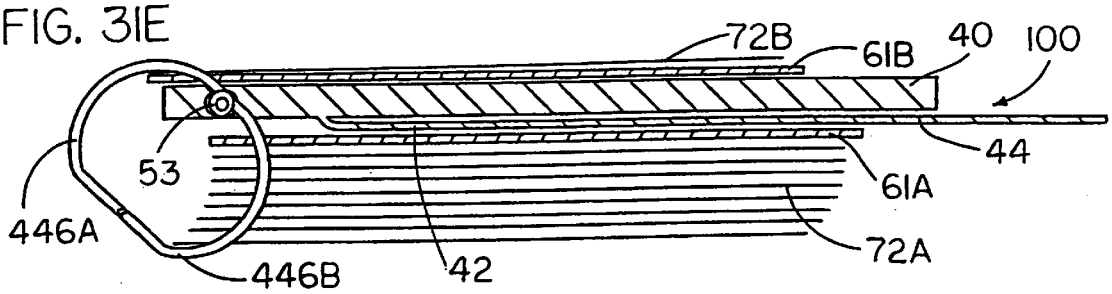
Figure 31F:
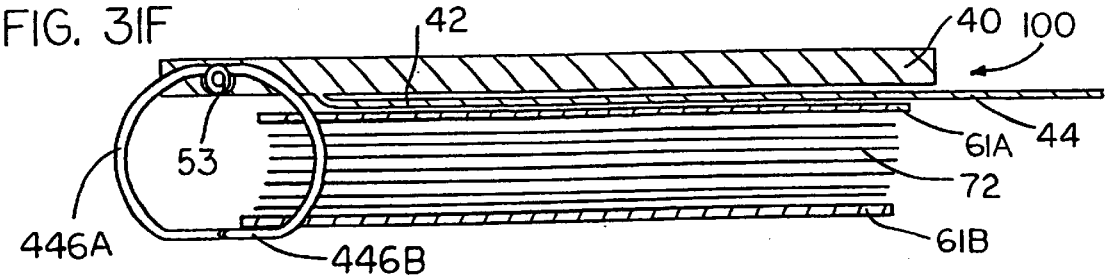

Distance A1 is the upright-ring loose-leaf capacity measured from the interior surface 40N of back cover 40 to point Q1 when rings 346 are upright as shown in FIGS. 30A and 30B. When rings 346 are upright, ring segments 346Q and 346S are parallel to back cover 40. Distance E1 is the length of the major axis of the interior cut-off ellipse of ring 346 as shown in FIG. 30A. FIGS. 30C–30F show that back cover 40 and front cover 44 occupy additional interior ring space when forward loose-leaves 72A are flipped 360 degrees beneath back cover 40 that they do not occupy when rings 346 are upright as in FIG. 30B. The space occupied by back cover 40 and front cover 44 is measured by distance D1 as shown in FIG. 30D. Distance (B1+C1) measures the loose-leaf capacity of the rings when spine 53 is rotated 90 degrees as shown in FIG. 30D.

Cover 100 of FIGS. 30B–30F is preferably loaded and unloaded with loose-leaves when cover 100 is open 180 degrees and rings 346 are substantially upright. Therefore, the height of the upright rings 346 determines the capacity of rings 346 as users will fill the rings up to the under surface of the ring segments 346Q and 346S. For convenient operation of the binder, it is preferred that the upright-ring loose-leaf capacity be less than or equal to the loose-leaf capacity when the spine 53 is rotated to other positions shown in FIGS. 30C–30F. To enable rings 346 to have less or the same loose-leaf capacity when rings 346 are upright as when spine 53 and rings 346 are rotated 90 degrees from upright, the following equation must be satisfied:

$$A1=<B1+C1 \qquad \text{equation 1}$$

From FIG. 30D, major axis distance E1 equals the sum of distances B1, C1, and D1.

$$E1=B1+C1+D1 \qquad \text{equation 2}$$

Substituting equation 2 into equation 1 and rearranging terms yields:

$$E1>=A1+D1$$

For a given thickness of back and front cover as measured by distance D1 and for a given upright-ring loose-leaf capacity A1, the length of the major axis E1 of ring 346 can be calculated so that the loose-leaf capacity of rings 346 in the upright position is greater than or equal to the loose-leaf capacity of rings 346 when spine 53 and loose-leaf ring 346 are rotated 90 degrees from upright. More stringently, chord P1Q1 can cut the elliptical curve of rings 346 at a position such that the upright-ring loose-leaf capacity is less than or equal to the loose-leaf capacity of rings 346 for the range of spine rotation illustrated in FIGS. 30B–30F. The preferred length of E1 is its maximum value that satisfies this more stringent constraint.

Completely elliptical rings immediately decrease in loose-leaf capacity as spine 53 begins to rotate and ring prongs enter the plane of the back cover 40 of binder 1. Cut-off elliptical rings 346 do not share this problem because point Q1 which determines upright-ring capacity of rings 346 extends farther from back cover 40 as spine 53 rotates counterclockwise from upright until point Q1 is directly over spine 53.

FIGS. 31A–31F

FIG. 31A is the bottom view of another preferred embodiment of a ring component 446 of the present invention and FIGS. 31B–31F are bottom views of binder 1, shown in FIGS. 1A–1L, with its skeleton 50 incorporating rings 446 in placed of rings 46. FIGS. 31B–31F show rings 446 in different positions as varying numbers of forward loose-leaves 72A are flipped beneath back cover 40. Ring 446 comprises ring segments 446A–446B and the portion of spine 53 intersected by ring segments 446A–446B. Ring segment 446A comprises ring segments 446P–446R and ring segment 446B comprises ring segments 446S–446U. The shape of ring 446 is a cut-off ellipse similar to ring 346 with additional chord ring segments 446P and 446S parallel to the major axis of the elliptical curve of rings 446. When binder 1 of FIGS. 31A–31F is open 180 degrees, middle cover 42 presses against the flat ring segments 446P and 446S to urge rings 446 to stand upright.

FIGS. 32A–32F

FIG. 32A is the bottom view of another preferred embodiment of a ring component 546 of the present invention and FIGS. 32B–32F are bottom views of binder 1, shown in FIGS. 1A–1L, with its skeleton 50 incorporating rings 546 in placed of rings 46. FIGS. 32B–32F show rings 546 in different positions as varying numbers of forward loose-leaves 72A are flipped beneath back cover 40. Ring 546 comprises ring segments 546A–546B and the portion of spine 53 intersected by ring segments 546A–546B.

Figure 32B:
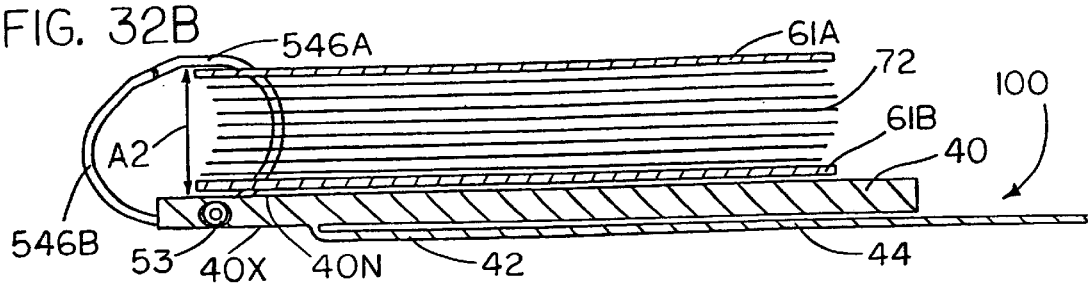
FIGS. 32B–32F are bottom views of the binder of FIG. 1 with its rings replaced with rings of FIG. 32A; FIGS.
Figure 32C:
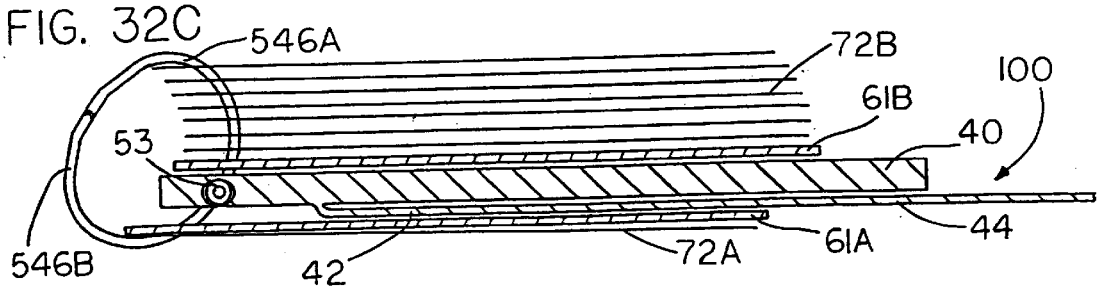
Figure 32D:
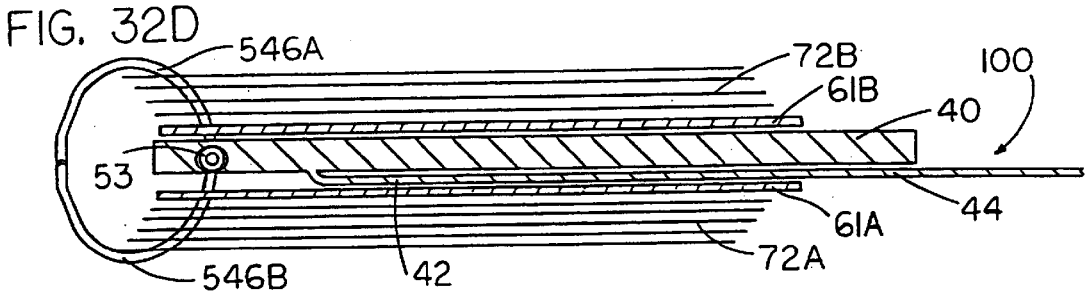
Figure 32E:
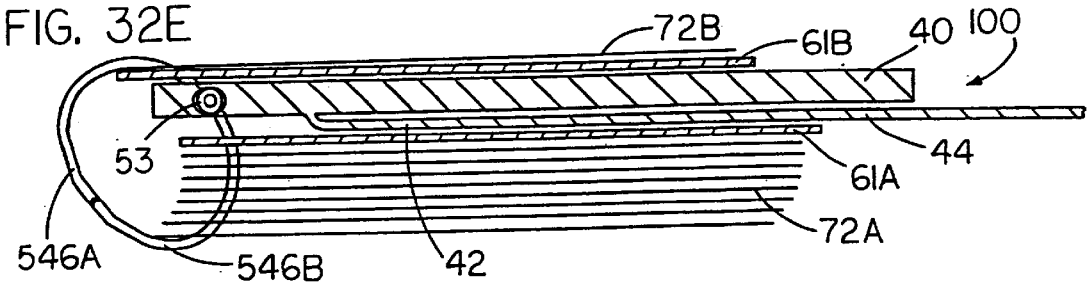
Figure 32F:
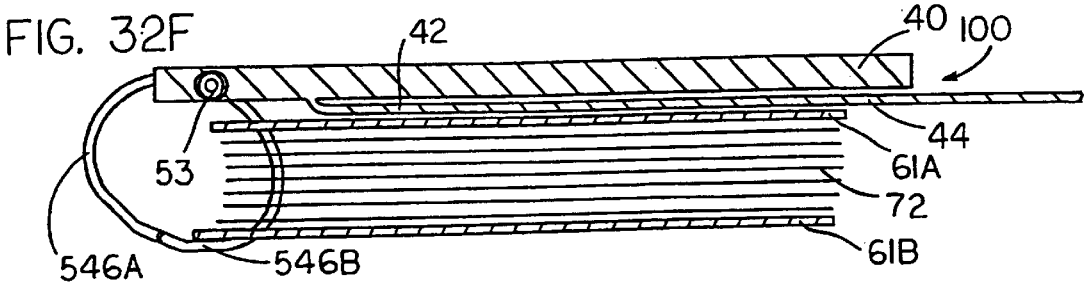

Ring segment 546A has ring segments 546P–546R and ring segment 546B has ring segments 546S–546U. Mostly elliptical ring segments 546P and 546S are joined to straight ring segments 546Q and 546T, respectively. Straight ring segments 546Q and 546T are bridged by straight ring segments 546R and 546U to complete rings 546. Straight ring segments 546Q, 546R, 546U, and 546T constitute a multiple-line perimeter segment. The two angles that straight ring segments 546Q and 546T make with the major axis of the partial ellipse of ring 546 are not arbitrary. Straight ring segments 546Q and 546T are made intentionally parallel to lines X1 and Y1, respectively. Line X1 is a tangent line to spine 53 and ring segment 546S and line Y1 is a tangent line to spine 53 and ring segment 546P. When rings 546 are in their upright position, line X1 is in the plane of the exterior surface 40X of back cover 40 and ring segment 546Q is parallel as shown in FIG. 32B. Distance A2 measured from the interior surface 40N of back cover 40 to the under surface of rings segment 546Q is the upright-ring loose-leaf capacity of rings 546. Similar to rings 346, rings 546 are wider than tall such that the upright-ring loose-leaf capacity of rings 546 is less than or equal to the loose-leaf capacity of rings 546 for the range of spine rotation illustrated in FIGS. 32B–32F. Rings 546 rotate through a smaller angular range in FIGS. 32B–32F than rings 346 rotate in FIGS. 30B–30F. Cover 100 of FIGS. 32B–32F is preferably loaded and unloaded with loose-leaves when cover 100 is open 180 degrees and rings 546 are substantially upright.

FIGS. 33A–33F

FIG. 33A is the bottom view of another preferred embodiment of a ring component 646 of the present invention and FIGS. 33B–33F are bottom views of binder 1, shown in FIGS. 1A–1L, with its skeleton 50 incorporating rings 646 in placed of rings 46. FIGS. 33B–33F show rings 646 in different positions as varying numbers of forward loose-leaves 72A are flipped beneath back cover 40. Rings 646 are very similar to rings 546 but have less straight ring segments and are partially circular.

Figure 33B:
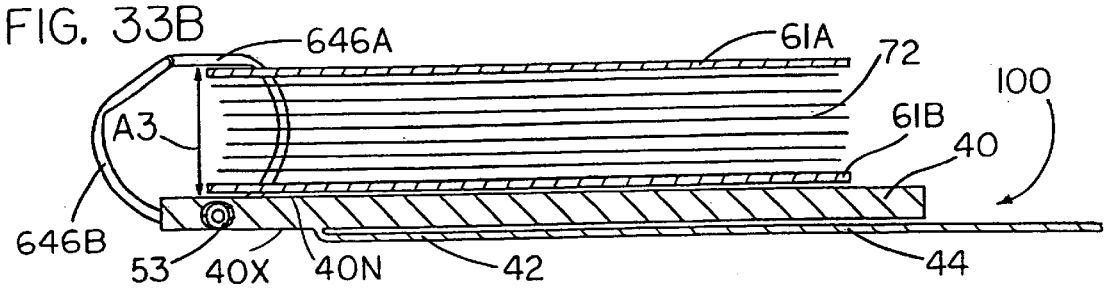
Figure 33C:
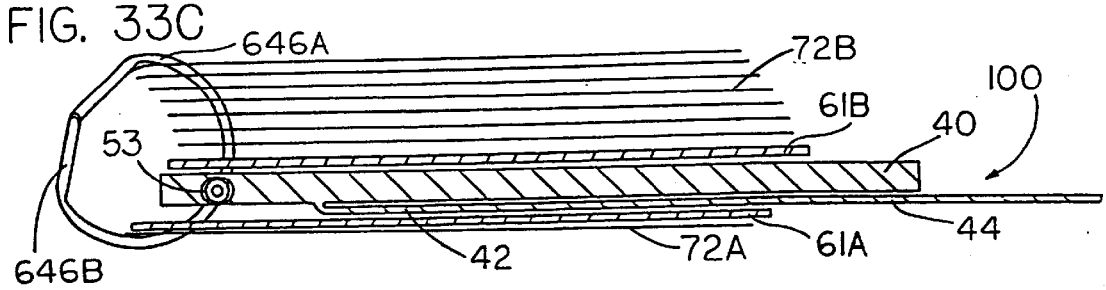
Figure 33D:
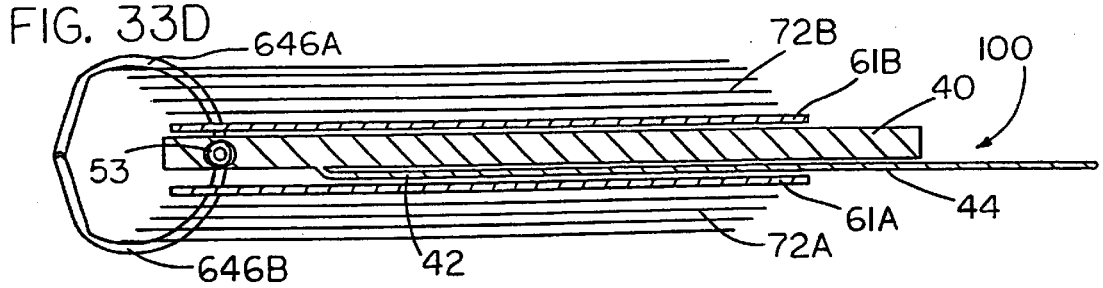
Figure 33E:
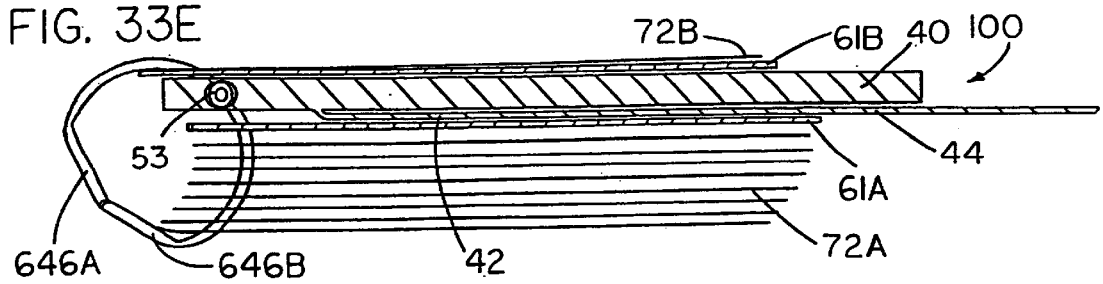
Figure 33F:
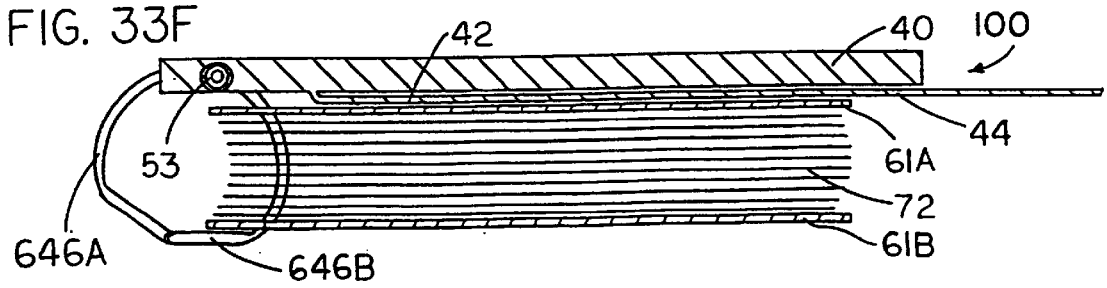

Ring 646 comprises ring segments 646A–646B and the portion of spine 53 intersected by ring segments 646A–646B. Ring segment 646A has ring segments 646P–646Q and ring segment 646B has ring segments 646R–646S. Mostly circular ring segments 646P and 646R are joined to straight ring segments 646Q and 646S, respectively. Straight ring segments 646Q and 646S are parallel with lines X2 and Y2, respectively, and constitute a multiple-line perimeter segment. Line X2 is a tangent line to spine 53 and ring segment 646R and line Y2 is a tangent line to spine 53 and ring segment 646P. When rings 646 are in their upright position, line X2 is in the plane of the exterior surface 40X of back cover 40 and ring segment 646Q is parallel as shown in FIG. 33B. Distance A3 measured from the interior surface 40N of back cover 40 to the under surface of rings segment 646Q is the upright-ring loose-leaf capacity of rings 646. Similar to rings 346, rings 646 are wider than tall such that the upright-ring loose-leaf capacity of rings 646 is less than or equal to the loose-leaf capacity of rings 646 for the range of spine rotation illustrated in FIGS. 33B–33F. Rings 646 rotate through a smaller angular range in FIGS. 33B–33F than rings 346 rotate in FIGS. 30B–30F. Cover 100 of FIGS. 33B–33F is preferably loaded and unloaded with loose-leaves when cover 100 is open 180 degrees and rings 646 are substantially upright.

FIG. 34

FIG. 34 is the bottom view of another preferred embodiment of a ring component 746 of the present invention. Ring 746 is very similar to ring 346 except that spine 553 is incorporated in place of spine 53. Ring 746 comprises ring segments 746A–746B and the portion of spine 553 intersected by ring segments 746A–746B. Ring segments 746A and 746B closely correspond in shape and function to ring segments 346A and 346B of FIGS. 30A–30F. Rings 746 are incorporated in binders 23–25 shown in FIGS. 23A–25B where the skeleton is fixed to the cover with a fastener or rivet.

FIG. 35

FIG. 35 is the bottom view of another preferred embodiment of a ring component 846 of the present invention. Ring 846 is very similar to ring 546 except that spine 553 is incorporated in place of spine 53. Ring 846 comprises ring segments 846A–846B and the portion of spine 553 intersected by ring segments 846A–846B. Ring segments 846A and 846B closely correspond in shape and function to ring segments 546A and 546B of FIGS. 32A–32F. Rings 846 can be incorporated in binder 25 shown in FIGS. 25A–25B where the skeleton is fixed to back cover 1740D with a rivet.

The invention provides for a minimal footprint during use without sacrificing other popular advantages common to loose-leaf binders. The binder provides the minimal footprint capability with minimal tearing stress on the loose-leaves, a flat writing surface and the ability to simultaneously open or close all rings of the binder via an actuator.

While my above descriptions contain many specificities, these should not be construed as limitations on the scope of the invention, but rather as an exemplification of several preferred embodiments thereof. Many other variations are possible. For example, all twenty-five binder embodiments with a SOCRA skeleton can instead use a skeleton having independently-openable rings. The cover embodiments with conduits that contain spine 53 can be joined with rings that are not connected by a spine; for example, skeleton 450 could be cut into three segments via cuts between its rings and then each segment placed end-to-end in conduit 56 as when they are unified. Other spineless embodiments are easily created from binders 13, 14 and 20 by eliminating skeleton 50 and inserting unconnected, independently-openable rings in place of rings 46 of these binders. Skeletons with more rings can be substituted by adding a corresponding number of slots to the binder cover. Skeletons with a synchronized switching element different from those disclosed herein may be substituted. Furthermore, a synchronized switching element that opens or closes all the rings simultaneously can be replaced by a sequential switching element that opens or closes all the rings sequentially. Margin supports can be eliminated especially when writing-support pads are included. Binder 1 can be modified by eliminating its middle cover segment and attaching a wider unsegmented flexible front cover directly to back cover 40 at the location of seam 66. The skeleton of FIGS. 26A–26C can be modified so that its rings can pitch back and forth like the skeleton of FIG. 29A to enable reduced binder thickness when the binder is not filled to capacity. The binder of FIG. 8 could have a second loops flap attached to its middle cover to provide an alternative attachment to the back cover. Other variants comprise a skeleton with rings that can rotate relative to its spine's longitudinal dimension while a portion of its spine is held still. One such variant comprises a spine with a rectangular cross-section with a height equal to the thickness of its back cover and where the spine rigidly attaches along one edge of the back cover flush with the interior and exterior surfaces of the back cover to extend the back cover writing surface; the spine connects binder rings which can rotate about the spine's longitudinal dimension through slots in the spine. A second such variant can be made simply by placing spine 53 of skeleton 50 in a sleeve with slots corresponding to rings 46 that allow spine 53 to rotate relative to the sleeve; the sleeve which is part of this variant's spine can be rigidly riveted to a cover but still allow spine 53 contained therein and rings 46 to rotate relative to the cover. This use of a fixed sleeve may include the previous variant above where the sleeve is designed with a rectangular cross-section, and having spine 53 of skeleton 50 disposed within and rotatable relative to the rectangular sleeve while the sleeve is held still. Another variant, which lacks a distinct skeleton component, has a cover which is integrally formed with a synchronized switching element for simultaneously opening and closing its rings and which folds flat when open 360 degrees, and has rings that can rotate around a near-ring edge of the flatly-folded cover when the cover is open 360 degrees.

FIGS. 36A–36F

FIGS. 36A–36F show perspective and bottom views with a detailed sectional portion of a further preferred embodiment of a skeleton 650 and its components of the binder of the present invention. Ring segments 46A are attached to rod 652A via weld, braze, casting or other appropriate means. Similarly, ring segments 46B are attached to rod 652B. When rod 652A is assembled alongside rod 652B within wrap housing 41 to form spine 653, the spaced ring segments 46A and 46B protrude through similarly spaced slots 155A and 155B, respectively, of wrap housing 41. Slots 155A and 155B are integrally formed with housing-slot arch 112. Slots 155A and 155B closely bound ring segments 46A and 46B to prevent longitudinal motion of rod 652A relative to rod 652B. Rods 652A and 652B rotate adjacent to each other in opposite directions through a limited angle to open and close ring segments 46A relative to ring segments 46B of rings 46. Since rods 652A and 652B cannot move longitudinally relative to each other, ring segments 46A and 46B of ring 46 open and close transversely relative to spine 653. Rods 652A and 652B have cross-sections that are preferably circular or slightly elliptical, having widths and heights that are of similar size so that the width and height of the resultant spine are similar in magnitude, preferably neither dimension being more than double the size of the other, thus keeping the resultant spine suitable for pivotal insertion in a conduit of a cover segment (FIGS. 45B–45C). Or more broadly stated, each rod 652A and 652B has a cross-section with a major dimension and minor dimension that are roughly perpendicular and that are similar in magnitude so that the major dimension and minor dimension of the cross-section of the resultant spine are similar in magnitude.

Roughly L-shaped torque levers 45A and 45B are integrally formed with or are attached to the ends of rods 652A and 652B, respectively, by weld, braze, casting, or other appropriate means. Torque levers 45A and 45B, which are spanned by tensile spring 83 of spreader 59, have elongated stems that extend transversely from spine 653 and its component rods 652A and 652B. Consequently, torque levers 45A and 45B are highly effective in transforming the tensile force exerted by spring 83 into strong opposing torsional forces, which act on rods 652A and 652B when rings 46 are opened and closed or are in the process of being either opened or closed. For example, when skeleton 650 is closed, springs 83 pull torque levers 45A and 45B towards each other, which is transmitted as opposing static torque to rods 652A and 652B, which in turn, is transmitted as opposing static forces on the free ends of rings 46A and 46B to keep rings 46 closed. Torque levers 45A and 45B provide for robust closure of rings 46.

FIG. 36E shows a bottom view of skeleton 650 with a detailed sectional portion showing components of the synchronized switching element or actuator 451 of skeleton 650. Actuator 451 comprises rods 652A and 652B, torque levers 45A and 45B, and spreader 59. In this embodiment of a skeleton 650, rods 652A and 652B serve as the first and second connective elements, respectively, of actuator 451. Spring-loaded spreader 59 includes spring 83 housed within telescopic capsule 85 and thus is able to extend and retract. Retraction of spreader 59 is limited by stop 232. FIG. 36F shows Telescopic capsule 85 has pinholes 63A and 63B which receive the free ends of L-shaped torque levers 45A and 45B, respectively. One end of spreader 59 pivots about the free end of torque lever 45A and the other end of spreader 59 pivots about the free end of torque lever 45B.

Spring 83 of actuator 451 is tensilely loaded when skeleton 650 is either open or closed and spring 83 resists the opening of ring segments 46A relative to ring segments 46B when spring 83 is on the ring side of spine 653 (FIG. 36E). However, spring 83 resists the closure of ring segments 46A and 46B when spring 83 is on the opposite side of spine 653 away from the free ends of ring segments 46A and 46B (FIG. 36F).

To open skeleton 650, middle rings 46A and 46B of skeleton 650 are pulled apart, which twists rods 652A and 652B, which in turn spreads torque levers 45A and 45B apart against the resistance of springs 83 until springs 83 travel from one side of spine 653 to the other side at which point springs 83 switch from exerting closure force on skeleton 650 to exerting opening force. When driven only by this opening force, Skeleton 650 continues opening until telescopic capsule 85 of spreader 59 retracts to its limit as set by stop 232.

To close skeleton 650, rings 46A and 46B are pushed toward each other against resistance of springs 83 until springs 83 travel from one side of spine 653 to the ring side of spine 653 at which point springs 83 switch from exerting opening force on skeleton 650 to exerting closure force. When driven only by this closure force, Skeleton 650 continues closing until the free ends of rings 46A and 46B abut each other. Rings 46 then remain closed because of the tensile loading of springs 83.

FIGS. 37A–37D

FIGS. 37A–37D show perspective and bottom views of a further preferred embodiment of a skeleton 750 and its components of the binder of the present invention with detailed sectional portions of the actuator 551 thereof. Skeleton 750 comprises the same spine 653 and rings 46 as skeleton 650 shown in FIGS. 36A–36F, but incorporates different torque levers 145A–145B and spreader 159. Actuator 551 comprises rods 652A and 652B of spine 653, torque levers 145A and 145B, and spreader 159. In particular, FIG. 37A shows an exploded view of another preferred embodiment of a spring-loaded spreader 159. Spreader 159 comprises telescopic capsule 185, static pins 102A–102B, slide pin 102C, and tensile spring 83. Capsule segment 185A fits snugly into and can slide longitudinally within capsule segment 185B. Capsule segment 185A has guide slot 101A and pinhole 163A, which receives static pin 102A. Capsule segment 185B has guide slot 101B and pinhole 163B, which receives static pin 102B. When spreader 159 is assembled and is part of skeleton 750, slide pin 102C is inserted within both guide slots 101A and 101B and is hooked by one end of spring 83; static pin 102B is hooked by the other end of spring 83 and is inserted within pinhole 163B of capsule segment 185B as well as within hole 163D of torque lever 145B; and static pin 102A is inserted within pinhole 163A of capsule segment 185A as well as within hole 163C of torque lever 145A.

To open skeleton 750, middle rings 46A and 46B of skeleton 750 are pulled apart, which spreads torque levers 145A and 145B apart against the resistance of springs 83. As torque levers 145A and 145B spread wider, capsule segment 185A telescopically extends from capsule segment 185B and the border of guide slot 101A pushes slide pin 102C along guide slot 101B in the direction of static pin 102A until it reaches the tip of pointed tooth 128 of guide slot 101B. Upon clearing this tip, guide slot 101A pushes slide pin 102C in a new direction roughly toward spine 653. After clearing this tip, slide pin 102C will maintain spreader 159 in its extended position upon release of rings 46A and 46B, thus keeping rings 46 open (FIG. 37D).

To close skeleton 750, middle rings 46A and 46B of skeleton 750 are pushed toward each other, which brings torque levers 145A and 145B towards each other against the partial resistance of springs 83. As torque levers 145A and 145B approach each other, capsule segment 185A telescopically retracts within capsule segment 185B and the border of guide slot 101A pushes slide pin 102C along guide slot 101B in the direction away from spine 653 toward the tip of pointed tooth 128. After clearing this tip, spring 83 drags slide pin 102C along guide slot 101B in the direction of static pin 102B to retract spreader 159 until ring segments 46A abut ring segments 46B, thus closing rings 46 (FIG. 37C). Springs 83 are still under tension when rings 46 are closed which provides for spring-loaded closure of skeleton 750.

FIGS. 38A–38C

FIGS. 38A–38C show perspective and bottom views of a further preferred embodiment of a skeleton 850 of the binder of the present invention with detailed sectional portions of the actuator 651 thereof. Skeleton 850 comprises the same spine 653 and rings 46 as skeleton 650 shown in FIGS. 36A–36F, but incorporates different torque levers 145A–145B and spreader 259. Actuator 651 comprises rods 652A and 652B of spine 653, torque levers 145A and 145B, and spreader 259. FIG. 38B shows a sectional view of another preferred embodiment of a spring-loaded spreader 259. Spreader 259 comprises telescopic capsule 285, pins 102A–102B, spin cylinder 103A, slide cylinder 103B, and tensile spring 83. Capsule 285 includes capsule cylinder 285A, which fits snugly into and can slide longitudinally within capsule segment 285B. Slide cylinder 103B fits in spin cylinder 103A, which in turn fits in capsule cylinder 285A. Capsule cylinder 285A has pinhole 263A, which receives pin 102A and capsule segment 285B has pinhole 263B, which receives pin 102B. When spreader 259 is assembled into skeleton 850, pin 102A is inserted within pinhole 263A of capsule cylinder 285A as well as within hole 163C of torque lever 145A (FIGS. 37B and 38A–38B) and is hooked by one end of spring 83; pin 102B is hooked by the other end of spring 83 and is inserted within pinhole 263B of capsule segment 285B as well as within hole 163D of torque lever 145B.

Spin cylinder 103A, slide cylinder 103B, and Capsule cylinder 285A are part of a two-state mechanical switch well known to ballpoint pens for extending and retracting the ballpoint. In ballpoint pens, this two-state mechanical switch depends upon the constant resistance of a compression spring; in skeleton 850, the constant resistance is supplied by tensile spring 83 via linkages (pins 102A–102B). Additionally, the characteristic push button cylinder of the ballpoint mechanism is adapted here to become slide cylinder 103B, which is pulled by pin 102B. This adaptation includes removing the portion of the push button cylinder that would protrude from the top of the ballpoint pen and adding the cylindrical portion of slide cylinder 103B that penetrates spin cylinder 103A and loops pin 102B (FIG. 38B). Instead of pressing a push button once to extend a ballpoint and a second time to retract it, ring segments 46A and 46B are pulled apart and released once to extend spreader 259, which maintains rings 46 open, and are pulled apart and released a second time to retract spreader 259, allowing rings 46 to close. The straight grooves and spiral ledges of spin cylinder 103A, slide cylinder 103B, and capsule cylinder 285A, which characterize this two-state switch, are well known and are not illustrated in FIGS. 38A–38C.

To open skeleton 850, middle rings 46A and 46B of skeleton 850 are pulled apart, which spreads torque levers 145A and 145B apart against the resistance of springs 83. Spreading torque levers 145A and 145B separates pins 102A and 102B so that pin 102B pulls slide cylinder 103B away from capsule cylinder 285A; concurrently, slide cylinder 103B also pushes spin cylinder 103A in the same direction and capsule cylinder 285A telescopically extends from capsule segment 285B. If the rings are pulled far enough apart and released, spin cylinder 103A moves to its extended position to lock spreader 259 in its extended state under the force of spring 83. When spreader 259 is locked in its extended state between torque levers 145A and 145B, rings 46 are kept open (FIG. 38C).

To close skeleton 850, middle rings 46A and 46B of skeleton 850 are pulled apart again and released. If pulled apart far enough and released under the force of spring 83, spin cylinder 103A moves to its retracted position enabling spreader 259 to retract as well such that capsule cylinder 285A telescopically retracts within capsule segment 285B. Torque levers 145A and 145B approach each other, until ring segments 46A abut ring segments 46B, thus closing rings 46 (FIG. 38B). Springs 83 are still under tension when rings 46 are closed which provides for spring-loaded closure of skeleton 850.

Spreader 259 can be assembled in an alternative way by attaching spring 83 to spin cylinder 103A, instead of pin 102B, by an appropriate attachment means that does not inhibit the spin action associated with spin cylinder 103A during operation. When this alternative assembly is used, ring segments 46A–46B can flop back and forth a limited distance when rings 46 are open and are not biased to a fixed position.

FIGS. 39A–39C

FIGS. 39A–39C show a front view of another preferred embodiment of a spreader 359 and bottom views of a further preferred embodiment of a skeleton 950 of the binder of the present invention. Skeleton 950 comprises the same spine 653 and rings 46 as skeleton 650 shown in FIGS. 36A–36F, but incorporates different torque levers 245A–245B and spreader 359. Skeleton 950 has actuator 751, which comprises rods 652A and 652B of spine 653, zigzag torque levers 245A and 245B, and spreader 359. Spreader 359 is a bar having pinholes 363A and 363B, which receive torque levers 245A and 245B, respectively. Zigzag torque levers 245A and 245B have open and closed indentation positions for spreader 359.

To open skeleton 950, spreader 359 is slid along both torque levers from the closed indentation position (FIG. 39B) to the open indentation position (FIG. 39C). Spreader 359 is able to slide from the closed indentation position because of the elasticity of torque levers 245A–245B and the twist elasticity of spine rods 652A–652B of spine 653.

To close skeleton 950, spreader 359 is slid along both torque levers from the open indentation position to the closed indentation position. Closure of skeleton 950 can seem slightly spring-loaded if preferred by utilizing the elasticity of torque levers 245A–245B and twist elasticity of rods 652A–652B of spine 653; to add the appearance of slight spring-loaded closure, pinholes 363A–363B of spreader 359 are simply located a little closer to each other than their positions on a spreader 359 that just brings ring segments 46A and 46B of skeleton 950 into contact without stress.

FIGS. 40A–40B

FIGS. 40A–40B show perspective views of portions of a further preferred embodiment of a skeleton 1050 of the binder of the present invention. Skeleton 1050 comprises the same spine 653 as skeleton 650 shown in FIGS. 36A–36F, but incorporates a different middle ring 946 and has no torque levers and no spreaders. Skeleton 1050 has actuator 851, which comprises rods 652A and 652B of spine 653 and interlocking ring 946 with ring sleeve 106. Skeleton 1050 also has rings 46 near opposite ends of spine 653, but are not shown in FIGS. 40A–40B. Ring sleeve 106 is springy and has inner protruding rim 106A. Ring 946 has ring notches 107A and 107B near ring interlock 108. When ring 946 is locked securely closed, ring sleeve 106 covers ring interlock 108 and is held in place by rim 106A which is spring-biased to ring-closure notch 107A. Sleeve 106 reinforces interlock 108, which otherwise is prone to open accidentally during use.

To open skeleton 1050, ring sleeve 106 is pulled away from notch 107A and is slid along ring 946 away from interlock 108 until rim 106A finds ring-open notch 107B; then ring segments 946A and 946B are unhitched and pulled apart (FIG. 40B). To close skeleton 1050, ring segments 946A and 946B are hitched together creating interlock 108; then ring sleeve 106 is pulled away from ring-open notch 107B and is slid along ring 946 toward interlock 108 until rim 106A finds ring-closure notch 107A.

Closure of rings 46 of skeleton 1050 can seem slightly spring-loaded if preferred by utilizing the elasticity of ring segments 946A–946B, ring segments 46A–46B, and twist elasticity of rods 652A–652B of spine 653. To add the appearance of slight spring-loaded closure, ring segments 946A–946B and ring segments 46A–46B should be attached to rods 652A–652B, respectively, such that ring segments 946A and 946B are slightly open when ring segments 46A and 46B abut each other; when ring segments 946A and 946B are then forced together and locked close, rings 946, rings 46, and rods 652A–652B will all be under elastic loading.

FIGS. 41A–41F

FIGS. 41A–41F show perspective and bottom views and a detailed sectional portion of a further preferred embodiment of a skeleton 1150 and its components of the binder of the present invention. Skeleton 1150 has rings 46, spine 753, and actuator 851. Rings segments 46A and 46B are attached to rods 752A and 752B, respectively, via weld, braze, casting, or other appropriate means. Cleats 109A and 109B are attached to the backs of rods 752A and 752B, respectively. Spine 753 is formed by assembling rod 752A alongside rod 752B within wrap bands 141 and with cleats 109A interspaced with cleats 109B. Both the snug placement of bands 141 between pairs of rings 46 as well as the snug interspacing of cleats 109A with 109B prevent the longitudinal motion of rod 752A relative to rod 752B. Cleats 109A and 109B are attached to rods 752A and 752B along edges 752C and 752D, respectively, to facilitate pivot motion between rods 752A and 752B. When spine 753 is assembled, rods 752A and 752B pivot in opposite directions about contacting edges 752C and 752D through a limited angle to open or close ring segments 46A relative to ring segments 46B. The transverse cross-section of rods 752A and 752B (excluding cleats 109A–109B) are shaped like a slice of pie having an obtuse angle (FIG. 41E). The pie-slice cross-sections of rods 752A and 752B and the short-length of cleats 109A–109B enable this pivot motion to occur within a cylindrical space, the obtuse-angle point of each pie-slice cross-section corresponding to edges 752C and 752D, respectively.

Torque levers 345A and 345B are integrally formed with or are attached to the ends of rods 752A and 752B preferably by casting, but may be attached by weld, braze, or other appropriate means. To facilitate the preferred casting of the whole component of skeleton 1150 shown in FIG. 41B as well as the whole component of skeleton 1150 shown in FIG. 41C using only one mold, torque lever 345A is attached to the bottom of rod 752A and the top of rod 752B, and torque lever 345B is attached to the bottom of rod 752B and the top of rod 752A. Torque levers 345A and 345B have protruding knobs 345C and 345D, respectively, which are connected by tensile spring 83. Push levers 87A and 87B are integrally formed with torque levers 345A and 345B, respectively. Spring-metal ratchet pawl 105 is attached to push lever 87A and engages push lever 87B when push levers 87A and 87B are pivoted through a particular angle. Extendable capsule 385 hides spring 83 and has capsule segments 385A–385B. Capsule segments 385A and 385B are integrally formed with torque levers 345A and 345B, respectively.

FIGS. 41E–F shows bottom views of skeleton 1150. Actuator 851 comprises rods 752A and 752B, torque levers 345A and 345B, spreader 459, and push levers 87A and 87B. In this embodiment of a skeleton 1150, rods 752A and 752B serve as the first and second connective elements, respectively, of actuator 851. Spring-loaded spreader 459 comprises spring 83, ratchet pawl 105, and push levers 87A–87B and locks rings open when pawl 105 of push lever 87A engages push lever 87B. Tensile spring 83 is always under tension upon assembly of skeleton 1150.

To open skeleton 1150, push levers 87A and 87B are pushed together against the resistance of spring 83 until ratchet pawls 105 engage push levers 87B, meanwhile rods 752A and 752B pivot in opposite directions to open rings 46. Upon engagement, ratchet pawls 105 resists the closure of skeleton 1150 by spring 83 (FIG. 41F).

To close skeleton 1150, the free ends of ratchet pawls 105 are lifted away from push levers 87B to disengage them, allowing spring 83 to act on torque levers 345A and 345B to pivot rods 752A and 752B until ring segments 46A abut ring segments 46B (FIG. 41E). Rings 46 then remain closed because of the tensile loading of springs 83.

FIG. 42

FIG. 42 shows a sectional view of a further preferred embodiment of a spine 853 of the binder of the present invention with rings 46 attached. Spine 853 has interlocking rods 852A and 852B, which do not require a wrapping band or housing to be assembled, but are joined together in puzzle-link fashion. Rod 852A has a cross-section of a partial hollow cylinder, having a longitudinal opening 104 extending the length of rod 852A and which receives a partly cylindrical portion of rod 852B. Rod 852B has a cross-section with a partly circular portion that when extended longitudinally is the partly cylindrical portion of rod 852B, which is inserted into rod 852A. A portion of rod 852B protrudes into longitudinal opening 104 enabling rod 852B to be stronger than if it were only a cylindrical rod because of its relatively larger cross-sectional area, which is roughly shaped like a short old-fashioned keyhole. The width or span of the longitudinal opening 104 of rod 852A is smaller than the diameter of the partly cylindrical portion of rod 852B; therefore, rod 852B is inserted into rod 852A either by snapping it in transversely, or by sliding it in longitudinally from one end. Rods 852A and 852B are constrained from moving longitudinally relative to one another by some means but can pivot through a limited angle relative to each other to enable the opening and closing of ring segments 46A relative to ring segments 46B. Since rods 852A and 852B cannot move longitudinally relative to each other, ring segments 46A and 46B of ring 46 open and close transversely relative to spine 853.

FIGS. 43A–43B

FIGS. 43A–43B show bottom views with a detailed sectional portion of a further preferred embodiment of a skeleton 1250 of the binder of the present invention. Ring segments 46A and 46B and cleats 109A and 109B are attached to rods 952A and 952B, respectively. Rods 952A and 952B have longitudinal clefts 110A and 110B, which receive opposite edges of sheet-metal arc-spring housing 43. Spine 953 is formed by assembling rod 952A alongside rod 952B within arc-spring housing 43 and with cleats 109A interspaced with cleats 109B. Rod 952A and 952B can pivot about contacting edges 952C and 952D upon assembly of spine 953. Arc-spring housing 43 exerts a compressive force on clefts 110A and 110B. When edges 952C and 952D are within the perimeter of arc-spring housing 43, this compressive force acts to keep rings 46 closed (FIG. 43A) and when edges 952C and 952D are outside the perimeter of arc-spring housing 43, this compressive force acts to keep rings 46 open (FIG. 43B). Rods 952A and 952B have roughly pie-slice-shaped cross-sections (excluding cleats 109A–109B), which enables spine 953 to have a substantially cylindrical cross-section when rings 46 are closed (FIG. 43A). Skeleton 1250 has actuator 951, which comprises rods 952A–952B and spring 43.

To open skeleton 1250, ring segments 46A and 46B are pulled apart against the compressive force of arc-spring housing 43 until edges 952C and 952D pivot beyond the perimeter of the arc-spring housing 43 at which point the compressive force begins to open the rings. Rings 46 continue opening until cleats 109A and 109B abut rods 952B and 952A respectively. To close skeleton 1250, ring segments 46A and 46B are pushed together until they abut each other and then kept closed by the compressive force of arc-spring housing 43. Optional torque levers with spring-loaded spreaders can be added to skeleton 1250 to increase the robustness of the closure force.

FIG. 44

FIG. 44 shows a bottom view of a further preferred embodiment of a ring 1046 of the binder of the present invention. Ring 1046 comprises ring segments 1046A–1046B and the portion of spine 53 intersected by ring segments 1046A–1046B. Ring segments 1046A and 1046B have varying prong thickness. Ring 1046 defines upright-ring diameter 111 which is the diameter that passes through the center of ring 1046 and the center of spine 53. The portions of ring segments 1046A–1046B that are roughly parallel to diameter 111 are thinner than the portions of rings segments 1046A–1046B that are roughly perpendicular to diameter 111. Consequently, the inner diameter of ring 1046 that is parallel to diameter 111 is less than the inner diameter that is perpendicular to diameter 111. This variable prong thickness enables a more stable loose-leaf ring capacity during usage when the binder may be closed, opened 180 degrees, or opened 360 degrees. This variable prong thickness stabilizes capacity by compensating for the reduction in capacity otherwise caused by the existence of the spine 53 within the ring perimeter when the binder is open 360 degrees.

FIGS. 45A–45C

FIG. 45A shows a perspective view of a further preferred embodiment of a skeleton 1350 of the binder of the present invention. FIGS. 45B–45C are bottom views of Binder 1 of FIGS. 1A–1L, with skeleton 1350 substituted in place of skeleton 50. Skeleton 1350 uses the same rods 652A–652B of spine 653 described with FIGS. 36A–36F and the spreader 259 described with FIGS. 38A–38C. Skeleton 1350 has rings 1146, spine 1053, and actuator 1051. Ring segments 1146A and 1146B are attached to rods 652A and 652B, respectively, via weld, braze, casting, or other appropriate means. Likewise, intra-ring torque levers 445A and 445B are integrally formed with or are attached to the spine-end of ring segments 1146A and 1146B, respectively. Intra-ring torque levers 445A–445B exist within both the plane and perimeter of the ring segments 1146A–1146B to which they are attached. Although torque levers 445A–445B are integrally formed with the ends of ring segments 1146A–1146B, respectively, at the intersection with spine 1053, torque levers 445A–445B are distinguishable from ring segments 1146A–1146B in that loose-leaves 72 are prevented from hanging off of torque levers 445A–445B by spine 1053. Rings 1146 comprise rings segments 1146A and 1146B and the portion of spine 1053 that is intersected, and excludes torque levers 445A and 445B. Spine 1053 is formed by assembling rod 652A alongside rod 652B within wrap bands 241, which are snugly fitted between pairs of rings 1146. Rods 652A and 652B rotate adjacent to each other in opposite directions through a limited angle to open and close ring segments 1146A relative to ring segments 1146B of rings 1146. The snug placement of bands 241 between pairs of rings 1146 prevent the longitudinal motion of rod 652A relative to rod 652B. Actuator 1051 comprises rods 652A–652B, torque levers 445A–445B, and spreader 259. Spreader 259 connects middle torque levers 445A and 445B and springs 83 connect the torque levers 445A and 445B that are located near opposite ends of spine 1053. Spreader 259 is attached to skeleton 1350 via pins 102A–102B, which are inserted within holes 463A–463B, respectively, of torque lever 445A (FIG. 45B). Rings segments 1146A and 1146B have margin ring segments 1146C and 1146D, respectively. The purpose of margin ring segments 1146C and 1146D is to accommodate the margin of ring-bound loose-leaves 72 between the loose-leaf holes and adjacent loose-leaf edge during usage (FIGS. 45B–45C). FIGS. 45B–45C show skeleton 1350 inserted within back cover 40 of cover 100 with front cover 44 flipped 360 degrees from its closed cover position.

Skeleton 1350 is operated in the same manner as skeleton 850 of FIGS. 38A–38C, which also has spreader 259.

Skeleton embodiments 650, 750, 850, 950, 1050, 1150, 1250 and 1350 can be used in place of skeleton embodiment 50 in each and every of the preferred embodiments that incorporate skeleton 50 of the present invention via a small modification to the covers to accommodate torque lever pairs 45A–45B, 145A–145B, 245A–245B, 345A–345B, 445A–445B, spreaders 59, 159, 259, 359, 459 and/or push levers 87A and 87B, which are more broadly categorized as actuator levers. Only a small modification is needed because the torque lever, spreader, and actuator lever embodiments of the present invention remain in the longitudinally projected perimeter of their associated ring embodiments as seen in FIGS. 36E, 37C, 38B, 39B, 41E, and 45B. Therefore, the various means employed by the cover embodiments of the present invention to accommodate rotation of the rings about an edge of the flatly folded covers can be used to accommodate rotation of the torque levers, spreaders, and actuator levers. For example, this modification can be simply a transverse slot or equivalent means that is incorporated into the covers of the respective embodiments of the binders of the present invention such as slots 58A–58C of FIG. 1A or holes 74C–74D of FIG. 20A. Furthermore, transverse opening of rings and transverse spreading of torque levers during use enable cover slots such as cover slots 58A–58C of FIG. 1A to be narrow.

Intra-ring torque levers 445A–445B of skeleton 1350 exist within both the plane and perimeter of the ring segments 1146A–1146B to which they are attached. Consequently, skeleton 1350 can be used in all of the cover embodiments of the binder of the present invention that use slots to avoid cover interference with ring rotation when these cover embodiments are open 360 degrees (FIGS. 1A–1F, FIGS. 19A–19C), but not with some cover embodiments (unless modified) that use cover holes (FIGS. 20A–20C).

While my above descriptions contain many specificities, these should not be construed as limitations on the scope of the invention, but rather as an exemplification of several preferred embodiments thereof. Many other variations are possible. For example, although spring-loaded spreaders have been shown with tensile springs, spreaders and torque levers can be adapted and possibly other parts added to use other springs such as compression, torsion, spiral, and sheet-metal springs. Rubber bands may also be substituted for tensile springs. Another possible embodiment of a spreader comprises a toggle switch and tensile spring. Spreaders and actuator levers with longitudinally oriented components that connect the transversely oriented intra-ring torque levers of skeleton 1350 can be incorporated, but these longitudinally oriented components must be positioned high enough within the rings away from the spine so as to clear the near-ring edge of the flat formation of various cover embodiments when the rings are rotated about the near-ring edge. Another possible embodiment of a pair of torque levers is a pair of interlocking torque levers; the interlocking means of such torque levers may or may not be spring-loaded.

It will appreciated by persons skilled in the art that herein described is a loose-leaf binder and analogous products and method of use. While the present invention has been described by reference to various preferred embodiments, it will be understood by persons skilled in the art that many modifications and variations may be made in those preferred embodiments without departing from the spirit and scope of the present invention. Accordingly, it is intended that the invention not be limited to the disclosed preferred embodiments and that it have the full scope permitted by the following claims.

I claim:

1. A binder for releasably binding a plurality of loose-leaves comprising:

a spine having a first rod and a second rod, a plurality of binder rings each having a first ring segment and a second ring segment, at least one pair of torque levers having a first torque lever and a second torque lever, a spreader linking said first torque lever to said second torque lever, an actuator for opening all of said binder rings substantially together, each of said binder rings attached to said spine, said first rod attached to each of said first ring segments and to said first torque lever, said second rod attached to each of said second ring segments and to said second torque lever, said first torque lever and said second torque lever transversely protruding from said spine, position of said spreader affecting the spread of said first torque lever relative to said second torque lever to control the opening and closure of said binder rings.

2. The binder of claim 1 wherein said spreader has a spreader housing capsule.

3. The binder of claim 2 wherein said spine has a spine housing, said spine housing is independent of said spreader housing capsule.

4. The binder of claim 2 wherein said spreader housing capsule can telescopically extend and retract.

5. The binder of claim 1 wherein said spreader has a spring to spring-load closure of said plurality of binder rings.

6. The binder of claim 1 wherein said plurality of binder rings has a loose-leaf stack space which is a space usable for occupation by loose-leaves concurrently bound on said binder rings, said pair of torque levers is attached at one end of said spine longitudinally beyond said loose-leaf stack space, whereby said pair of torque levers will not interfere with ring-bound loose-leaves.

7. The binder of claim 1 wherein a ring one of said plurality of binder rings exists in a transverse plane relative to said spine, said pair of torque levers is a pair of intra-ring torque levers located within the perimeter of said ring one and in said transverse plane.

8. The binder of claim 1 wherein said pair of torque levers is a pair of zigzag torque levers, said pair of zigzag torque levers have a zigzag shape which define a rings-closed position and a rings-open position, said spreader slides along said pair of zigzag torque levers from said rings-closed position to said rings-open position and vice versa to open and close said plurality of binder rings, respectively.

9. The binder of claim 1 wherein the longitudinal projection of the outer perimeter of said torque levers and said spreaders resides within the longitudinal projection of the outer perimeter of at least one of said plurality of binder rings.

10. A binder for releasably binding a plurality of loose-leaves comprising:

a spine having a first rod and a second rod, a plurality of binder rings each having a first ring segment and a second ring segment, an actuator for opening all of said binder rings substantially together, said first rod is located along side and mutually external to said second rod upon assembly of said spine, each of said binder rings attached to said spine, said first rod attached to each of said first ring segments, said second rod attached to each of said second ring segments, said spine has a spine transverse major dimension and a spine transverse minor dimension that are roughly perpendicular, a longest diameter of said binder rings has a length that is at least three times said spine transverse major dimension, said spine transverse major dimension is not more than double said spine transverse minor dimension, said first rod has a rod transverse major dimension and a rod transverse minor dimension, said rod transverse major dimension is not more than double said rod transverse minor dimension, whereby the thinness of said spine via thin said first rod and said second rod along with much wider said binder rings facilitates incorporation of said spine with a cover that folds in a flat formation with a near-ring edge about which said binder rings are rotatable enabling ring-bound loose-leaves above said flat formation to lie substantially flat and parallel to ring-bound loose-leaves below said flat formation when said cover is open 360 degrees.

11. The binder of claim 10 wherein said first ring segments are attached to said first rod and said second ring segments are attached to said second rod using space-saving attachment means selected from the group consisting of weld, braze, solder, casting, and adhesive, whereby the use of said space-saving attachment means to attach said plurality of binder rings to said spine instead of conventional penetrative rivet attachment facilitates decreasing the cross-sectional profile of said first rod, said second rod and resultant said spine.

12. The binder of claim 10 wherein at least one of said plurality of binder rings is an interlocking ring, said interlocking ring has an interlock when said first ring segment and said second ring segment of said interlocking ring are hitched together to close said interlocking ring.

13. The binder of claim 12, further comprising:

a ring sleeve, said ring sleeve can slide upon said interlock to reinforce closure of said interlocking ring.

14. The binder of claim 10, further comprising:

at least one pair of torque levers having a first torque lever and a second torque lever, a spreader linking said first torque lever to said second torque lever, said first rod attached to said first torque lever, said second rod attached to said second torque lever, said first torque lever and said second torque lever transversely protruding from said spine, position of said spreader affecting the spread of said first torque lever relative to said second torque lever to control the opening and closure of said binder rings.

15. The binder of claim 10, further comprising:

at least one pair of torque levers having a first torque lever and a second torque lever, an interlocking means to hitch said first torque lever to said second torque lever, said first rod attached to said first torque lever, said second rod attached to said second torque lever, said first torque lever and said second torque lever transversely protruding from said spine, said torque levers are physically distinct from said plurality of binder rings such that ring-bound loose-leaves do not hang on said torque levers, said plurality of binder rings has a loose-leaf stack space which is a space usable for occupation by loose-leaves concurrently bound on said binder rings, said pair of torque levers exist outside of said loose-leaf stack space, said binder rings are closed when said torque levers are hitched together via said interlocking means and said binder rings are open when said torque levers are unhitched.

16. The binder of claim 10 wherein a ring one of said plurality of binder rings defines an upright-ring diameter which is the diameter that passes through the center of said ring one and the center of said spine within the transverse plane of said ring one, each of said binder rings having an intersected portion of said spine, said first ring segments and said second ring segments have varying prong thickness exclusive of said intersected portion of said spine, roughly-vertical portions of said first ring segments and said second ring segments that are roughly parallel to said upright-ring diameter are on average thinner than roughly-horizontal portions of said first ring segments and said second ring segments that are roughly perpendicular to said upright-ring diameter, a first inner diameter of said ring one that is overlapping said upright-ring diameter is less than a second inner diameter of said ring one that is perpendicular to said upright-ring diameter.

17. The binder of claim 10 wherein a longest line connecting two points on the perimeter of a transverse cross-section of said spine is less than or equal to seven millimeters, whereby said spine is suitable for insertion into a conduit of a cover as a pivot about which said cover can rotate.

18. A binder for releasably binding a plurality of loose-leaves comprising:

a spine having a first rod and a second rod, a plurality of binder rings each having a first ring segment and a second ring segment, an actuator for opening all of said binder rings substantially together, said first rod is a partial hollow cylinder having a longitudinal opening, said second rod has a partly cylindrical portion, each of said binder rings attached to said spine, said first rod attached to each of said first ring segments, said second rod attached to each of said second ring segments, said partly cylindrical portion of said second rod inserted into said partial hollow cylinder of said first rod with said second ring segments extending outwardly from location of said longitudinal opening, said partly cylindrical portion concentric and snugly fitted with said partial hollow cylinder enabling said second rod to pivot a limited angle relative to said first rod to open and close said first ring segments relative to said second ring segments, a longest ring diameter of said binder rings has a length that is at least three times a longest spine diameter of said spine, each of said first ring segments pivot transversely about said spine relative to corresponding said second ring segments to open and close said binder rings, each of said first ring segments and corresponding said second ring segments restrained from moving relative to each other in the longitudinal direction of said spine, whereby partly-cylindrically-shaped said first rod and said second rod enable said spine to be made very thin to be used along with much wider said binder rings to facilitate incorporation of said spine with a cover that folds in a flat formation with a near-ring edge about which said binder rings are rotatable enabling ring-bound loose-leaves above said flat formation to lie substantially flat and parallel to ring-bound loose-leaves below said flat formation when said cover is open 360 degrees, and transversely opening said binder rings enables the use of narrow cover slots or cover holes with said cover.

19. The binder of claim 18 wherein at least one of said plurality of binder rings is an interlocking ring, said interlocking ring has an interlock when said first ring segment and said second ring segment of said interlocking ring are hitched together to close said interlocking ring.

20. The binder of claim 19, further comprising:

a ring sleeve, said ring sleeve can slide upon said interlock to reinforce closure of said interlocking ring.

21. The binder of claim 18, further comprising:

at least one pair of torque levers having a first torque lever and a second torque lever, a spreader linking said first torque lever to said second torque lever, said first rod attached to said first torque lever, said second rod attached to said second torque lever, said first torque lever and said second torque lever transversely protruding from said spine, position of said spreader affecting the spread of said first torque lever relative to said second torque lever to control the opening and closure of said binder rings.

22. The binder of claim 18 wherein said second rod has a roughly short keyhole cross-section having an extended portion protruding through said longitudinal opening of said first rod when said spine is assembled, whereby said extended portion increases the strength of said second rod.

23. A binder for releasably binding a plurality of loose-leaves comprising:

a spine attached to a plurality of binder rings, each of said binder rings having a first ring segment, a second ring segment, and an intersected portion of said spine, an actuator for opening all of said binder rings substantially together, a ring one of said plurality of binder rings defines an upright-ring diameter which is the diameter that passes through the center of said ring one and the center of said spine within the transverse plane of said ring one, said first ring segments and said second ring segments have varying prong thickness exclusive of said intersected portion of said spine, roughly-vertical portions of said first ring segments and said second ring segments that are roughly parallel to said upright-ring diameter are on average thinner than roughly-horizontal portions of said first ring segments and said second ring segments that are roughly perpendicular to said upright-ring diameter, a first inner diameter of said ring one that is overlapping said upright-ring diameter is less than a second inner diameter of said ring one that is perpendicular to said upright-ring diameter.

24. A binder for releasably binding a plurality of loose-leaves comprising:

a spine having a first rod and a second rod, a plurality of binder rings each having a first ring segment and a second ring segment, at least one pair of torque levers having a first torque lever and a second torque lever, a spreader linking said first torque lever to said second torque lever, an actuator for opening all of said binder rings substantially together, each of said binder rings attached to said spine, said first rod attached to each of said first ring segments and to said first torque lever, said second rod attached to each of said second ring segments and to said second torque lever, said spine sweeps out a volume of revolution when said spine is rotated about its own longitudinal center axis, a smallest cylinder to contain said volume of revolution has a threshold radius, said first torque lever and said second torque lever transversely protruding from said spine to an extent such that said first torque lever and said second torque lever each transversely extend away from the longitudinal center axis of said spine a distance beyond the length of said threshold radius, position of said spreader affecting the spread of said first torque lever relative to said second torque lever to control the opening and closure of said binder rings.

25. The binder of claim 24 wherein a ring one of said plurality of binder rings has a ring perimeter, a transverse cross-section of said spine has a spine transverse perimeter, said spine is very thin relative to said ring one such that the ratio of said ring perimeter to a longest line connecting two points on said spine transverse perimeter is at least seven.

26. The binder of claim 24 wherein a ring one of said plurality of binder rings has a ring portion coincident with the intersection of said ring one and said spine, said spine is very thin relative to said ring one such that the interior angle associated with said ring portion as measured between two rays emanating from the center of said ring one and intersecting opposite ends of said ring portion is no more than forty-five degrees.

27. The binder of claim 10, further comprising:

at least one pair of torque levers having a first torque lever and a second torque lever, a spreader linking said first torque lever to said second torque lever, said first rod attached to said first torque lever, said second rod attached to said second torque lever, a first radial line emanating from and perpendicular to the longitudinal center axis of said spine terminates at the radially outermost point of said first torque lever, a second radial line emanating from and perpendicular to the longitudinal center axis of said spine terminates at the radially outermost point of said second torque lever, said first torque lever and said second torque lever transversely protruding from said spine such that said first radial line and said second radial line are each greater than half the longest line connecting two points on the perimeter of a transverse cross-section of said spine, position of said spreader affecting the spread of said first torque lever relative to said second torque lever to control the opening and closure of said binder rings.

28. A binder for releasably binding a plurality of loose-leaves comprising:

a spine attached to a plurality of binder rings, an actuator for opening all of said binder rings substantially together, each of said binder rings having a first ring segment, a second ring segment, and an intersected portion of said spine, a ring one of said plurality of binder rings defines an upright-ring diameter which is the diameter that passes through the center of said ring one and the center of said spine within the transverse plane of said ring one, said first ring segments and said second ring segments have varying prong thickness exclusive of said intersected portion of said spine, roughly-vertical portions of said first ring segments and said second ring segments that are roughly parallel to said upright-ring diameter are on average thinner than roughly-horizontal portions of said first ring segments and said second ring segments that are roughly perpendicular to said upright-ring diameter, a first inner diameter of said ring one that is overlapping said upright-ring diameter is less than a second inner diameter of said ring one that is perpendicular to said upright-ring diameter, said ring one of said plurality of binder rings has a ring perimeter, a transverse cross-section of said spine has a spine transverse perimeter, said spine is very thin relative to said ring one such that the ratio of said ring perimeter to a longest line connecting two points on said spine transverse perimeter is at least seven, whereby the combination of a very thin said spine in conjunction with much wider and distinctively-structured said binder rings helps to minimize or eliminate any lump attributed to said spine occurring when said spine is located between stacks of ring-bound loose-leaves.

* * * * *